US010782626B2

(12) United States Patent
Murakami et al.

(10) Patent No.: US 10,782,626 B2
(45) Date of Patent: Sep. 22, 2020

(54) IMAGE FORMING APPARATUS AND IMAGE FORMING METHOD

(71) Applicants: Masatoshi Murakami, Kanagawa (JP); Yoshinori Shirasaki, Kanagawa (JP); Masayuki Hayashi, Osaka (JP)

(72) Inventors: Masatoshi Murakami, Kanagawa (JP); Yoshinori Shirasaki, Kanagawa (JP); Masayuki Hayashi, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/423,509

(22) Filed: May 28, 2019

(65) Prior Publication Data

US 2019/0369518 A1 Dec. 5, 2019

(30) Foreign Application Priority Data

Jun. 1, 2018 (JP) ..... 2018-106443

(51) Int. Cl.
*G03G 15/01* (2006.01)
*G03G 15/16* (2006.01)

(52) U.S. Cl.
CPC ..... *G03G 15/0194* (2013.01); *G03G 15/0131* (2013.01); *G03G 15/1615* (2013.01); *G03G 2215/0161* (2013.01)

(58) Field of Classification Search
None
See application file for complete search history.

(56) References Cited

U.S. PATENT DOCUMENTS

2009/0238585 A1 9/2009 Hayashi et al.
2010/0119273 A1* 5/2010 Komai ..... G03G 15/0131 399/395
2010/0239331 A1 9/2010 Miyadera et al.
2011/0052232 A1 3/2011 Ohshima et al.
2012/0061909 A1 3/2012 Shikama et al.
2012/0062682 A1 3/2012 Komai et al.
2013/0004194 A1 1/2013 Shirasaki et al.
(Continued)

FOREIGN PATENT DOCUMENTS

JP 2001-034026 2/2001
JP 2005-352082 12/2005
JP 2015-055784 3/2015

*Primary Examiner* — Roy Y Yi
(74) *Attorney, Agent, or Firm* — Harness, Dickey & Pierce, P.L.C.

(57) ABSTRACT

An image forming apparatus includes a transfer belt, a plurality of endless rotational bodies, an image forming device, a pattern sensor, and processing circuitry. The image forming device forms correction patterns including a first pattern as a straight line pattern orthogonal to a conveyance direction of the correction patterns and a second pattern as one of a straight line pattern orthogonal to and an oblique line pattern inclined with respect to the conveyance direction. The processing circuitry causes the image forming device to form the correction patterns using a correction value such that the second pattern included in one correction pattern on the transfer belt is same in color and shape as the second pattern included in at least one correction pattern of a preceding correction pattern and a following correction pattern in the conveyance direction with respect to the one correction pattern.

20 Claims, 40 Drawing Sheets

(56) References Cited

U.S. PATENT DOCUMENTS

| | | | | |
|---|---|---|---|---|
| 2013/0084109 | A1 | 4/2013 | Shikama et al. | |
| 2013/0242318 | A1 | 9/2013 | Yamaguchi et al. | |
| 2013/0343775 | A1 | 12/2013 | Yamaguchi et al. | |
| 2014/0072316 | A1* | 3/2014 | Shinohara ..... | G03G 15/0131 399/49 |
| 2014/0153943 | A1 | 6/2014 | Miyadera et al. | |
| 2015/0125170 | A1 | 5/2015 | Shirasaki et al. | |
| 2015/0261121 | A1 | 9/2015 | Kawanabe et al. | |
| 2015/0346626 | A1 | 12/2015 | Kohri et al. | |

* cited by examiner

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

X AXIS: NUMBER OF SETS OF PATTERNS
Y AXIS: ORDER OF SHIFT OF PERIODIC FORMATION POSITION
Z AXIS: SCALE FACTOR OF INFLUENCE OF SHIFT OF PERIODIC FORMATION POSITION OCCURRING IN EACH PATTERN AT CALCULATION OF POSITIONAL SHIFT CORRECTION VALUE

IMAGE FORMING APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2018-106443, filed on Jun. 1, 2018, in the Japan Patent Office, the entire disclosure of which is hereby incorporated by reference herein.

BACKGROUND

Technical Field

Aspects of the present disclosure relate to an image forming apparatus and an image forming method.

Related Art

A color image forming apparatuses for forming a full color image on a recording medium is known. The color image forming apparatus forms color images corresponding to respective colors and superimposes the color images to form a full-color image. The color images are formed by attaching developing materials corresponding to the respective colors to electrostatic latent images formed using an optical writing control technology on photoconductors provided corresponding to the respective colors. The color images (developed color images) formed on surfaces of the photoconductors are sequentially transferred and superimposed on a transfer body to form the full-color image.

In recent years, even in low-priced color image forming apparatuses, the resolution has been improved and the quality of color images has been demanded. As the color image forming apparatus, a so-called tandem-type color image forming apparatus is known, which superimposes images developed using developing materials (toners) in a plurality of different colors to form an image. The tandem-type color image forming apparatus needs to suppress a shift (positional shift) of when superimposing color images in order to meet the demand for high resolution and high quality.

The color image forming apparatus includes a large number of endless rotational bodies such as photoconductors and an intermediate transfer belt, and these rotational bodies operate to form the full-color image. An occurring factor of the above-described "positional shift" is fluctuation of operation of the endless rotational bodies, that is, speed variation of rotational driving. Note that the endless rotational bodies include, in addition to the photoconductors and the like, for example, a transfer roller for transferring an image from the intermediate transfer belt to a recording medium, a charging roller for charging the photoconductor, and gears for rotating the endless rotational bodies.

If all the endless rotational bodies are ideal ones, no positional shift will occur as the speed variation as described above does not occur. However, the actual rotational bodies have eccentricity, surface distortion, and the like. It is difficult to adjust (control driving of) the rotational speed of each rotational body to suppress overlapping position positional shift of each color image in consideration of the eccentricity and distortion of all the rotating bodies.

As a technology for suppressing positional shift, a "positional shift correction technology" is known. For example, in the case of the tandem-type color image forming apparatus, when the color images formed on the photoconductors are transferred to the transfer belt as a transfer body, the color images are conveyed to the positions of the corresponding photoconductors and are sequentially superimposed while rotationally driving the transfer body. In this case, the positional shift correction technology is a technology for enabling a transfer position of each color image to be located at an ideal position (a position where the color image overlaps the other color images without being shifted) when the color image is transferred from the photoconductor to the transfer body. Specifically, a correction value for correcting a "positional shift amount" that is a difference of an actual transfer position from the ideal position is calculated, and optical writing control timing to form the electrostatic latent image on the photoconductor is controlled using the calculated correction value. To calculate the correction value, the positional shift amount in the actual transfer body needs to be detected.

Therefore, in the positional shift correction technology, a positional shift detection image pattern (pattern image) for detecting a transfer state of each color image, which will be a base of calculation of the correction value, is formed in advance on the transfer body, and the correction value is calculated using a detection result of the pattern image. In this case, detection results of the same pattern images repeatedly formed on the endless component (rotational body) such as the intermediate transfer belt is averaged, whereby influences of periodically occurring speed variations can be canceled with each other.

It is the intermediate transfer belt as a component having the longest peripheral length that is the endless component (rotational body) regarding image formation and causes the largest influence of speed variation. Therefore, the same pattern image is repeatedly formed on one round length of the intermediate transfer belt, and detection results of the pattern image are averaged, whereby the influences of periodically occurring speed variations can be cancelled with each other.

However, in this case, all the pattern images formed on the one round length of the intermediate transfer belt needs to be detected in order to cancel the influences of speed variations. Therefore, the intermediate transfer belt needs to make a round or more to calculate the correction value, which takes time. To solve the problem, there has been proposed a technology for devising the shape of a pattern image for correction (correction pattern) and capable of calculating an amount of correction of positional shift even if number of times of detection of the pattern image is made small.

SUMMARY

In an aspect of the present disclosure, there is provided an image forming apparatus that includes a transfer belt, a plurality of endless rotational bodies, an image forming device, a pattern sensor, and processing circuitry. The plurality of endless rotational bodies is configured to rotate to superimpose color images onto the transfer belt. The image forming device is configured to form a plurality of correction patterns for calculating a correction value for correcting a positional shift caused when the color images are superimposed on the transfer belt. The pattern sensor is configured to detect the plurality of correction patterns formed on the transfer belt. The plurality of correction patterns includes a first pattern and a second pattern. The first pattern is formed by the image forming device as a straight line pattern orthogonal to a conveyance direction of the plurality of correction patterns in which the plurality of correction patterns is conveyed by rotation of the transfer belt. The second pattern is formed by the image forming device as one of a straight line pattern orthogonal to the conveyance direction and an oblique line pattern inclined with respect to the conveyance direction. Each of the plurality of correction patterns is a set of combination patterns, each combination pattern in which one line of the second pattern is disposed between two lines of the first pattern. The processing circuitry is configured to cause the image forming device to form the plurality of correction patterns using the correction value, which is calculated based on a detection result of the pattern sensor, such that the second pattern included in one correction pattern of the plurality of correction patterns formed on the transfer belt is same in color and shape as the second pattern included in at least one correction pattern of a preceding correction pattern and a following correction pattern in the conveyance direction with respect to the one correction pattern of the plurality of correction patterns.

In another aspect of the present disclosure, there is provided an image forming apparatus that includes a transfer belt, a plurality of endless rotational bodies, pattern formation means, and pattern detection means. The plurality of endless rotational bodies is configured to rotate to superimpose color images onto the transfer belt. The pattern formation means forms a plurality of correction patterns for calculating a correction value for correcting a positional shift caused when the color images are superimposed on the transfer belt. The pattern detection means detects the plurality of correction patterns formed on the transfer belt. The plurality of correction patterns includes a first pattern and a second pattern. The first pattern is formed by the pattern formation means as a straight line pattern orthogonal to a conveyance direction of the plurality of correction patterns in which the plurality of correction patterns is conveyed by rotation of the transfer belt. The second pattern is formed by the pattern formation means as one of a straight line pattern orthogonal to the conveyance direction and an oblique line pattern inclined with respect to the conveyance direction. Each of the plurality of correction patterns is a set of combination patterns, each combination pattern in which one line of the second pattern is disposed between two lines of the first pattern. The pattern formation means forms the plurality of correction patterns using the correction value, which is calculated based on a detection result of the pattern detection means, such that the second pattern included in one correction pattern of the plurality of correction patterns formed on the transfer belt is same in color and shape as the second pattern included in at least one correction pattern of a preceding correction pattern and a following correction pattern in the conveyance direction with respect to the one correction pattern of the plurality of correction patterns.

In yet another aspect of the present disclosure, there is provided an image forming method for superimposing images developed with developers in a plurality of colors by rotation of a plurality of endless rotational bodies to form a color image on a transfer belt. The image forming method includes forming a plurality of correction patterns for calculating a correction value for correcting a positional shift caused when the images of the plurality of colors are superimposed on the transfer belt; and detecting the plurality of correction patterns formed on the transfer belt. The plurality of correction patterns includes a first pattern and a second pattern. The first pattern is formed as a straight line pattern orthogonal to a conveyance direction of the plurality of correction patterns in which the plurality of correction patterns is conveyed by rotation of the transfer belt. The second pattern is formed as one of a straight line pattern orthogonal to the conveyance direction and an oblique line pattern inclined with respect to the conveyance direction. Each of the plurality of correction patterns is a set of combination patterns, each combination pattern in which one line of the second pattern is disposed between two lines of the first pattern. The image forming method further includes forming the plurality of correction patterns using the correction value, which is calculated based on a detection result of the plurality of correction patterns, such that the second pattern included in one correction pattern of the plurality of correction patterns formed on the transfer belt is same in color and shape as the second pattern included in at least one correction pattern of a preceding correction pattern and a following correction pattern in the conveyance direction with respect to the one correction pattern of the plurality of correction patterns.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
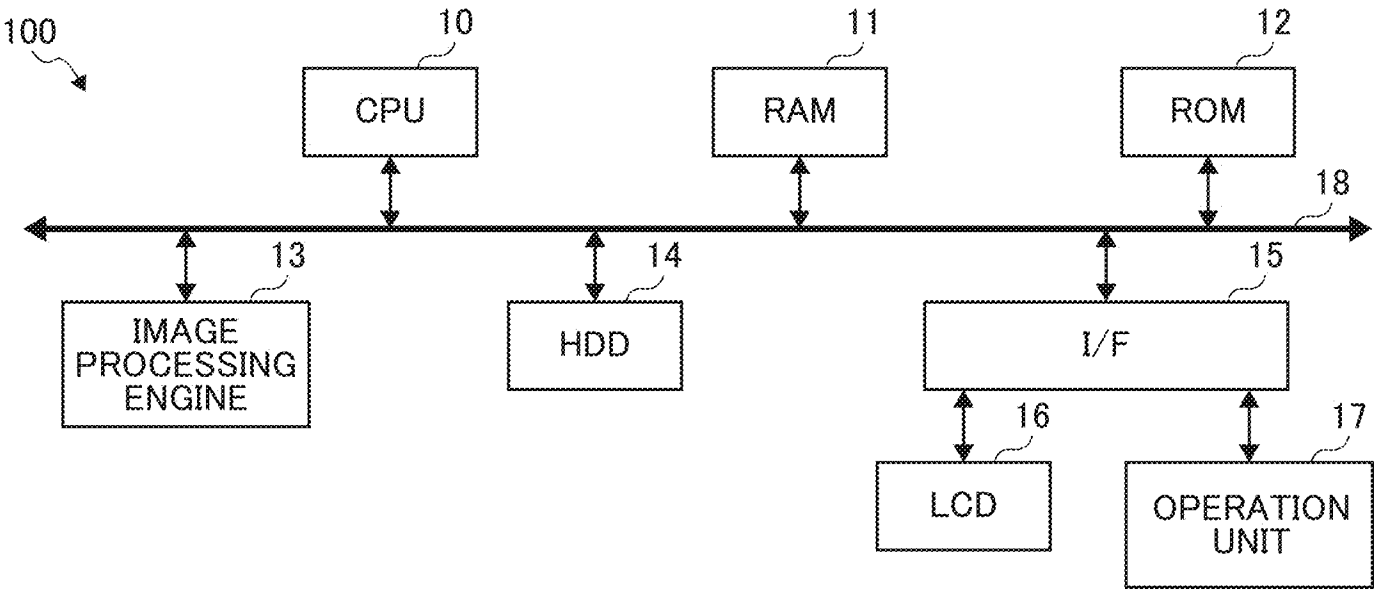
FIG. 1 is a hardware block diagram illustrating an embodiment of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, an image forming apparatus and an image forming method according to embodiments of the present invention will be described with reference to the drawings. The characteristic of the present invention is a method for forming a pattern image used for calculation of a positional shift correction value for correcting a positional shift (positional shift) of when superposing color images formed by optical writing processing. Here, the "method for forming a pattern image" refers to combination and arrangement of shapes and colors of a plurality patterns constituting the pattern image. In the present invention, the pattern image used for calculation of the positional shift correction value is a set by combining pattern images having specific forms. This set of pattern images is described as "alignment mark" in the present specification.

Overview of Alignment Mark

The alignment mark according to the present invention is configured by combining a plurality of positional shift correction patterns. The positional shift correction pattern is configured by combining a plurality of line patterns that are linear pattern images. The positional shift correction pattern has two different variations, i.e., "Z pattern" and "three-line pattern", depending on how the line patterns are combined. Each positional shift correction pattern includes two reference line patterns and one correction target pattern arranged between the reference line patterns.

The reference line pattern is a linear pattern image in a direction orthogonal to a sub-scanning direction that is a conveyance direction (moving direction) of a pattern image transferred onto a transfer body to which superposition of the pattern image is executed. This reference line pattern is formed in the common shape and color even if the variations of the positional shift correction patterns are different. That is, a pattern image of a cross line orthogonal to the sub-scanning direction is the reference line pattern even in the Z pattern or in the three-line pattern.

The correction target pattern has two variations. One is an oblique line pattern that is an oblique line shaped pattern image inclined with respect to the above two reference line patterns (having an angle with respect to the sub-scanning direction). The other one is a cross line pattern that is a linear pattern image not inclined (parallel to) the two reference line patterns.

In the case where the correction target pattern is the oblique line pattern, the positional shift correction pattern configured by a combination of the oblique line pattern and the reference line patterns becomes a form resembling an alphabet Z and is thus called "Z pattern". Meanwhile, in the case where the correction target pattern is the cross line pattern, the positional shift correction pattern configured by a combination of the cross line pattern and the reference line patterns becomes a form resembling "three" of a Japanese Kanji character including three parallel lines and is thus called "three-line pattern". Therefore, the alignment mark according to the present embodiment is characterized in the method (arrangement) for forming the "Z pattern" and the "three-line pattern".

In an image forming apparatus according to the present embodiment, when focusing on the alignment mark used for the first alignment processing, the reference line patterns included in the positional shift correction pattern constituting the alignment mark are formed in the same color. Further, the reference line patterns are formed at constant intervals, and the correction target pattern is arranged between the reference line patterns. The correction target pattern is formed in the same color as each color image that is to be a positional shift correction target. Further, the shape of the correction target pattern differs depending on the direction in which the positional shift is corrected. The positional shift correction pattern (Z pattern) in the case where the correction target pattern is the oblique line pattern is intended to correct positional shift in the main scanning direction. Further, the positional shift correction pattern (three-line pattern) in the case where the correction target pattern is the cross line pattern is intended to correct positional shift in the sub-scanning direction.

The reference line patterns are formed as the cross line patterns in a reference color even in the Z pattern or the three-line pattern. The reference line patterns are formed in the same color in one alignment. Note that the "one alignment" refers to pattern detection processing for calculating a correction value for correcting positional shift and pattern formation processing using the calculated correction value. By making the reference line patterns have the same color in one alignment, the phase component of the shift of the formation position of the positional shift correction pattern caused by rotational speed variation of the endless component (endless rotational body) can be shared. By sharing the phase components of shift, the alignment accuracy can be improved.

Further, while pattern interval needs to be spaced to change the color of the reference line pattern if the reference line patterns in two or more colors are used, the interval needs to be provided using the reference line patterns in one color. Therefore, the length (total pattern length) to form the alignment mark configured by a combination of the positional shift correction patterns can be made short.

In adjacent front and back sets (sets of the reference line patterns and the correction target pattern), that is, in the positional shift correction patterns corresponding to an adjacent front and back relationship, the color and the shape of the correction target pattern included in at least one of the sets (positional shift correction patterns) become the same as the color and the shape of the correction target pattern of the set of interest. With the formation, the influence of speed variation of the endless component (endless rotational body) caused at the time of calculating the out of a color shift correction value can be effectively suppressed. Note that the above-described "set of interest" refers to the positional shift correction pattern corresponding to a target for which the correction value for positional shift correction is to be calculated, and for example, the "set of interest" of when calculating the correction value for correcting positional shift in the main-scanning direction of yellow refers to the positional shift correction pattern in which the correction target pattern is formed as a yellow oblique line pattern.

Hardware Configuration of Image Forming Apparatus

First, an image forming apparatus including an optical writing device according to an embodiment of the present invention will be described. FIG. 1 is a block diagram illustrating a hardware configuration that controls a control system of a multifunction peripheral (MFP) as the image forming apparatus according to an embodiment of the present invention. In FIG. 1, the control system of an MFP 100 according to the present embodiment includes an image processing engine that executes image formation in addition to a similar configuration to a personal computer (PC) as an information processing apparatus. That is, the MFP 100 according to the present embodiment includes a central processing unit (CPU) 10, a random access memory (RAM) 11, a read only memory (ROM) 12, an image processing engine 13, a hard disk drive (HDD) 14, and an interface (I/F) 15, which are connected via a system bus 18. Further, a liquid crystal display (LCD) 16 and an operation unit 17 are connected to the I/F 15.

The CPU 10 is an arithmetic unit and controls operation of the entire MFP 100. The RAM 11 is a volatile storage medium capable of high-speed reading and writing of information and is used as a work area when the CPU 10 processes information. The ROM 12 is a read only non-volatile storage medium and stores programs such as firmware. The image processing engine 13 includes a configuration that operates to actually execute image formation in the MFP 100.

The HDD 14 is a non-volatile storage medium capable of reading and writing information and stores an operating system (OS), various control programs, application programs, and the like. The I/F 15 connects and controls the system bus 18 and various types of hardware and networks. The LCD 16 is a visual user interface for a user to confirm the state of the MFP 100. The operation unit 17 is a user interface, such as a keyboard and a mouse, for inputting information to the MFP 100 by the user.

In such a hardware configuration, a program stored in a recording medium such as the ROM 12 or the HDD 14 is read to the RAM 11, and the CPU 10 performs an operation according to the program to configure a software controller. A combination of the software controller configured as described above and the hardware configures a functional block that implements functions of the MFP 100 according to the present embodiment. Note that the hardware configuration illustrated in FIG. 1 is an example, and the hardware configuration of the MFP 100 according to the present embodiment is not limited to the configuration in FIG. 1 as long as the hardware enables implementation of the functional configuration described below.

Functional Configuration of Image Forming Apparatus

Figure 2:
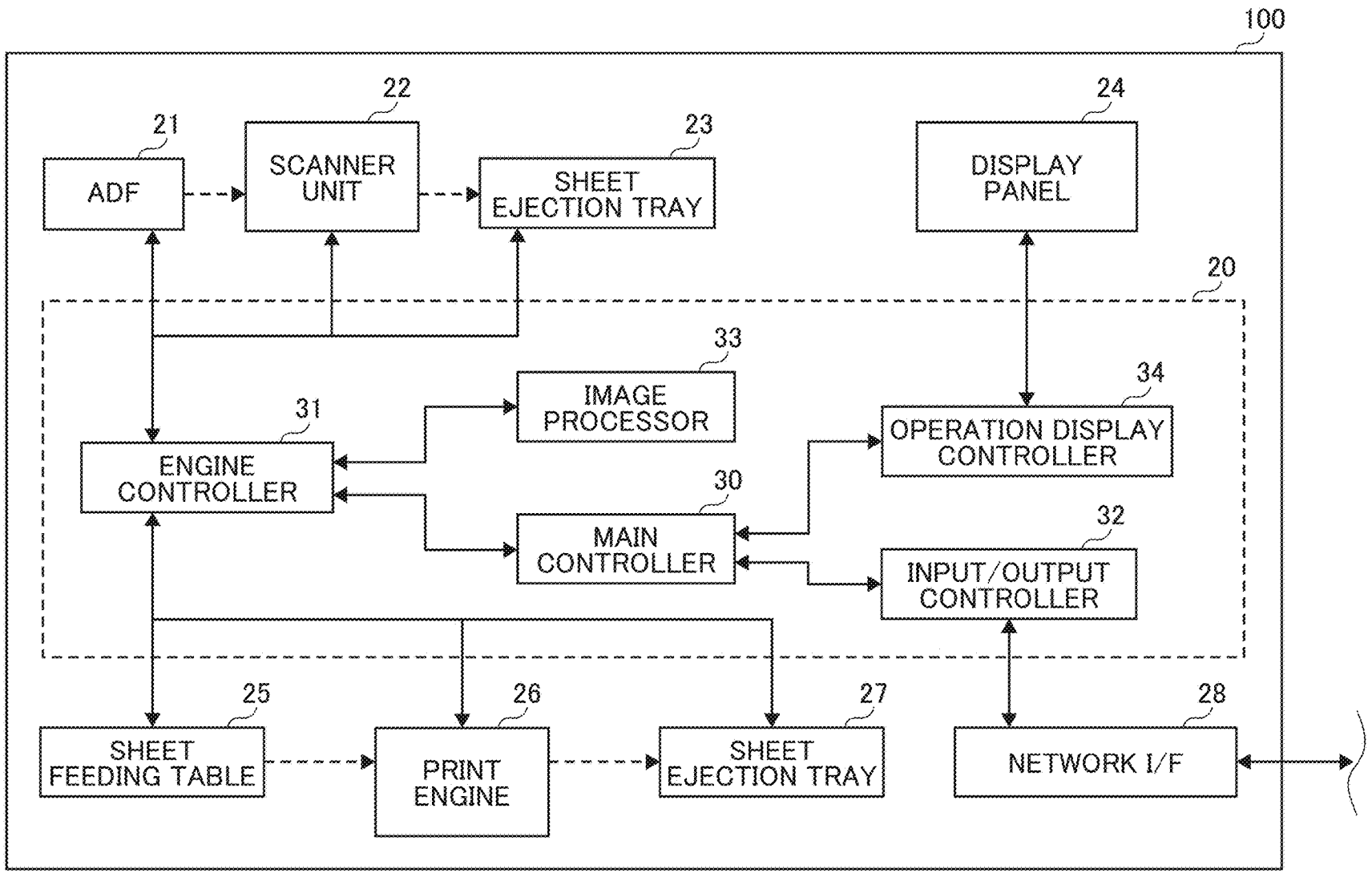
FIG. 2 is a functional block diagram of an MFP according to the present embodiment.

Next, a functional configuration of the MFP 100 according to the present embodiment will be described referring to FIG. 2. FIG. 2 is a block diagram illustrating a functional configuration of the MFP 100 according to the present embodiment. The MFP 100 includes a controller 20, an auto document feeder (ADF) 21, a scanner unit 22, a sheet ejection tray 23, a display panel 24, a sheet feeding table 25, a print engine 26, a sheet ejection tray 27, and a network I/F 28.

Further, the controller 20 includes a main controller 30, an engine controller 31, an input/output controller 32, an image processor 33, and an operation display controller 34. Further, the MFP 100 is configured as a multifunction peripheral including the scanner unit 22 and the print engine 26. In FIG. 2, an electrical connection is illustrated by a solid arrow, and a flow of a recording medium is illustrated by a broken arrow.

The display panel 24 is an output interface for visually displaying the state of the MFP 100 and is also an input interface (operation unit) when the user directly operates the MFP 100 as a touch panel or inputs information to the MFP 100. The network I/F 28 is an interface for the MFP 100 to communicate with other devices via a network, and Ethernet (registered trademark) or a universal serial bus (USB) interface is used.

The controller 20 is configured by a combination of software and hardware. Specifically, control programs in the ROM 12, a nonvolatile memory, and the HDD 14 are loaded into a volatile memory (hereinafter, memory) such as the RAM 11, and the software controller configured by the operation of the CPU 10 according to the control programs and hardware such as an integrated circuit configure the controller 20. The controller 20 functions as a controller that controls the entire MFP 100.

The main controller 30 serves to control each unit included in the controller 20 and gives a command to each unit of the controller 20. The engine controller 31 serves as a driver that controls or drives the print engine 26, the scanner unit 22, and the like. The input/output controller 32 inputs to signals and commands input via the network I/F 28 to the main controller 30. Further, the main controller 30 controls the input/output controller 32 and accesses other devices via the network I/F 28.

The image processor 33 generates drawing information based on print information included in an input print job under the control of the main controller 30. The drawing information is information for drawing an image to be formed in an image forming operation by the print engine 26 as an image forming device. Further, the print information included in a print job is image information converted into a format recognizable by the MFP 100, by a printer driver installed in an information processing apparatus such as a PC. The operation display controller 34 displays information on the display panel 24 or notifies the main controller 30 of information input via the display panel 24.

In a case where the MFP 100 operates as a printer, first, the input/output controller 32 receives a print job via the network I/F 28. The input/output controller 32 transfers the received print job to the main controller 30. When the main controller 30 receives the print job, the main controller 30 controls the image processor 33 to generate the drawing information based on the print information included in the print job.

When the drawing information is generated by the image processor 33, the engine controller 31 controls the print engine 26 according to the generated drawing information to execute image formation on a recording medium conveyed from the sheet feeding table 25. That is, the print engine 26 functions as an image forming device. The recording medium to which the image formation has been applied by the print engine 26 is discharged to the sheet ejection tray 27.

The image information generated by the image processor 33 is stored as it is in the HDD 14 or the like according to a user's instruction or is transmitted to an external device via the input/output controller 32 and the network I/F 28. That is, the ADF 21 and the engine controller 31 function as an image input unit.

In a case where the MFP 100 operates as a copying machine, the image processor 33 generates the drawing information based on imaging information received from the scanner unit 22 by the engine controller 31 or the image information generated by the image processor 33. The engine controller 31 drives the print engine 26 according to the drawing information as in the case of the printer operation.

Configuration of Print Engine

Figure 3:
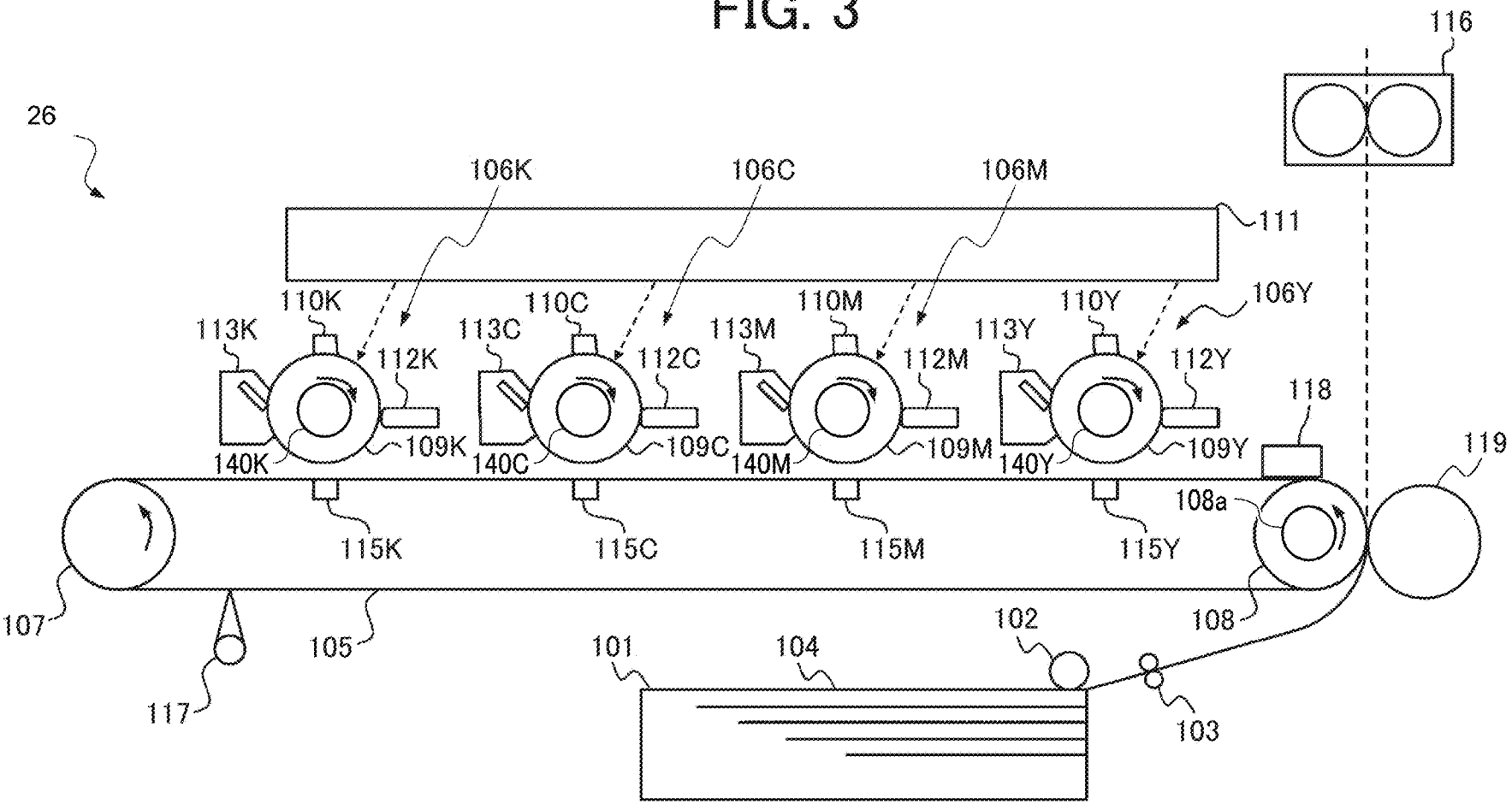
FIG. 3 is a configuration diagram illustrating a configuration of a print engine according to the present embodiment.

Next, a configuration of the print engine 26 according to the present embodiment will be described referring to FIG. 3. FIG. 3 is a diagram illustrating a configuration of the print engine 26 according to the present embodiment. The print engine 26 has a configuration in which image forming units 106 corresponding to respective colors are arranged along an intermediate transfer belt 105 that is one of endless components, is a transfer body to which color images are transferred, and is one of endless rotational bodies. The print engine 26 illustrated in FIG. 3 is called tandem-type print engine.

The image forming unit 106 includes a yellow image forming unit 106Y used for forming a yellow image, a magenta image forming unit 106M used for forming a magenta image, a cyan image forming unit 106C used for forming a cyan image, and a black image forming unit 106K used for forming a black image, which are electrophotographic processors (hereinafter these image forming units are collectively called image forming units 106) and arranged along a rotational operation direction of the intermediate transfer belt 105 (a conveyance direction of a transferred image).

The plurality of image forming units 106 shares an internal configuration except that colors of developing materials (toners) used to visualize an electrostatic latent image are different. That is, the yellow image forming unit 106Y forms a yellow image, the magenta image forming unit 106M forms a magenta image, the cyan image forming unit 106C forms a cyan image, and the black image forming unit 106K forms a black image, respectively.

In the following description, the yellow image forming unit 106Y will be specifically described. Components corresponding to the other colors are left in illustration in the drawings with reference symbols M, C, and K, which are replaced with Y attached to components of the yellow image forming unit 106Y, and description is omitted.

The intermediate transfer belt 105 is an intermediate transfer unit, and is an endless belt member, that is, an endless rotational body, which is stretched between a driving roller 108 and a driven roller 107. The color images are transferred from the image forming units 106 to the intermediate transfer belt 105 to form a full-color image. The driving roller 108 is rotationally driven by a drive motor, a drive gear 108*a*, and the like. The driven roller 107 is rotated by the intermediate transfer belt 105 rotated by a driving force of the driving roller 108. The driving roller 108, the drive motor for driving the driving roller 108, and the driven roller 107 rotated according to driving of the driving roller 108 function as driving means or a driving device that rotates the intermediate transfer belt 105 as an endless mover.

A transfer roller 119 is arranged at a position facing the driving roller 108 across the intermediate transfer belt 105. The transfer roller 119 constitutes a secondary transfer unit that imparts a pressure to press a sheet 104 as a recording medium against the intermediate transfer belt 105. The sheet 104 supplied from a sheet feeding tray 101 is pressed against the intermediate transfer belt 105 and conveyed by the pressure from the transfer roller 119, and the color image formed on the intermediate transfer belt 105 is transferred to the sheet 104.

The yellow image forming unit 106Y includes a photoconductor drum 109Y as a photoconductor or an image bearer, a charging roller 110Y as a charging roller arranged at a periphery of the photoconductor drum 109Y, an optical writing control device 111, a developing device 112Y, a photoconductor cleaner, a static eliminator 113Y, and the like. The optical writing control device 111 irradiates the photoconductor drums 109Y, 109M, 109C, and 109K (hereinafter collectively described as "photoconductor drums 109") corresponding to the respective colors with light.

In image formation, an outer peripheral surface of the photoconductor drum 109Y is uniformly charged by the charging roller 110Y in the dark, and then writing is performed with light from a light source corresponding to the yellow image from the optical writing control device 111 to form an electrostatic latent image. The developing device 112Y visualizes the electrostatic latent image with a yellow toner, thereby forming a yellow toner image on the photoconductor drum 109Y.

The toner image is transferred to the intermediate transfer belt 105 by a function of a transferer 115Y at a position transfer position) where the photoconductor drum 109Y and the intermediate transfer belt 105 come in contact with or come closest to each other The yellow toner image is transferred onto the intermediate transfer belt 105 by this transfer. The photoconductor drum 109Y to which the toner image has been transferred is destaticized by the static eliminator 113Y after an unnecessary toner remaining on the outer peripheral surface is wiped by the photoconductor cleaner and stands by for the next image formation.

As described above, the yellow toner image transferred onto the intermediate transfer belt 105 by the yellow image forming unit 106Y is conveyed to the next magenta image forming unit 106M by roller drive of the intermediate transfer belt 105. This conveyance direction is a main-scanning direction and a width direction (depth direction in FIG. 3) of the intermediate transfer belt 105 is a sub-scanning direction, which is orthogonal to the main-scanning direction. In the magenta image forming unit 106M, a magenta toner image is formed on the photoconductor drums 109M by a similar process to the image forming process in the yellow image forming unit 106Y and is transferred to be superimposed on the yellow image, the toner image of which has already been formed.

The toner image in which the yellow toner image and the magenta toner image transferred onto the intermediate transfer belt 105 are superimposed is further conveyed to the next cyan image forming unit 106C and the black image forming unit 106K. Then, a cyan toner image formed on the photoconductor drums 109C and a black toner image formed on the photoconductor drums 109K are superimposed on the already transferred toner image (the toner image where yellow and magenta are superimposed) by similar operations. In this way, a color intermediate transfer image is formed on the intermediate transfer belt 105.

The sheets 104 stored in the sheet feeding tray 101 are sent out in order from the top, are once stopped by a registration roller 103, and are sent out to the transfer position of the image from the intermediate transfer belt 105 according to timing of the image formation in the image forming units 106. The intermediate transfer image formed on the intermediate transfer belt 105 is transferred to the sheet 104 to form a color image at a position where a conveyance path comes in contact with or comes closest to the intermediate transfer belt 105. The sheet 104 on which the image has been formed is further conveyed and discharged to the outside of the MFP 100 after the image is fixed by the fixer 116.

In the MFP 100 that forms an image using the print engine 26 having the above configuration, there are cases where the toner images in the respective colors do not overlap one another at a position where the toner images should overlap one another and positional shift (color shift) may occur among the colors due to errors in distances among the photoconductor drums 109Y, 109M, 109C, and 109K, parallelism errors among the photoconductor drums 109Y, 109M, 109C, and 109K, installation errors of light-emitting diode arrays (LEDAs) 130 in the optical writing control device 111, write timing errors of electrostatic latent images to the photoconductor drums 109Y, 109M, 109C, and 109K, and the like. The positional shift is caused by variation of a rotational speed of the endless rotational body due to such errors. The positional shift in the superposition of the toner images in the respective colors (color images) occurs due to an influence of the speed variation.

A pattern detection sensor 117 is provided to correct such positional shift. The pattern detection sensor 117 is, for example, an optical sensor (TM sensor) using reflection of light. The pattern detection sensor 117 is an optical sensor for reading an alignment mark transferred as a toner image on the intermediate transfer belt 105 by the photoconductor drums 109Y, 109M, 109C, and 109K. The pattern detection sensor 117 includes a light emitting element for emitting light illuminating an pattern image drawn on a surface of the intermediate transfer belt 105 and a light receiving element for receiving reflected light from the pattern image. As illustrated in FIG. 3, the pattern detection sensor 117 is located on a downstream side in the conveyance direction of the sheet 104 with respect to the photoconductor drums 109Y, 109M, 109C, and 109K, and is supported on the same substrate along the direction (so-called sub-scanning direction) orthogonal to the conveyance direction of the sheet 104 by the intermediate transfer belt 105.

The pattern detection sensor 117 is used for an positional shift correction operation by detecting the alignment mark. Details of the pattern detection sensor 117 and a mode of the positional shift correction will be described below. Note that the print engine 26 includes a configuration for implementing an information processing function such as the CPU 10 as described in FIG. 1 and operates under control of such a configuration.

Further, the print engine 26 is provided with a belt cleaner 118 that removes the toner of the alignment mark drawn by the toner image transferred to the intermediate transfer belt 105 so that the sheet 104 conveyed by the intermediate transfer belt 105 is not soiled. As illustrated in FIG. 3, the belt cleaner 118 is a cleaning blade arranged on a downstream side of the driving roller 108 and on an upstream side of the photoconductor drum 109, and pressed against the intermediate transfer belt 105. The belt cleaner 118 is a developer remover that scrapes the toner attached to the surface of the intermediate transfer belt 105.

Overview of Optical Writing Device

Figure 4:
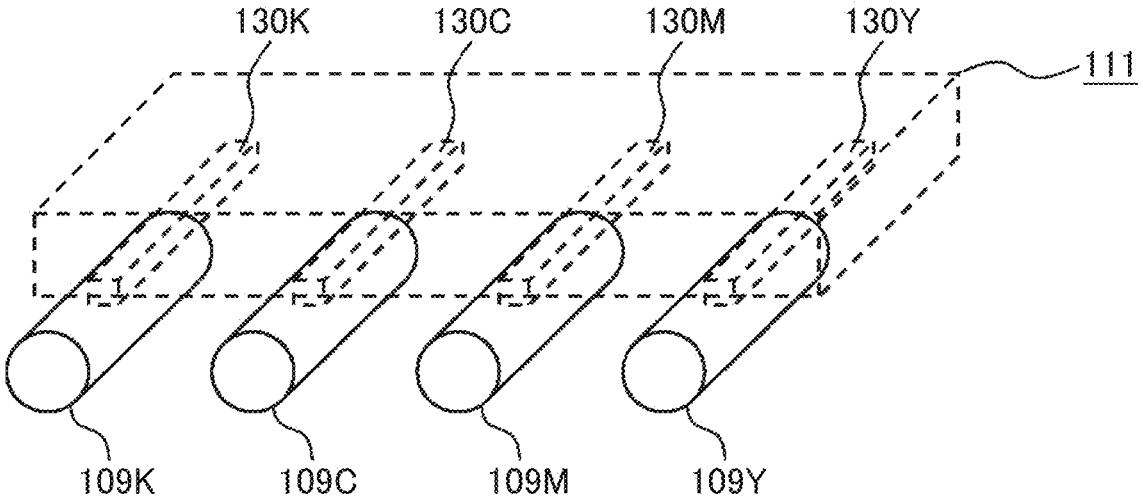
FIG. 4 is a view illustrating an embodiment of an optical writing control device according to the present embodiment.

Next, the optical writing control device 111 according to the present embodiment will be described. FIG. 4 is a view illustrating an arrangement relationship between the optical writing control device 111 and the photoconductor drums 109 according to the present embodiment. As illustrated in FIG. 4, irradiation light to be emitted to the photoconductor drums 109Y, 109M, 109C, and 109K of the respective colors is emitted from light-emitting diode arrays (LEDA) 130Y, 130M, 130C, and 130K (hereinafter collectively referred to as LEDAs 130) that are light sources.

The LEDA 130 is configured by arranging LEDs, which are light emitting elements, in the main-scanning direction of the photoconductor drum 109. A controller included in the optical writing control device 111 controls on/off states of the LEDs arranged in the main-scanning direction for each main-scanning line according to the drawing information input from the controller 20, thereby selectively exposing the surface of the photoconductor drum 109 to form an electrostatic latent image.

Control Block of Optical Writing Device

Figure 5:
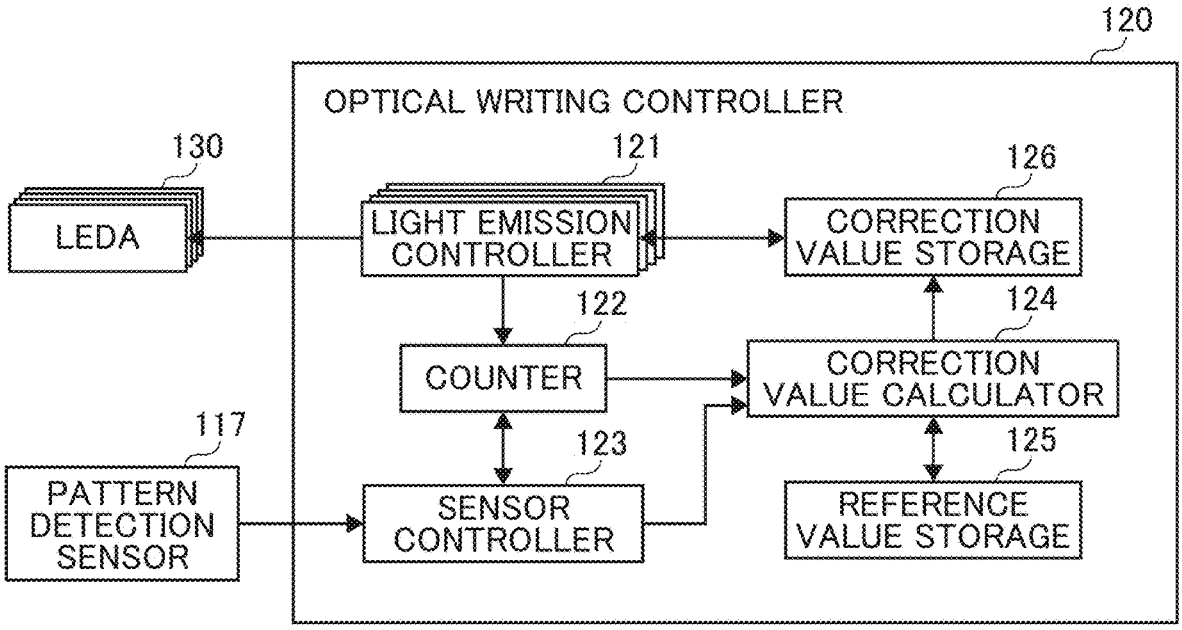
FIG. 5 is a functional block diagram illustrating an embodiment of a control block of the optical writing control device.

Next, a control block of the optical writing control device 111 according to the present embodiment will be described referring to FIG. 5. FIG. 5 is a diagram illustrating a connection relationship between a functional configuration of an optical writing controller 120 for controlling the optical writing control device 111 according to the present embodiment, and the LEDA 130 and the pattern detection sensor 117.

As illustrated in FIG. 5, the optical writing controller 120 according to the present embodiment includes a light emission controller 121, a counter 122, a sensor controller 123, a correction value calculator 124, a reference value storage 125, and a correction value storage 126. The optical writing controller 120 functions as an optical writing control device that controls the LEDA 130 as a light source to form an electrostatic latent image on the photoconductor.

Note that the optical writing controller 120 is configured by loading the control program stored in the ROM 12 or the HDD 14 into the RAM 11 and operating under the control of the CPU 10, similarly to the controller 20 of the MFP 100.

The light emission controller 121 is a light source controller that controls the LEDA 130 according to the image information input from the engine controller 31 of the controller 20. That is, the light emission controller 121 also functions as a pixel information acquisition unit. The light emission controller 121 causes the LEDA 130 to emit light with a predetermined line period to implement optical writing to the photoconductor drum 109.

The line period with which the light emission controller 121 controls light emission of the LEDA 130 is determined according to output resolution of the image forming apparatus 1. In a case of performing scaling in the sub-scanning direction according to a ratio of the output resolution to a conveyance speed of the sheet as described above, the light emission controller 121 adjusts the line period to perform scaling in the sub-scanning direction.

Further, the light emission controller 121 drives the LEDA 130 according to the drawing information input from the engine controller 31 and controls the light emission of the LEDA 130 in order to draw a correction pattern in the above-described drawing parameter correction processing.

As described in FIG. 4, a plurality of the LEDAs 130 is provided corresponding to the respective colors. Therefore, as illustrated in FIG. 5, a plurality of the light emission controllers 121 is provided corresponding to the plurality of LEDAs 130. A correction value generated as a result of positional shift correction processing of the drawing parameter correction processing is stored as a positional shift correction value in the correction value storage 126 illustrated in FIG. 5.

The light emission controller 121 corrects timing to drive the LEDA 130 according to the positional shift correction value stored in the correction value storage 126. Further, the light emission controller 121 adjusts a correspondence between information of pixels constituting the image information of one line and LED elements included in the LEDA 130 according to the positional shift correction value stored in the correction value storage 126 when causing the LEDA 130 to emit light according to the image information of each main-scanning line in order to correct the position in the main-scanning direction of the image.

The correction of the timing to drive the LEDA 130 by the light emission controller 121 is implemented by, specifically, delaying the timing to drive light emission of the LEDA 130 in units of line period according to the drawing information input from the engine controller 31, that is, by shifting a line. In contrast, the drawing information is input one after another from the engine controller 31 according to a predetermined period. Therefore, to shift a line to delay the light emission timing, the input drawing information is retained and timing to read the drawing information needs to be delayed.

Therefore, the light emission controller 121 includes a line memory that is a storage medium for retaining the drawing information to be input for each main-scanning line, and causes the line memory to store the drawing information input from the engine controller 31 to retain the information. As the correction of the timing to drive LEDA 130, light emission timing is finely adjusted in each line period, in addition to the adjustment in units of line periods.

The counter 122 starts counting at the same time with the control of the LEDA 130 by the light emission controller 121 to start exposure of the photoconductor drum 109K in the positional shift correction processing. The counter 122 acquires a detection signal that is output by the sensor controller 123 detecting the positional shift correction pattern according to the output signal of the pattern detection sensor 117. Further, the counter 122 inputs a count value of the detection timing of the detection signal to the correction value calculator 124. That is, the counter 122 functions as a detection timing acquisition unit that acquires detection timing of a pattern.

The sensor controller 123 is a controller for controlling the pattern detection sensor 117, and determines that the positional shift correction pattern formed on the intermediate transfer belt 105 has reached the position of the pattern detection sensor 117 and outputs the detection signal according to the output signal of the pattern detection sensor 117, as described above. That is, the sensor controller 123 functions as a detection signal acquisition unit that acquires the detection signal of a pattern by the pattern detection sensor 117.

Further, in density correction with a density correction pattern, the sensor controller 123 acquires signal intensity of the output signal of the pattern detection sensor 117 and inputs the signal intensity to the correction value calculator 124. Further, the sensor controller 123 adjusts timing to detect the density correction pattern according to a detection result of the positional shift correction pattern.

The correction value calculator 124 calculates the correction value based on positional shift correction and density correction reference values stored in the reference value storage 125 on the basis of the count value acquired from the counter 122 and the signal intensity of the detection result of the density correction pattern acquired from the sensor controller 123. That is, the correction value calculator 124 functions as a reference value acquisition unit and a correction value calculator. The reference value storage 125 stores the reference values to be used for such calculation.

Examples of Alignment Mark

Figure 6:
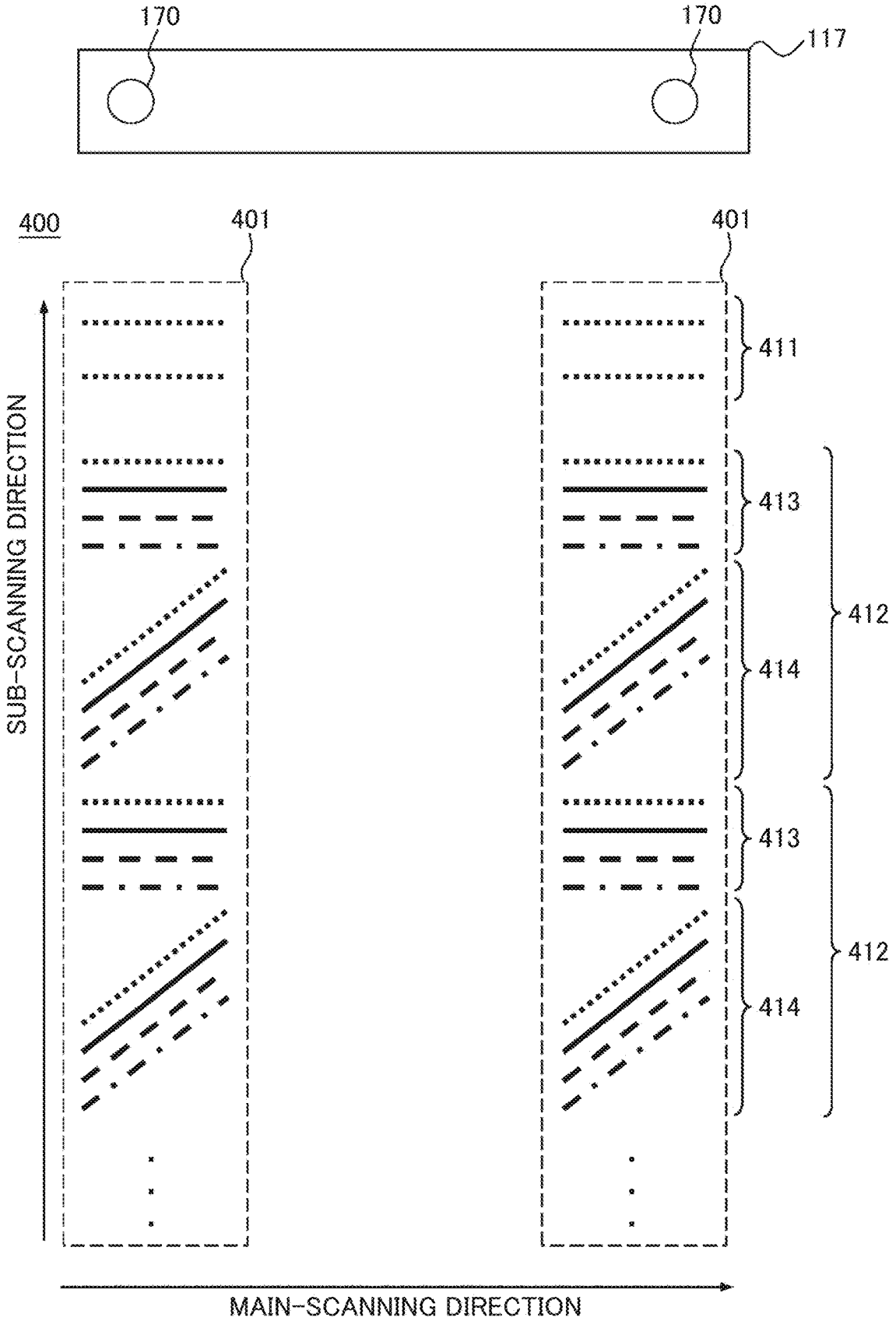
FIG. 6 is a conventional comparative example of a correction pattern for correcting a shift of an image transfer position in the MFP according to the present embodiment.

Next, an outline of positional shift correction operation according to the present embodiment will be described. FIG. 6 illustrates a positional relationship between an alignment mark that will be a base of calculation of a correction value for correcting the positional shift and the pattern detection sensor 117 for detecting the alignment mark. Note that the alignment mark illustrated in FIG. 6 is a conventional example for making a comparison with a characteristic alignment mark of an embodiment of the present invention described below.

A conventional mark 400 illustrated in FIG. 6 is configured by a combination of various pattern images drawn on the intermediate transfer belt 105 by the LEDAs 130 controlled by the light emission controllers 121. For example, various pattern images are arranged in the sub-scanning direction to configure an alignment pattern array 401. A plurality of (two in the present embodiment) alignment pattern arrays 401 is arranged in the main-scanning direction.

The conventional mark 400 includes line patterns corresponding to respective colors. In describing the present embodiment, differences in color-based representation of the line patterns are as follows. The dotted line indicates a pattern image drawn by the photoconductor drum 109Y. Further, the solid line is drawn by the photoconductor drum 109K, the broken line is drawn by the photoconductor drum 109C, and the one-dot chain line is drawn by the photoconductor drum 109M, and these lines indicate patterns. That is, the dotted line indicates a line pattern formed in "yellow", the solid line indicates a line pattern formed in "black", the broken line indicates a line pattern formed in "cyan", and the one-dot chain line indicates a line pattern formed in "magenta".

The pattern detection sensor 117 includes a plurality of (two in the present embodiment) sensor elements 170 in the main-scanning direction, and the alignment pattern arrays 401 corresponding to the respective positions of the sensor elements 170 are drawn at positions passing through detection ranges of the sensor elements 170. An output voltage of the sensor element 170 drops when the line pattern constituting the alignment pattern array 401 enters the detection range of the sensor element 170, and the output voltage of the sensor element 170 rises when the line passes through the detection range. The sensor controller 123 acquires the detection signal to be output by detecting the positional shift correction pattern on the basis of the output voltage, and the counter 122 inputs the count value of the acquisition timing of the detection signal to the correction value calculator 124.

With the input, the optical writing controller 120 can detect a pattern at a plurality of positions in the main-scanning direction, thereby correcting a skew of a drawn image. Further, by averaging detection results based on the plurality of sensor elements 170, the correction accuracy can be improved.

As illustrated in FIG. 6, the alignment pattern array 401 includes an overall position correction pattern 411 and a drum interval correction pattern 412. Further, as illustrated in FIG. 6, the drum interval correction pattern 412 is repeatedly drawn.

The overall position correction pattern 411 is a line drawn by the photoconductor drum 109Y and a line parallel to the main-scanning direction, as illustrated in FIG. 6. The overall position correction pattern 411 is a pattern drawn for obtaining a count value for correcting an overall shift in the sub-scanning direction of the image, that is, the transfer position of the image with respect to the sheet. Further, the overall position correction pattern 411 is also used for correcting detection timing of when the sensor controller 123 detects the drum interval correction pattern 412 and a density correction pattern to be described below.

In the overall position correction using the overall position correction pattern 411, the optical writing controller 120 performs correction operation of writing start timing according to a read signal of the overall position correction pattern 411 by the pattern detection sensor 117

The drum interval correction pattern 412 is a pattern drawn for obtaining a count value for correcting a gap in drawing timing between the photoconductor drums 109 in the respective colors, that is, an overlapping position where the images in the respective colors are superimposed. As illustrated in FIG. 6, the drum interval correction pattern 412 includes a cross line pattern 413 and an oblique line pattern 414. As illustrated in FIG. 6, the drum interval correction pattern 412 is configured by alternately repeating the cross line pattern 413 in which linear patterns in CMYK colors in a direction orthogonal to the conveyance direction form a set and the oblique line pattern 414 in which linear patterns in the CMYK colors inclined at a predetermined angle with respect to the conveyance direction form a set.

The optical writing controller 120 performs positional shift correction of the photoconductor drums 109K, 109M, 109C, and 109Y in the sub-scanning direction according to the read signal of the cross line pattern 413 by the pattern detection sensor 117. Meanwhile, in the conventional positional shift correction operation, the optical writing controller 120 performs positional shift correction of the photoconductor drums in the main-scanning direction according to the read signal of the oblique line pattern 414.

In a case where an error occurs in the main-scanning direction at the transfer position of the image, the detection timing of the oblique line pattern 414 changes according to the inclination of the oblique line. For example, in a case where the inclination of the oblique line is 45 degrees with respect to the sub-scanning direction, an amount of movement of the transfer position of the image in the main scanning direction and an amount of change of the detection timing of the image are one to one. Therefore, the conventional optical writing controller 120 performs the positional shift correction of the photoconductor drums 109K, 109M, 109C, and 109Y in the main-scanning direction according to the amount of change of the detection timing of the oblique line pattern 414.

Alignment Mark According to Embodiment of Present Invention

Next, the alignment mark according to the present invention will be described. A mark 500 as an embodiment of the alignment mark according to the present invention is characterized in how the shapes and colors of the line patterns are combined (a method for forming an alignment pattern). As described above, the conventional mark 400 is formed such that the cross line pattern corresponding to the respective colors are formed, and then the oblique line patterns configured in the arrangement of the same colors are formed.

Figure 7:
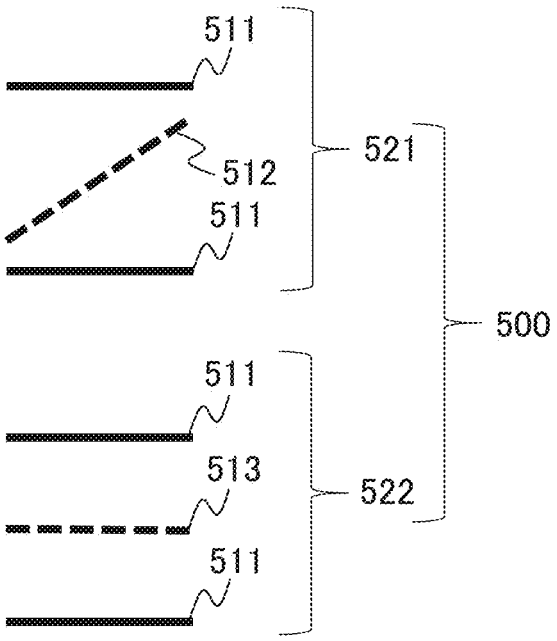
FIG. 7 is a diagram illustrating an embodiment of a positional shift correction pattern according to an embodiment of the present invention.

On the other hand, the mark 500 according to the present embodiment includes a correction first pattern 521, a correction second pattern 522, and a combination of the first and second patterns 521 and 522, as illustrated in FIG. 7.

The correction first pattern 521 has two reference line patterns 511 as cross line patterns and a correction target first pattern 512 sandwiched between the reference line patterns 511. That is, the correction first pattern 521 is a so-called "Z pattern".

The correction second pattern 522 has two reference line patterns 511 as cross line patterns and a correction target second pattern 513 sandwiched between the reference line patterns 511. That is, the correction second pattern 522 is a so-called "three-line pattern".

Hereinafter, in describing the present embodiment, the correction first pattern 521 may be simply described as "Z pattern", and the correction second pattern 522 may be simply described as "three-line pattern".

Note that FIG. 7 illustrates the mark 500 in the case where a color image in magenta is a target of positional shift. Therefore, in FIG. 7, the correction target first pattern 512 and the correction target second pattern 513 are drawn by the dotted lines used to represent magenta in the present embodiment. The reference line pattern 511 is formed in the reference color. Here, since black is used as the reference color as an example, the reference line patterns 511 is drawn as a straight line. In the following description, the color image in magenta will be used as an example of a correction target for simplification of description.

Further, as a comparative example for describing characteristics of the present embodiment, the conventional mark 400 illustrated in FIG. 6 will be used. In this case, a pattern obtained by extracting the cross line patterns and the oblique line pattern in black from the conventional mark 400 will be used as a conventional pattern 410 in the description.

Description of Overview of Periodic Speed Variation

Figure 8A:
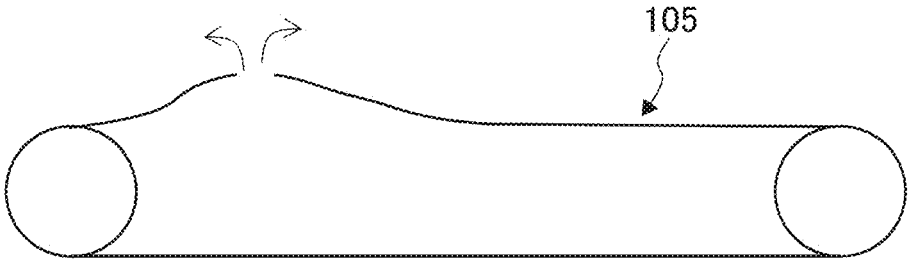
FIG. 8A is a diagram illustrating an example of an intermediate transfer belt.
Figure 8B:
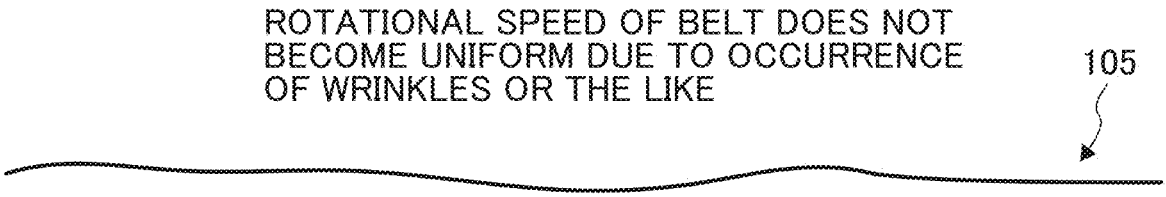
FIG. 8B is a diagram illustrating an example of fluctuation of the intermediate transfer belt.

Next, in the image forming apparatus according to an embodiment of the present invention, an example of an occurring factor of periodic rotational speed variation due to an endless component to be solved will be described. FIGS. 8A and 8B illustrate the intermediate transfer belt 105 as the endless component (endless rotational body). However, the occurring factor of the rotational speed variation to be a problem is not limited to the intermediate transfer belt 105, and for example, other components (the photoconductor drums 109 and the like) similarly become the occurring factors of the periodic speed variation of the rotational bodies.

As illustrated in FIG. 8A, it is assumed that a part of the intermediate transfer belt 105 is cut and stretched. Since the intermediate transfer belt 105 is made of a resin material (thermoplastic elastomer (TPE) or the like), the surface has "wrinkles" and "curls" and does not become flat over the entire length, as illustrated in FIG. 8B. Therefore, the rotational speed does not become uniform even if the intermediate transfer belt 105 is rotated as an endless rotational body. In a case of transferring the color images on the surface of the intermediate transfer belt 105 having non-uniform rotational speed, the transfer position returns to the same transfer position as one round before when the intermediate transfer belt 105 makes a round. However, positional shift locally occurs during the one round, and the transfer position comes to a different position from one round before. That is, during one round of the intermediate transfer belt 105, the "locally generated positional shift" in which a position different from the previous round becomes the transfer position occurs.

Figure 9:
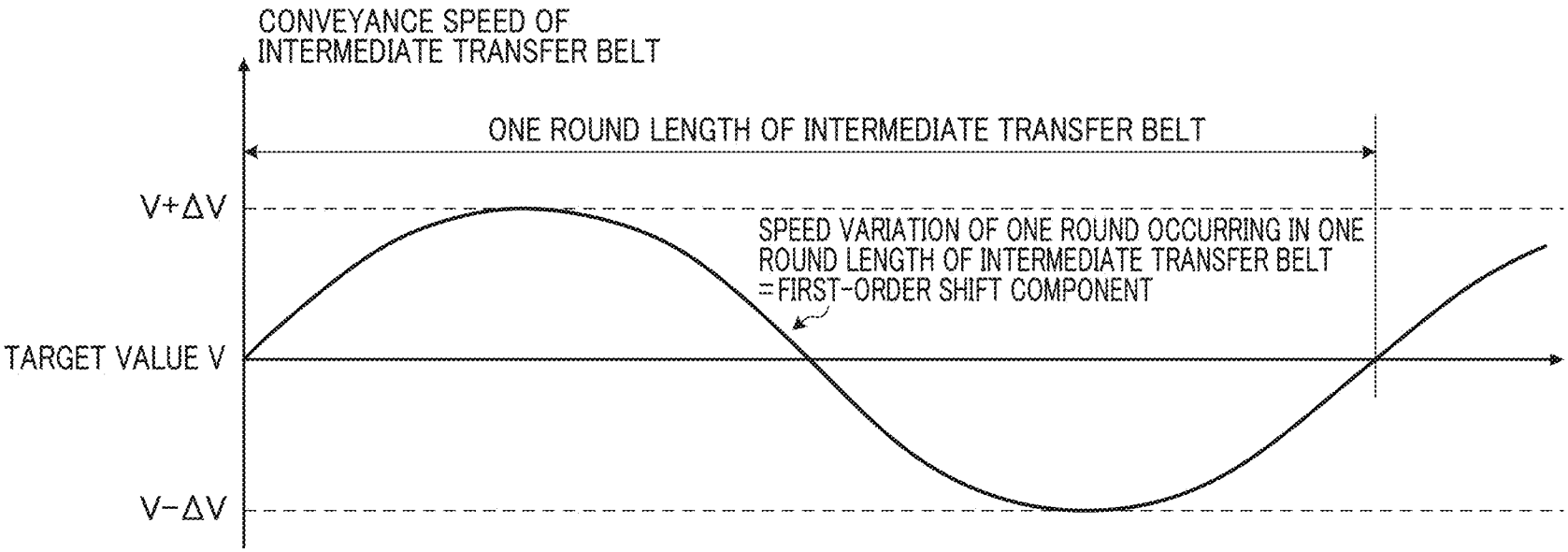
FIG. 9 is a graph illustrating fluctuation of the intermediate transfer belt.

FIG. 9 is a graph illustrating fluctuation of the rotational speed (conveyance speed of the toner image) of the intermediate transfer belt 105, and illustrates fluctuation over one round length of the intermediate transfer belt 105. Assuming that the origin of the graph in FIG. 9 changes such that the rotational speed of the intermediate transfer belt 105 draws a sine curve with the one round length of the intermediate transfer belt 105 as one period, for easy description as an ideal rotation speed (target value V). Since the intermediate transfer belt 105 continues to rotate in the image formation processing, similar speed variation repeatedly occurs. Hereinafter, when referring to the variation of the rotational speed, the rotational speed variation for making a round in the one round length of the intermediate transfer belt 105 is particularly described as "first-order speed variation".

When the rotational speed variation for making two rounds in the one round length of the intermediate transfer belt 105 is described as second-order speed variation, the rotational speed variation for making three rounds is described as third-order speed variation, and the like, these rotational speed variations can be expressed by sine functions. Therefore, an intensity component and a phase component of the sine function expressing the rotational speed variation become parameters indicating each order rotational speed variation. The periodic rotational speed variation occurring in the intermediate transfer belt 105 can be expressed by a sum from the first-order speed variation to the infinite-order speed variation. The detection timing of a position correction pattern becomes shifted from assumed (ideal) timing under the influence of the periodic speed variation.

Hereinafter, description will be given focusing on the intermediate transfer belt 105 among the components (endless rotational bodies) that cause the periodic speed variation. Note that parts described as the intermediate transfer belt 105 can be substituted for another endless rotational body such as the photoconductor drum 109, the transfer roller 119, the driving roller 108, the driven roller 107, the charging roller, or drive gears, such as the drive gear 108*a* and drive gears 140K, 140M, 140C, and 140Y, for the aforementioned rotational bodies.

Figure 10:
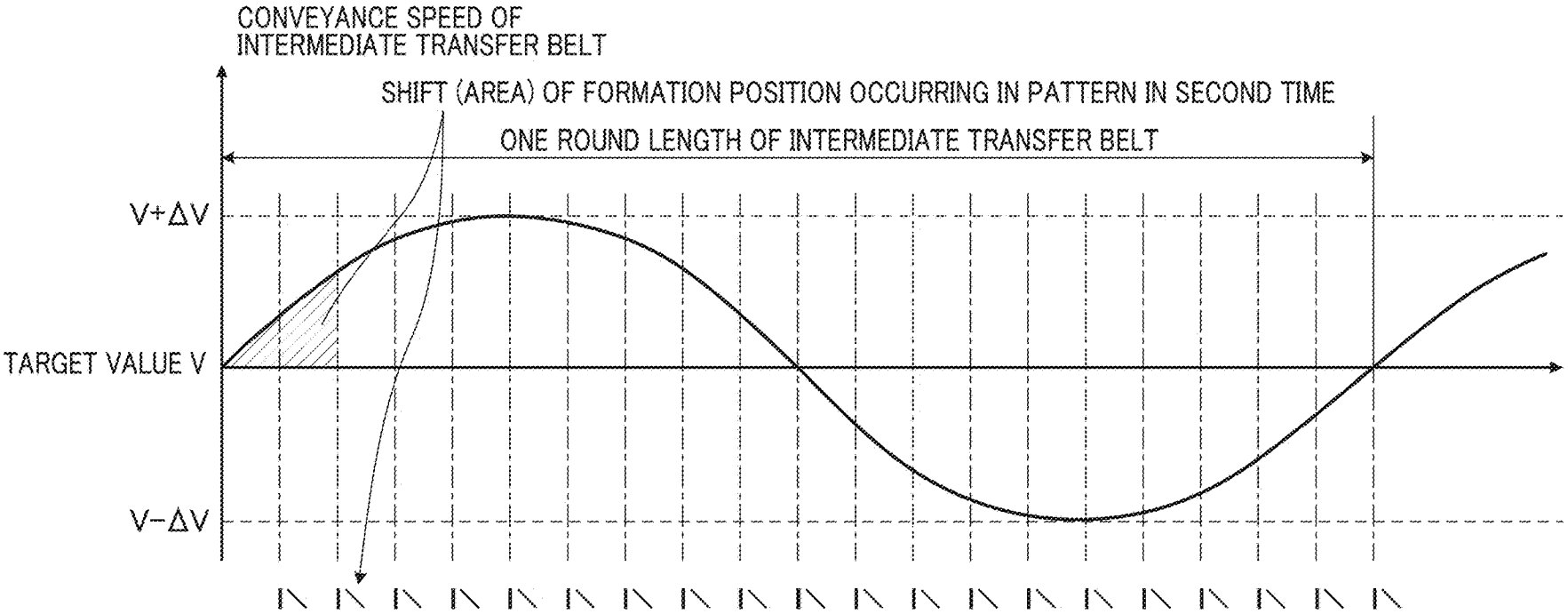
FIG. 10 is a graph for describing periodic speed variation and variation of a formation position of a conventional pattern.

Periodic Speed Variation and Shift of Formation Position of Conventional Pattern FIG. 10 is a graph for describing periodic speed variation and variation of a formation position of the conventional pattern 410. When the pattern image is shifted and formed from an assumed position due to the periodic speed variation, the shift can be expressed by time integration of the speed variation. As described above, the periodic speed variation can be expressed by a sine function, and the intensity component and the phase component of the sine function become parameters of each order.

Therefore, when calculating this time integration, the intensity component becomes a value divided by the order (first order, second order, . . . ), and the phase component becomes a value shifted by $\pi/2$. That is, when the periodic speed variation occurs, the shift of the formation position of the conventional pattern 410 can be expressed by a sine function similarly to the speed variation, and an intensity component and a phase component become parameters of each order. The periodic shifts occurring at the formation positions of the respective pattern images can be expressed by a sum of shifts of periodic formation positions up to the infinite order, counting the shift as first order, second order, third order, and the like. The detection timing of the conventional pattern 410 becomes shifted from assumed timing under the influence of the periodic formation position by the expressions.

As described above, since the shift of the formation position occurring in each conventional pattern 410 can be expressed by a sine function, when the conventional pattern 410 is formed at positions obtained by dividing the one round length of the intermediate transfer belt 105 by an integer, the sum of the shifts of the periodic formation positions occurring at all the line patterns becomes zero at the time of calculating the correction value for correcting positional shift. That is, when detection results of the conventional pattern 410 are averaged over one round length, the periodic shifts of the formation positions of the conventional pattern 410 are canceled and suppressed.

However, when shifts of the periodic formation positions simultaneously occur due to a plurality of factors such as the photoconductor drum 109 and the transfer roller 119, it is difficult to simultaneously cancel such shifts. Further, if the conventional mark 400 needs to be formed over the one round length of the intermediate transfer belt 105, the positional shift correction takes long time.

Periodic Speed Variation and Shift of Formation Position of Mark

Figure 11:
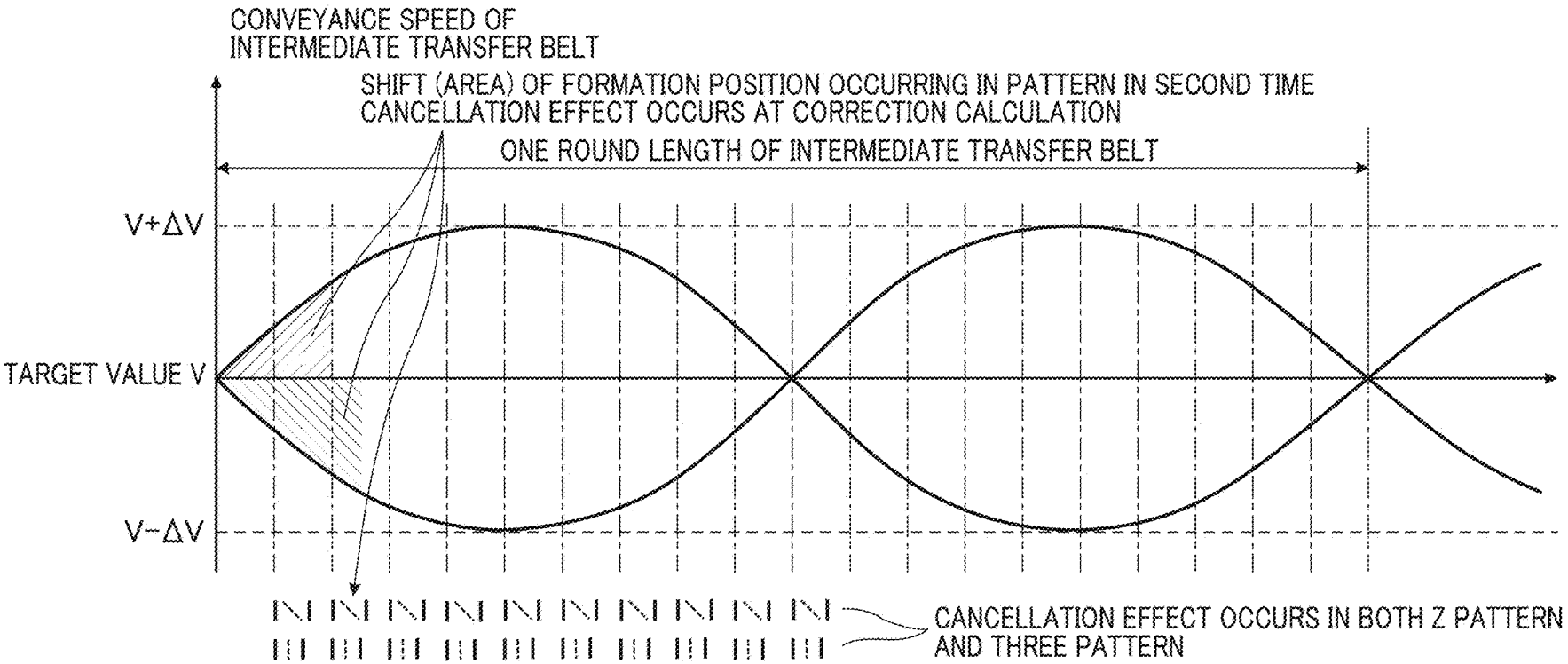
FIG. 11 is a graph for describing periodic speed variation and variation of formation positions of a Z pattern and a "three-line pattern" constituting a mark according to the present embodiment.

FIG. 11 is a graph for describing periodic speed variation and variation of formation positions of the "Z pattern" and the "three-line pattern" constituting the mark 500 according to the present embodiment. Similarly to the conventional example (variation of the formation position of the conventional pattern 410) described using FIG. 10, a shift of a formation position of the Z pattern (three-line pattern) can be expressed by a sine function, and an intensity component and a phase component become parameters of each order. The shifts of periodic formation positions occurring at the respective line patterns can be expressed by a sum of the shifts of periodic formation positions of the first order, second order, third order, and up to the infinite order.

At this time, a "first calculation expression" for calculating a positional shift correction value using the reference line patterns 511 formed first and the correction target first pattern 512 (correction target second pattern 513) in one Z pattern (three-line pattern), that is, the two line patterns, can be considered. Further, a "second calculation expression" for calculating a positional shift correction value using the correction target first pattern 512 (correction target second pattern 513) and the reference line patterns 511 calculated later can be considered. Then, the positional shift correction values calculated in these two calculation expressions are averaged, whereby a final positional shift correction value can be calculated.

By performing the calculation processing, the shifts of the periodic formation positions occurring in one Z pattern (three-line pattern) can be "approximately" canceled. Therefore, color matching can be performed with high accuracy even if the line patterns (mark 500) is not formed over the one round length of the intermediate transfer belt 105. At the same time, the time required for color matching can be reduced.

Different points of the mark 500 according to the present embodiment from the conventional mark 400 will be described. The mark 500 is different from the conventional case in exerting an effect according to the present invention even if the line patterns are not formed at positions of when the one round length of the intermediate transfer belt 105 is "divided by an integer". That is, the mark 500 can exert the effect even in a case of forming the line patterns at positions of when the one round length of the intermediate transfer belt 105 is "divided by a real number". Therefore, even if shifts of periodic formation positions simultaneously occur due to a plurality of endless rotational bodies such as the photoconductor drum 109 and the transfer roller 119, the influence of the shifts of the periodic formation positions in the respective line patterns can be effectively suppressed at the time of calculating the positional shift correction value.

Further, the first calculation expression and the second calculation expression are different in the reference line patterns 511 used in calculation. The difference in the shifts of the periodic formation positions occurring at the formation positions of the reference line patterns 511 is eliminated as the two reference line patterns 511 are closer, and thus the cancellation effect is improved. This means that the accuracy of alignment increases as a pattern interval decreases. The detection resolution of the line pattern depends on the pattern detection sensor 117. Therefore, if the reference line pattern 511 and the correction target first pattern 512 (correction target second pattern 513) are formed at an interval according to a detection spot of the pattern detection sensor 117, the alignment accuracy can be maximized.

Calculation of Positional Shift Correction Value

Figure 12A:
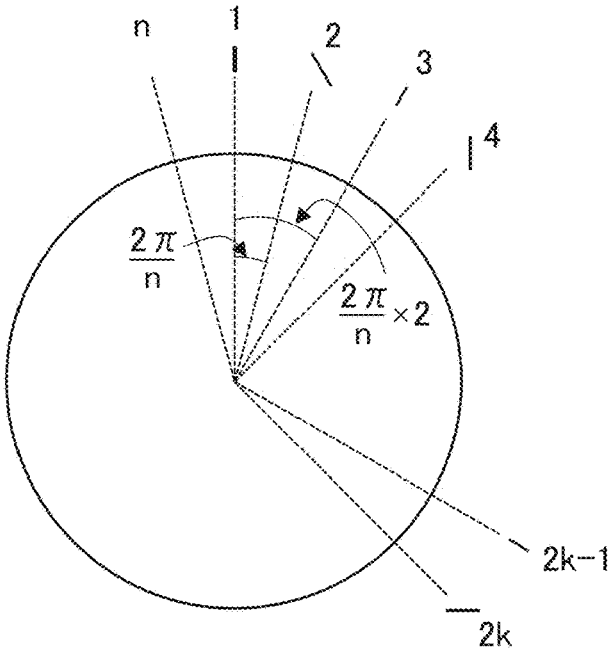
FIGS. 12A and 12B are graphs illustrating a state in which line patterns are formed at formation positions corresponding to positions obtained by dividing a peripheral length of an endless rotational body that periodically causes speed variation into n.
Figure 12B:
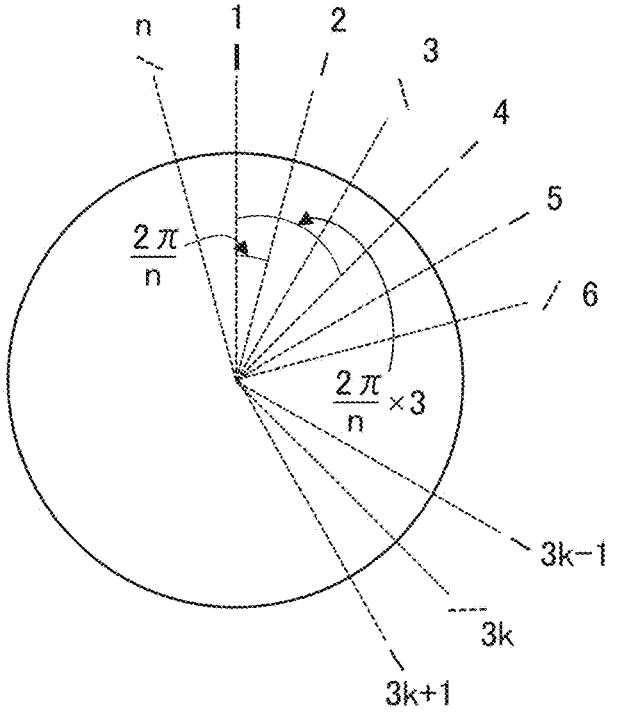

Next, calculation of the positional shift correction value when the line patterns (Z pattern or three-line pattern) constituting the mark 500 are repeatedly formed, and calculation of the positional shift correction value when the line patterns (conventional pattern) constituting the conventional mark 400 as a comparative example are repeatedly formed will be described with comparison with reference to FIGS. 12A and 12B. FIGS. 12A and 12B are graphs illustrating states in which the line patterns are formed at formation positions corresponding to positions obtained by dividing a peripheral length of an endless rotational body that periodically causes speed variation into n. Here, the line patterns are the cross line patterns (reference line patterns 511) and the oblique line pattern (correction target first pattern 512). FIG. 12A illustrates the conventional pattern and FIG. 12B illustrates the Z pattern.

As illustrated in FIG. 12A, the number of sets of the line patterns formed in the conventional pattern is "k". When this "k" is half (n/2) of the number of divisions (n) of the peripheral length of an endless rotational body, the conventional mark 400 is formed just on one round of the rotational body. The interval between the cross line patterns constituting the conventional mark 400 at this time corresponds to twice the n-divided interval. In this case, the shift of the formation position periodically occurring at the formation position of each line pattern is expressed by the following expression (1) using a Fourier series.

Expression 1

$$\Delta y(t) = \sum_{m=1}^{\infty} F(t, m) = \sum_{m=1}^{\infty} c_m \sin\left(2\pi\left(\frac{m * t}{n}\right) + \phi_m\right) \tag{1}$$

where m is order, $C_m$ is amplitude component, and $\phi_m$ is phase component.

Since simultaneously calculating the shifts of the periodic formation positions at all the orders (m) of the expression (1) is complicated, here, one order (m) is focused. In a case of calculating the influence of the shift of the periodic formation position occurring at the time of calculating the positional shift correction value, the expression (2) is a calculation expression.

Expression 2

$$F(t, m) = c_m \sin\left(2\pi\left(\frac{m*t}{n}\right) + \phi_m\right) \tag{2}$$

where m is order, $C_m$ is amplitude component, and $\phi_m$ is phase component.

Calculation of Positional Shift in Main-Scanning Direction in Conventional Pattern The positional shift correction value in the main-scanning direction is calculated using a difference between the detection timing of the oblique line pattern and the detection timing of the cross line pattern of the conventional pattern. In this case, the influence (Δmain(i)) of the shift of the periodic formation position occurring in the i-th set can be expressed by the following expression (3).

Expression 3

$$\Delta\text{main}(i) = F(2i, m) - F(2i-1, m) = c_m \sin\left(2\pi\left(\frac{m*2i}{n}\right) + \phi_m\right) - c_m \sin\left(2\pi\left(\frac{m*(2i-1)}{n}\right) + \phi_m\right) \tag{3}$$

In the expression (3), k sets of the conventional patterns are detected, and the results are averaged to calculate the positional shift correction value. In this case, the influence of the shift of the periodic formation position is expressed by the following expression (4). Note that an intermediate expression regarding development from the expression (3) to the expression (4) is omitted.

Expression 4

$$\Delta\text{main} = \frac{1}{k}\sum_{i=1}^{k}(F(2i, m) - F(2i-1, m)) = \frac{1}{k}\sum_{i=1}^{k}\left[c_m \sin\left(2\pi\left(\frac{m*2i}{n}\right) + \phi_m\right) - c_m \sin\left(2\pi\left(\frac{m*(2i-1)}{n}\right) + \phi_m\right)\right] = 2c_m \sin\left(\frac{\pi m}{n}\right)\sqrt{\frac{k + 2\sum_{i=1}^{k-1}\left\{(k-i)\cos\left(\frac{4\pi m i}{n}\right)\right\}}{k^2}}\sin(\phi_m + \alpha) \tag{4}$$

$$\alpha = \tan^{-1}\frac{-1}{\sum_{i=1}^{k}\tan\left(\frac{4\pi m i}{n} - \frac{\pi m}{n}\right)}$$

Calculation of Positional Shift in Main-Scanning Direction in Z Pattern

In the Z pattern, an interval until the same reference line pattern is formed again corresponds to three times the n-divided interval. When calculating the positional shift correction value in the main-scanning direction using the differences between the detection timing of the correction target pattern and the detection timing of the reference line pattern existing before and after the correction target pattern, the influence (Δmain(i)) of the shift of the periodic formation position occurring in the i-th set can be expressed by the following expression (5).

Expression 5

$$\Delta\text{main}(i) = \frac{1}{2}\{[F(3i, m) - F(3i-1, m)] + (-1)\cdot[F(3i+1, m) - F(3i, m)]\} = \frac{1}{2}\left\{\left[c_m \sin\left(2\pi\left(\frac{m*3i}{n}\right) + \phi_m\right) - c_m \sin\left(2\pi\left(\frac{m*(3i-1)}{n}\right) + \phi_m\right)\right] + (-1)\cdot\left[c_m \sin\left(2\pi\left(\frac{m*(3i+1)}{n}\right) + \phi_m\right) - c_m \sin\left(2\pi\left(\frac{m*3i}{n}\right) + \phi_m\right)\right]\right\} \tag{5}$$

k sets of the Z patterns are detected, and the results are averaged to calculate the positional shift correction value. In this case, the influence of the shift of the periodic formation position is expressed by the following expression (6). Note that an intermediate expression regarding development from the expression (5) to the expression (6) is omitted.

Expression 6

$$\Delta\text{main} = \frac{1}{k}\sum_{i=1}^{k}\frac{1}{2}\{[F(3i, m) - F(3i-1, m)] + (-1)\cdot[F(3i+1, m) - F(3i, m)]\} = \frac{1}{2k}\sum_{i=1}^{k}\left\{\left[c_m \sin\left(2\pi\left(\frac{m*3i}{n}\right) + \phi_m\right) - c_m \sin\left(2\pi\left(\frac{m*(3i-1)}{n}\right) + \phi_m\right)\right] + (-1)\cdot\left[c_m \sin\left(2\pi\left(\frac{m*(3i+1)}{n}\right) + \phi_m\right) - c_m \sin\left(2\pi\left(\frac{m*3i}{n}\right) + \phi_m\right)\right]\right\} = 2c_m \sin^2\left(\frac{\pi m}{n}\right)\sqrt{\frac{k + 2\sum_{i=1}^{k-1}\left[(k-i)\cos\left(\frac{6\pi m i}{n}\right)\right]}{k^2}}\sin(\phi_m + \beta) \tag{6}$$

$$\beta = \tan^{-1}\left(\sum_{i=1}^{k}\tan\frac{6\pi m i}{n}\right)$$

Here, the two expressions are compared. The influence of the shift of the periodic formation position of the conventional pattern is expressed by the following expression (7). Meanwhile, the influence of the shift of the periodic formation position of the Z pattern according to the present embodiment is expressed by the following expression (8).

Expression 7

$$\Delta\text{main} = 2c_m \sin\left(\frac{\pi m}{n}\right)\sqrt{\frac{k + 2\sum_{i=1}^{k-1}\left[(k-i)\cos\left(\frac{4\pi m i}{n}\right)\right]}{k^2}}\sin(\phi_m + \alpha) \tag{7}$$

$$\left(\alpha = \tan^{-1}\frac{-1}{\sum_{i=1}^{k}\tan\left(\frac{4\pi m i}{n}\frac{\pi m}{n}\right)}\right)$$

-continued

Expression 8

$$\Delta\text{main} = 2c_m\sin^2\left(\frac{\pi m}{n}\right)\sqrt{\frac{k + 2\sum_{i=1}^{k-1}(k-i)\cos\left(\frac{6\pi mi}{n}\right)}{k^2}}\sin(\phi_m + \beta) \quad (8)$$

$$\left(\beta = \tan^{-1}\left(\sum_{i=1}^{k}\tan\frac{6\pi mi}{n}\right)\right)$$

The above expression (7) and expression (8) are compared. In each expression, the sine function including $\phi_m$ is the phase component. Therefore, it shows that the influence of the shift of the periodic formation position that occurs at the time of calculating the positional shift correction value (the influence on the calculated positional shift correction value) changes depending on the position where the line pattern starts to be formed. If the above-described phase component (value in the term of the sine function including $\phi_m$) can be made "zero", the influence of the shift of the periodic formation position can be completely suppressed. However, in practice, simultaneously making "zero" in the above expression in all of orders (m) is not realistic. Therefore, to confirm the degree (effect) of suppressing the influence of the shift of the periodic formation position occurring at the time of calculating the positional shift correction value, it is desirable to compare and confirm the intensity components (or effective values) instead of the phase components as described above.

When the number of sets (k) of line patterns is "1", the form is the same as the form of a conventional line pattern disclosed in JP-2001-034026-A. Further, when k=1 is assigned to the expressions (7) and (8), the calculation result of the square root part becomes "1". Therefore, when k that is the number of sets of line patterns is "1", the positional shift correction value calculated for the shift in the main-scanning direction of the conventional pattern expressed in the expression (7) is expressed by the following expression (9).

Expression 9

$$IC_{cp} = 2c_m\sin\left(\frac{\pi m}{n}\right) \quad (9)$$

where $IC_{cp}$ is the intensity component of the conventional pattern of when k=1.

Similarly, when k that is the number of sets of line patterns is "1", the positional shift correction value calculated for the shift in the main-scanning direction of the Z pattern expressed in the expression (8) is expressed by the following expression (10).

Expression 10

$$IC_{zp} = 2c_m\sin^2\left(\frac{\pi m}{n}\right) \quad (10)$$

where $IC_{zp}$ is the intensity component of the Z pattern of when k=1.

In a case of calculating a ratio of the intensity components of the conventional pattern and the Z pattern using the expressions (9) and (10), the ratio is expressed by the following expression (11).

Expression 11

$$\text{Ratio} = |IC_{zp}/IC_{cp}| = \left|\sin\left(\frac{\pi m}{n}\right)\right| \leq 1 \quad (11)$$

Figure 13:
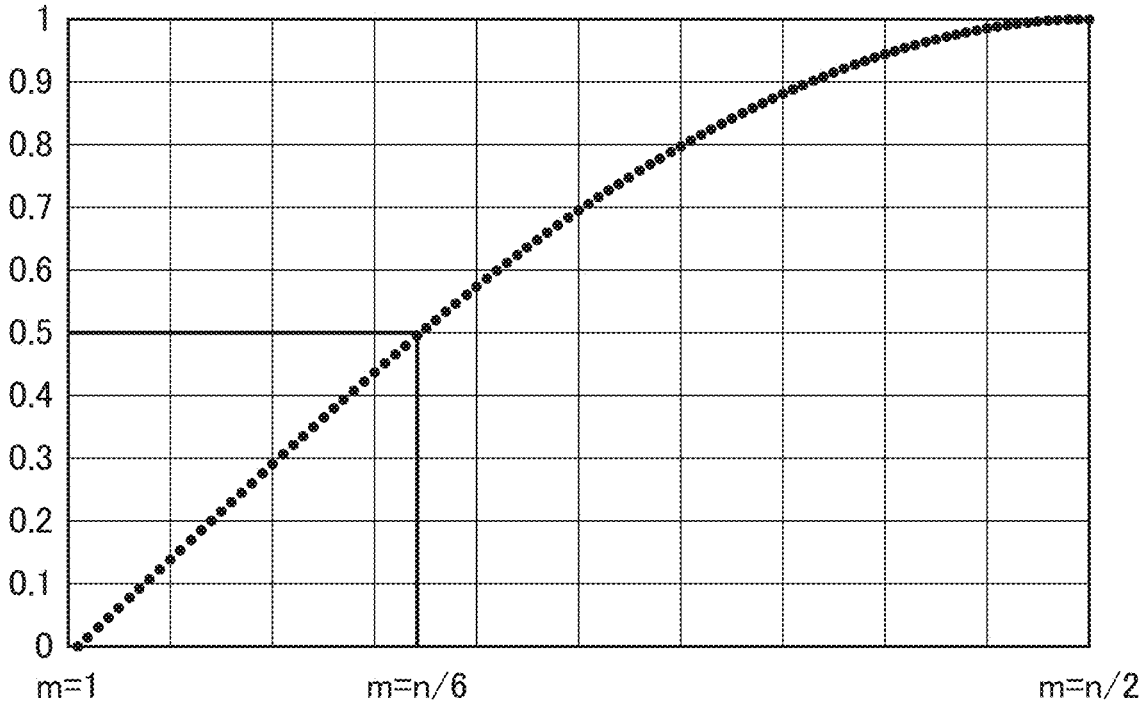
FIG. 13 is a graph in which a horizontal axis represents a ratio of an order "m" and the number of divisions "n", and a vertical axis represents a value calculated by an expression.

FIG. 13 is a graph in which a horizontal axis represents a ratio of an order "m" and the number of divisions "n" on the basis of the expression (11), and a vertical axis represents a value calculated by the expression (11). According to FIG. 13, regarding the influence of the periodic shift on the Z pattern, it is shown that the influence of the shift of the periodic formation position occurring at each line pattern is suppressed and alignment (color matching) can be performed at the time of calculating the positional shift correction value in all of the orders m, as compared with the conventional line patterns. A component of the order (m) of a low frequency band can be more effectively suppressed than a component of the order of a high frequency band. Further, according to FIG. 13, it is found that the influence of the shift of the periodic formation position can be effectively suppressed by increasing the number of divisions n.

Calculation of Positional Shift in Sub-Scanning Direction in Conventional Example A state in which the cross line pattern in a correction color is formed instead of the oblique line pattern in the reference color illustrated in FIG. 12A is assumed. In this case, a color shift correction value in the sub-scanning direction is calculated using a difference between the detection timing of the cross line pattern in the correction value and the detection timing of the cross line pattern in the reference color. The influence of the shift of the periodic formation position occurring in the i-th set is expressed by the following expression (12).

Expression 12

$$\Delta sub(i) = F(2i, m) - F(2i-1, m) = c_m\sin\left(2\pi\left(\frac{m*2i}{n}\right) + \phi_m\right) - c_m\sin\left(2\pi\left(\frac{m*(2i-1)}{n}\right) + \phi_m\right) \quad (12)$$

The expression (12) is the same as the expression (3) expressing the influence of the shift of the periodic formation position occurring at the time of calculating the positional shift correction value in the main-scanning direction. That is, in the conventional pattern, the shift of the periodic formation position indicates that similar influence occurs in the main-scanning direction and in the sub-scanning direction. However, it should be noted that there is a possibility that the number of divisions n is different.

Influence of Positional Shift in Sub-Scanning Direction in Three-Line Pattern

Next, a state in which the cross line pattern using a correction target value is formed instead of the correction target pattern (oblique line pattern) illustrated in FIG. 12B is assumed. That is, a state in which the three-line pattern is formed is assumed. In this case, the positional shift correction value in the sub-scanning direction is calculated using the differences between the detection timing of a certain correction target pattern, and the detection timing of the reference line patterns existing before and after the correction target pattern. In this case, the influence of the shift of the periodic formation position occurring in the i-th set is expressed by the next expression (13).

Expression 13

$$\Delta sub(i) = \frac{1}{2}\{[F(3i, m) - F(3i-1, m)] + (-1)\cdot [F(3i+1, m) - F(3i, m)]\} = \left[c_m \sin\left(2\pi\left(\frac{m*3i}{n}\right) + \phi_m\right) - c_m \sin\left(2\pi\left(\frac{m*(3i-1)}{n}\right) + \phi_m\right)\right] + (-1)\cdot\left[c_m \sin\left(2\pi\left(\frac{m*(3i+1)}{n}\right) + \phi_m\right) - c_m \sin\left(2\pi\left(\frac{m*3i}{n}\right) + \phi_m\right)\right] \quad (13)$$

Therefore, the influence of the shift of the periodic formation position occurring at the time of calculating the positional shift correction value in the sub-scanning direction can be similarly considered to the main-scanning direction. Here, the two expressions are compared. The influence of the shift of the periodic formation position of the conventional pattern is expressed by the following expression (14). Meanwhile, the influence of the shift of the periodic formation position of the three-line pattern according to the present embodiment is expressed by the following expression (15).

Expression 14

$$\Delta sub = 2c_m \sin\left(\frac{\pi m}{n}\right)\sqrt{\frac{k + 2\sum_{i=1}^{k-1}\left((k-i)\cos\left(\frac{4\pi mi}{n}\right)\right)}{k^2}}\sin(\phi_m + \alpha) \quad (14)$$

$$\left(\alpha = \tan^{-1}\frac{-1}{\sum_{i=1}^{k}\tan\left(\frac{4\pi mi}{n}\frac{\pi m}{n}\right)}\right)$$

Expression 15

$$\Delta sub = 2c_m \sin^2\left(\frac{\pi m}{n}\right)\sqrt{\frac{k + 2\sum_{i=1}^{k-1}\left((k-i)\cos\left(\frac{6\pi mi}{n}\right)\right)}{k^2}}\sin(\phi_m + \beta) \quad (15)$$

$$\left(\beta = \tan^{-1}\left(\sum_{i=1}^{k}\tan\frac{6\pi mi}{n}\right)\right)$$

Similarly to the shift in the main-scanning direction, in the case where the number of sets k of patterns is "1", a ratio of the intensity components of the three-line patterns in the conventional pattern and in the present embodiment in the sub-scanning direction is expressed by the following expression (16).

Expression 16

$$\text{Ratio} = |IC_{3p}/IC_{cp}| = \left|\sin\left(\frac{\pi m}{n}\right)\right| \le 1 \quad (16)$$

where $IC_{3p}$ is the intensity component of three-line patterns in the conventional pattern and $IC_{cp}$ is the intensity component of the conventional pattern.

Calculation of Positional Shift Correction Value

Figure 14A:
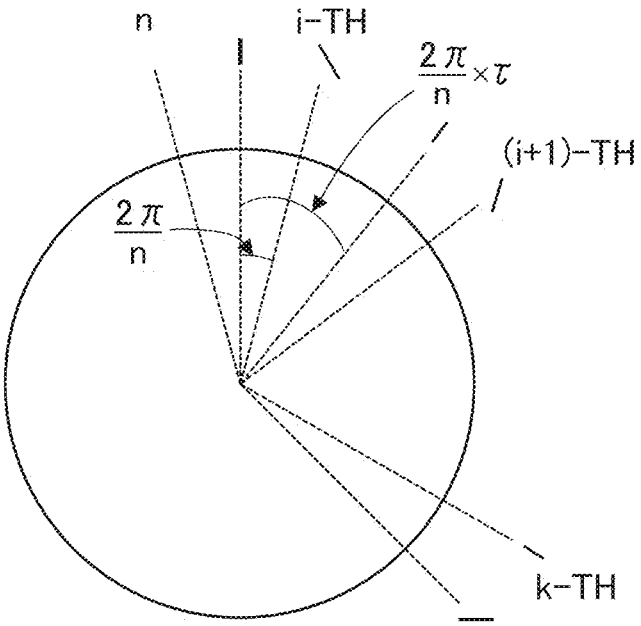
FIGS. 14A and 14B are graphs illustrating a state in which line patterns according to an embodiment of the present invention are formed at formation positions corresponding to positions obtained by dividing a peripheral length of an endless rotational body that periodically causes speed variation into n.
Figure 14B:
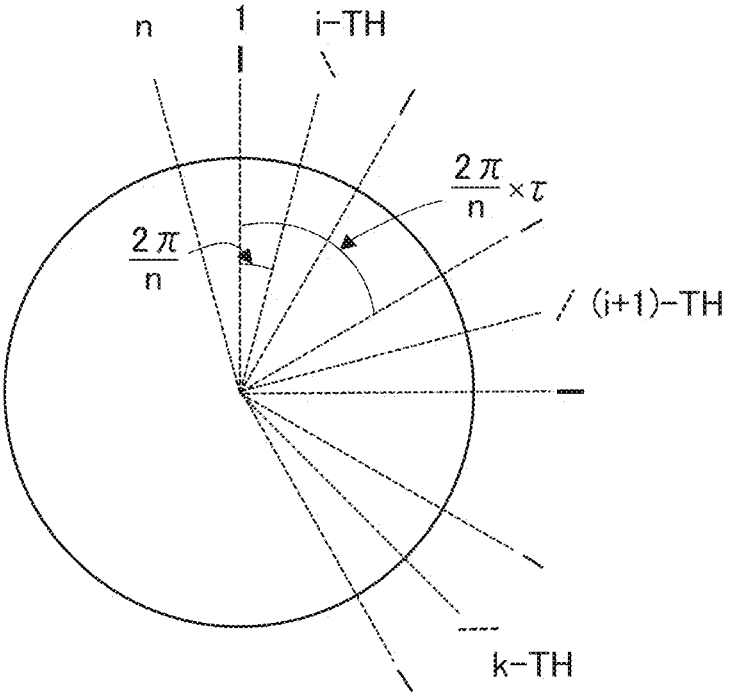

Next, calculation of the positional shift correction value when the interval for repeatedly forming the line patterns (Z pattern or three-line pattern) constituting the mark 500 is changed will be described with reference to FIGS. 14A and 14B. FIGS. 14A and 14B are graphs illustrating states in which the line patterns are formed at formation positions corresponding to positions obtained by dividing a peripheral length of an endless rotational body that periodically causes speed variation into n. Here, the line patterns are the cross line patterns (reference line patterns 511) and the oblique line pattern (correction target first pattern 512). FIG. 14A illustrates the conventional pattern and FIG. 14B illustrates the Z pattern. When comparing FIGS. 12A and 12B and FIGS. 14A and 14B, FIGS. 14A and 14B illustrate that the line pattern intervals of when repeatedly forming the same line pattern changes.

In FIG. 12A, the interval between the cross line patterns corresponds to twice the n-divided interval. Meanwhile, in FIG. 14A, the interval between the cross line patterns corresponds to τ times the n-divided interval. Further, in FIG. 12B, the interval until the same reference line pattern is formed again corresponds to three times the n-divided interval. Meanwhile, in FIG. 14B, the interval until the same reference line pattern is formed again corresponds to τ times the n-divided interval. How the interval for repeatedly forming the same line pattern exerts the influence at the time of calculating the positional shift correction value by using the parameter τ for the interval of the repeatedly formed line pattern in this way is analyzed.

Calculation of Positional Shift in Main-Scanning Direction in Conventional Pattern The interval between the i-th cross line pattern and the (i+1)-th cross line pattern is $2\pi/n\times\tau$. The influence of the shift of the periodic formation position occurring in the i-th set is the next expression (17).

Expression 17

$$\Delta\text{main}(i) = F(\tau i, m) - F(\tau i - 1, m) = c_m \sin\left(2\pi\left(\frac{m*\tau i}{n}\right) + \phi_m\right) - c_m \sin\left(2\pi\left(\frac{m*(\tau i - 1)}{n}\right) + \phi_m\right) \quad (17)$$

When comparing the above-described expression (3) with the expression (17), the portion "2i" in the expression (3) is "τi" in the expression (17). When developing this expression (17), the following expression (18) is obtained. Note that an intermediate expression regarding development from the expression (17) to the expression (18) is omitted.

Expression 18

$$\Delta\text{main} = 2c_m \sin\left(\frac{\pi m}{n}\right)\sqrt{\frac{k + 2\sum_{i=1}^{k-1}\left\{(k-i)\cos\left(\frac{2\pi mi}{n}\times\tau\right)\right\}}{k^2}}\sin(\phi_m + \alpha) \quad (18)$$

$$\left(\alpha = \tan^{-1}\frac{-1}{\sum_{i=1}^{k}\tan\left(\frac{2\pi mi}{n}\times\tau - \frac{\pi m}{n}\right)}\right)$$

Calculation of Positional Shift in Main-Scanning Direction in Z Pattern

The interval between the i-th cross line pattern and the (i+1)-th cross line pattern is $2\pi/n\times\tau$. The influence of the shift of the periodic formation position occurring in the i-th set is expressed by the next expression (19).

Expression 19

$$\Delta\text{main}(i) = \left[c_m\sin\left(2\pi\left(\frac{m*\tau i}{n}\right)+\phi_m\right) - c_m\sin\left(2\pi\left(\frac{m*(\tau i-1)}{n}\right)+\phi_m\right)\right] + (-1)\cdot\left[c_m\sin\left(2\pi\left(\frac{m*(\tau i+1)}{n}\right)+\phi_m\right) - c_m\sin\left(2\pi\left(\frac{m*\tau i}{n}\right)+\phi_m\right)\right] \quad (19)$$

When comparing the above-described expression (5) with the expression (19), the portion "3i" in the expression (5) is "τi" in the expression (19). When developing this expression (19), the following expression (20) is obtained. Note that an intermediate expression regarding development from the expression (19) to the expression (20) is omitted.

Expression 20

$$\Delta\text{main} = 2c_m\sin^2\left(\frac{\pi m}{n}\right)\sqrt{\frac{k+2\sum_{i=1}^{k-1}\left\{(k-i)\cos\left(\frac{2\pi mi}{n}\times\tau\right)\right\}}{k^2}}\sin(\phi_m+\beta) \quad (20)$$

$$\left(\beta = \tan^{-1}\left(\sum_{i=1}^{k}\tan\left(\frac{2\pi mi}{n}\times\tau\right)\right)\right)$$

Here, the two expressions are compared. The influence of the shift of the periodic position of the conventional pattern is expressed by the following expression (21). Meanwhile, the influence of the shift of the periodic formation position of the Z pattern is expressed by the following expression (22).

Expression 21

$$\Delta\text{main} = 2c_m\sin\left(\frac{\pi m}{n}\right)\sqrt{\frac{k+2\sum_{i=1}^{k-1}\left\{(k-i)\cos\left(\frac{2\pi mi}{n}\times\tau\right)\right\}}{k^2}}\sin(\phi_m+\alpha) \quad (21)$$

$$\left(\alpha = \tan^{-1}\frac{-1}{\sum_{i=1}^{k}\tan\left(\frac{2\pi mi}{n}\times\tau-\frac{\pi m}{n}\right)}\right)$$

Expression 22

$$\Delta\text{main} = 2c_m\sin^2\left(\frac{\pi m}{n}\right)\sqrt{\frac{k+2\sum_{i=1}^{k-1}\left\{(k-i)\cos\left(\frac{2\pi mi}{n}\times\tau\right)\right\}}{k^2}}\sin(\phi_m+\beta) \quad (22)$$

$$\left(\beta = \tan^{-1}\left(\sum_{i=1}^{k}\tan\left(\frac{2\pi mi}{n}\times\tau\right)\right)\right)$$

When comparing the expression (21) with the expression (22), it is found that the expressions included in the square root terms accord. Therefore, when the scale factors (parameters τ) of the interval for repeatedly forming the same pattern are adjusted to accord in the conventional pattern and the Z pattern, the ratio of the intensity components is expressed by the next expression (23) regardless of the number of sets k of patterns.

Expression 23

$$\text{Ratio} = |IC_{zp}/IC_{cp}| = \left|\sin\left(\frac{\pi m}{n}\right)\right| \le 1 \quad (16)$$

where $IC_{zp}$ is the intensity component of the Z pattern and $IC_{cp}$ is the intensity component of the conventional pattern.

The expression of the ratio is similar in the case of the three-line patterns. Therefore, when τ is 2, the cross line patterns (reference line patterns) in the reference color of the Z patterns (three-line patterns) overlap.

Graph of Scale Factor τ and Influence of Shift of Periodic Formation Position

Next, a relationship between the scale factor τ and the influence of the shift of the periodic formation position will be described with reference to the graphs in FIGS. 15 to 26. The graphs in FIGS. 15 to 18 respectively express the expressions described with reference to FIGS. 14A and 14B as three-dimensional graphs in a three-dimensional coordinate system including an X axis, a Y axis, and a Z axis (FIGS. 15, 18, 21, and 24), two-dimensional graphs projected on an X-Y plane (FIGS. 16, 19, 22, and 25), and two-dimensional graphs projected on a Y-Z plane (FIGS. 17, 20, 23, and 26). Here, the X axis represents the number of sets of patterns. The Y axis represents the order (m) of the shift of the periodic formation position.

The Z axis represents the scale factor of the influence of the shift of the periodic formation position occurring in each line pattern at the time of calculating the positional shift correction value. Note that the graphs in FIGS. 15 to 26 are examples in which "72" is set as the value of the number of divisions n.

In the expressions obtained by the above calculation, the coefficient Cm corresponds to the intensity component of the shift of the periodic formation position in the order m. Therefore, the three-dimensional graphs according to FIGS. 15 to 26 are created using the expression (24), which is the remaining expression excluding the intensity component (Cm) and the phase component (the term of the sine function including $\phi_m$).

Expression 24

$$G(k,m) = 2\sin^2\left(\frac{\pi m}{n}\right)\sqrt{\frac{k+2\sum_{i=1}^{k-1}\left\{(k-i)\cos\left(\frac{2\pi mi}{n}\times\tau\right)\right\}}{k^2}} \quad (24)$$

Figure 15:
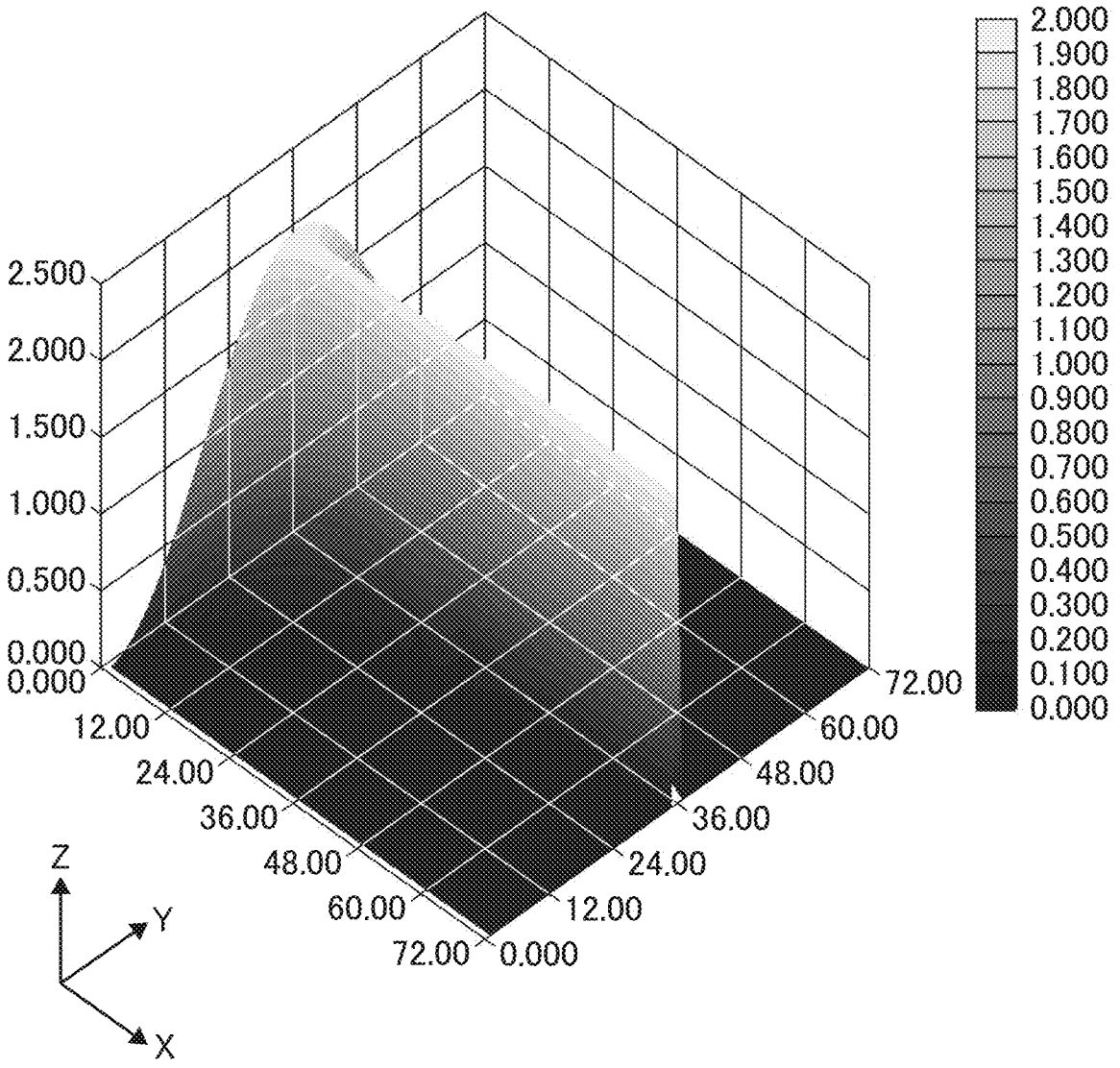
FIG. 15 is a graph illustrating a relationship between a scale factor τ and an influence of a shift of a periodic formation position in a case where the scale factor τ is 2.
Figure 16:
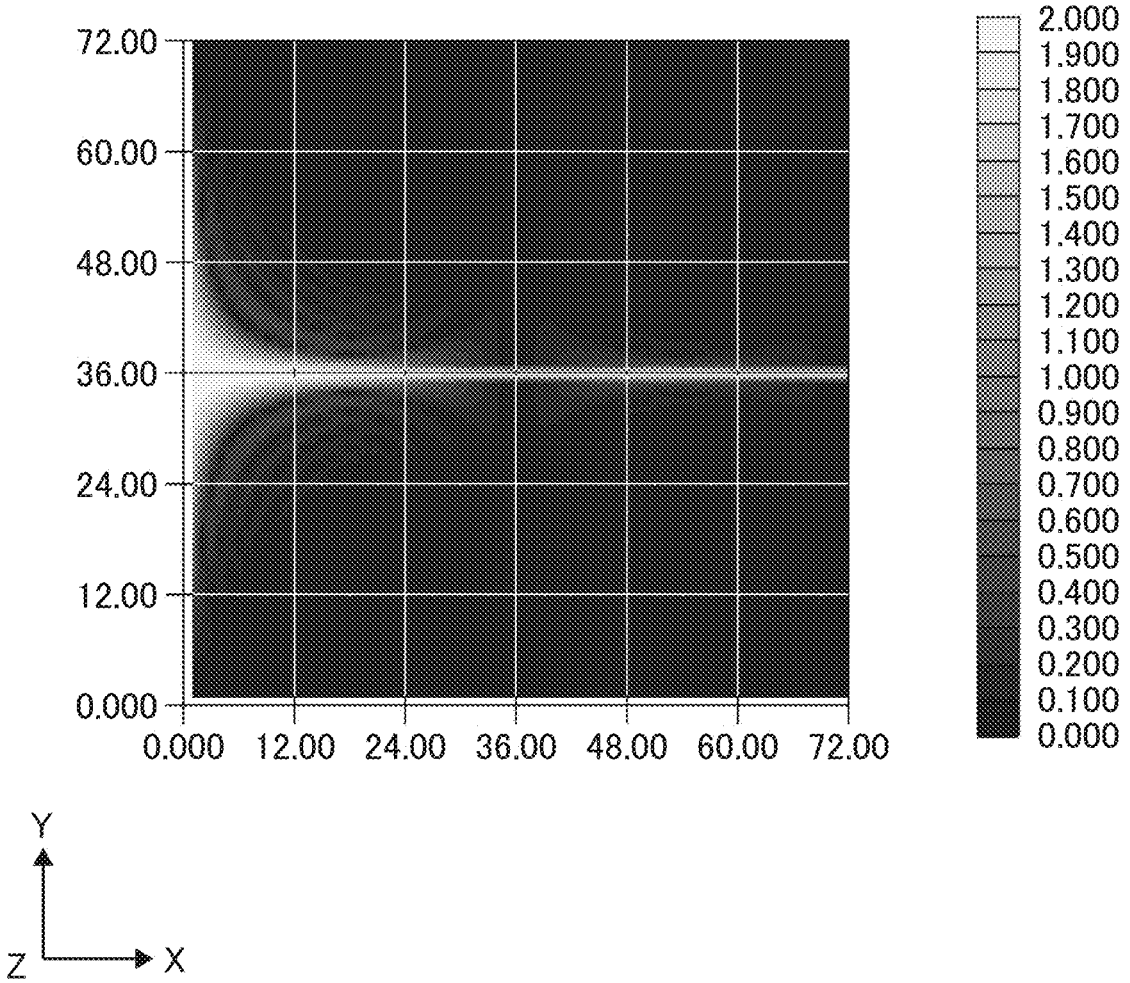
FIG. 16 is a graph illustrating the relationship between a scale factor τ and an influence of a shift of a periodic formation position in a case where the scale factor τ is 2.
Figure 17:
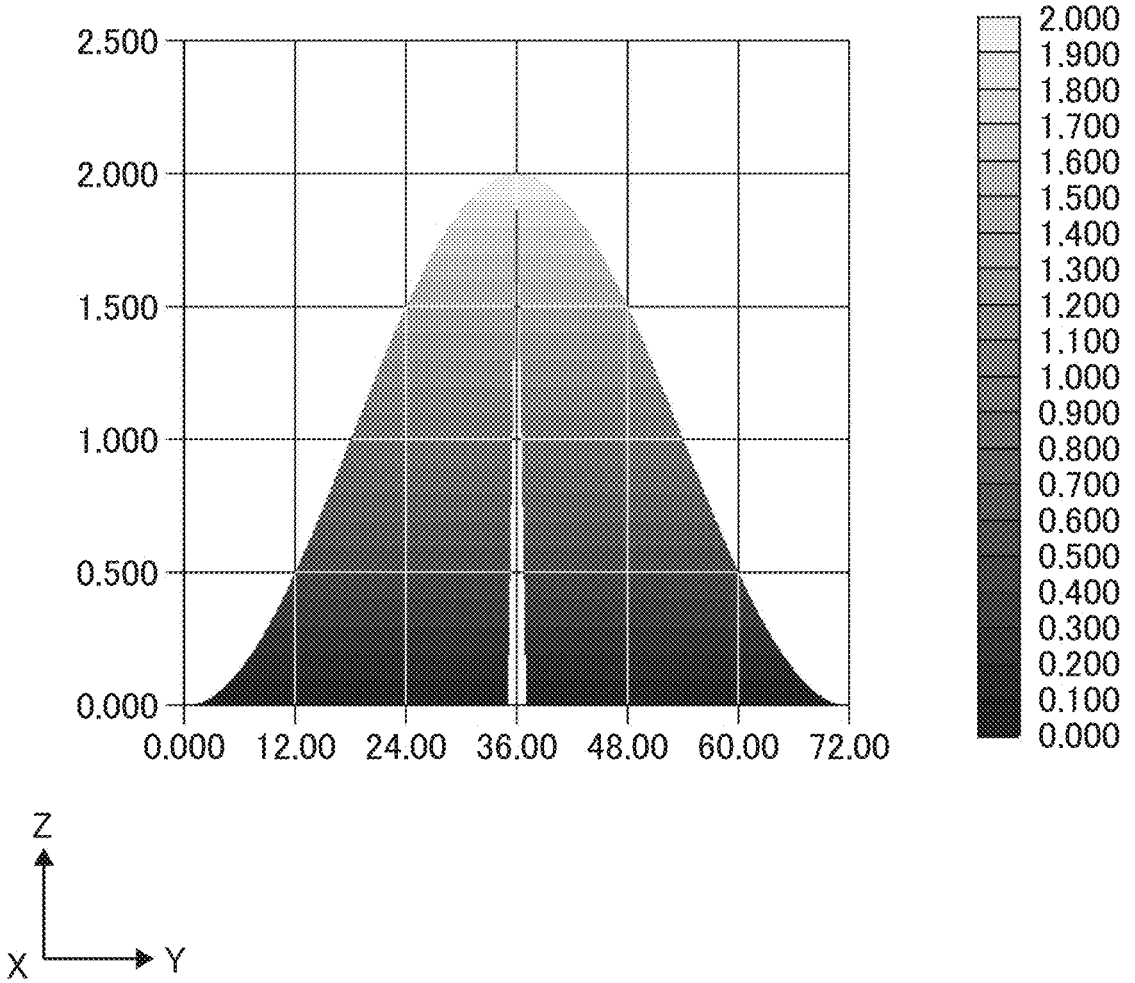
FIG. 17 is a graph illustrating the relationship between a scale factor τ and an influence of a shift of a periodic formation position in a case where the scale factor τ is 2.

First, FIGS. 15 to 17 will be described. FIGS. 15 to 17 are graphs in the case where the scale factor τ is "2". As is clear from FIGS. 15 to 17, the influence of the shift of the periodic formation position where the order m is "36" cannot be suppressed in the case where the scale factor τ is "2".

Figure 18:
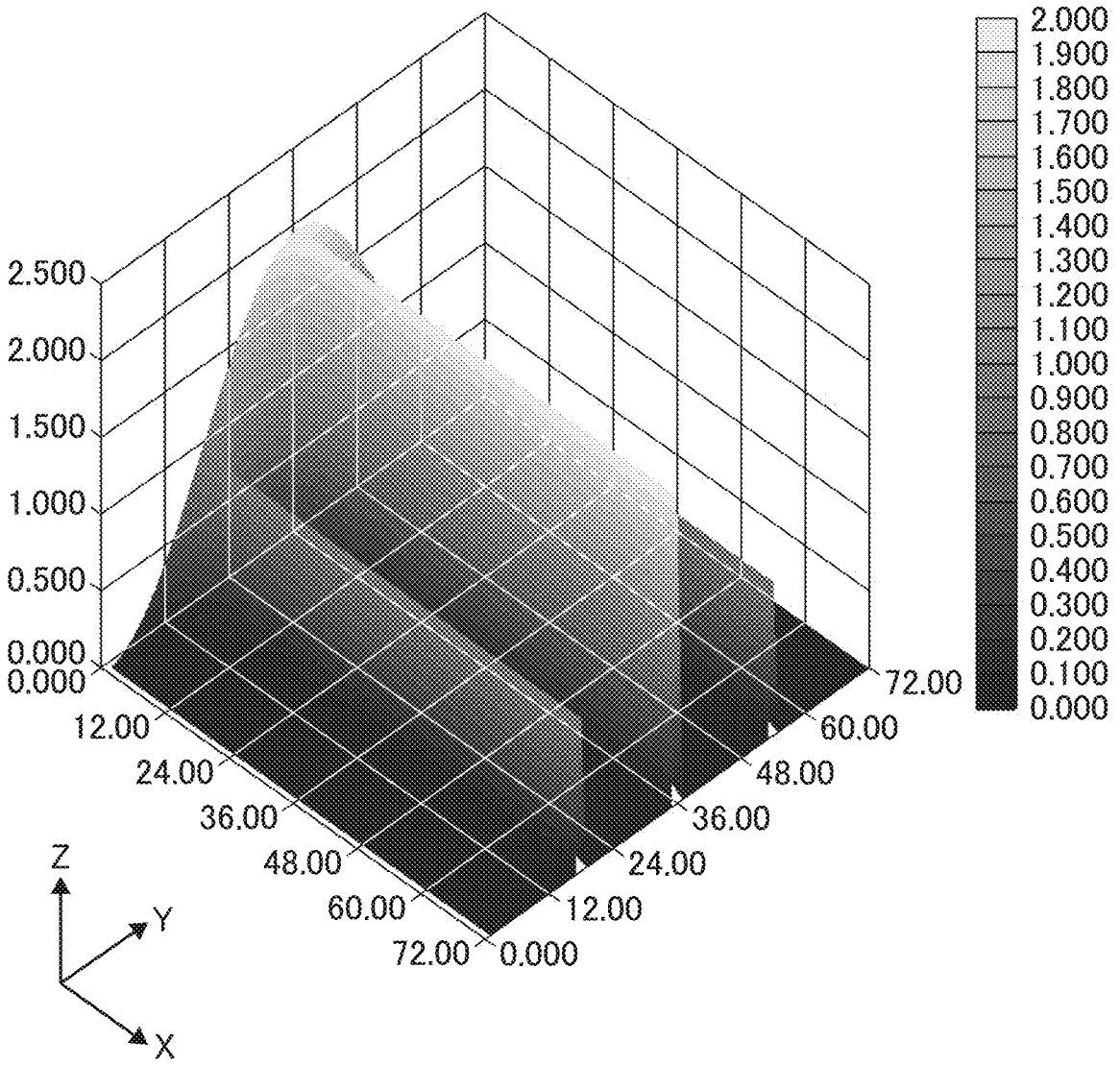
FIG. 18 is a graph illustrating a relationship between a scale factor τ and an influence of a shift of a periodic formation position in a case where the scale factor τ is 4.
Figure 19:
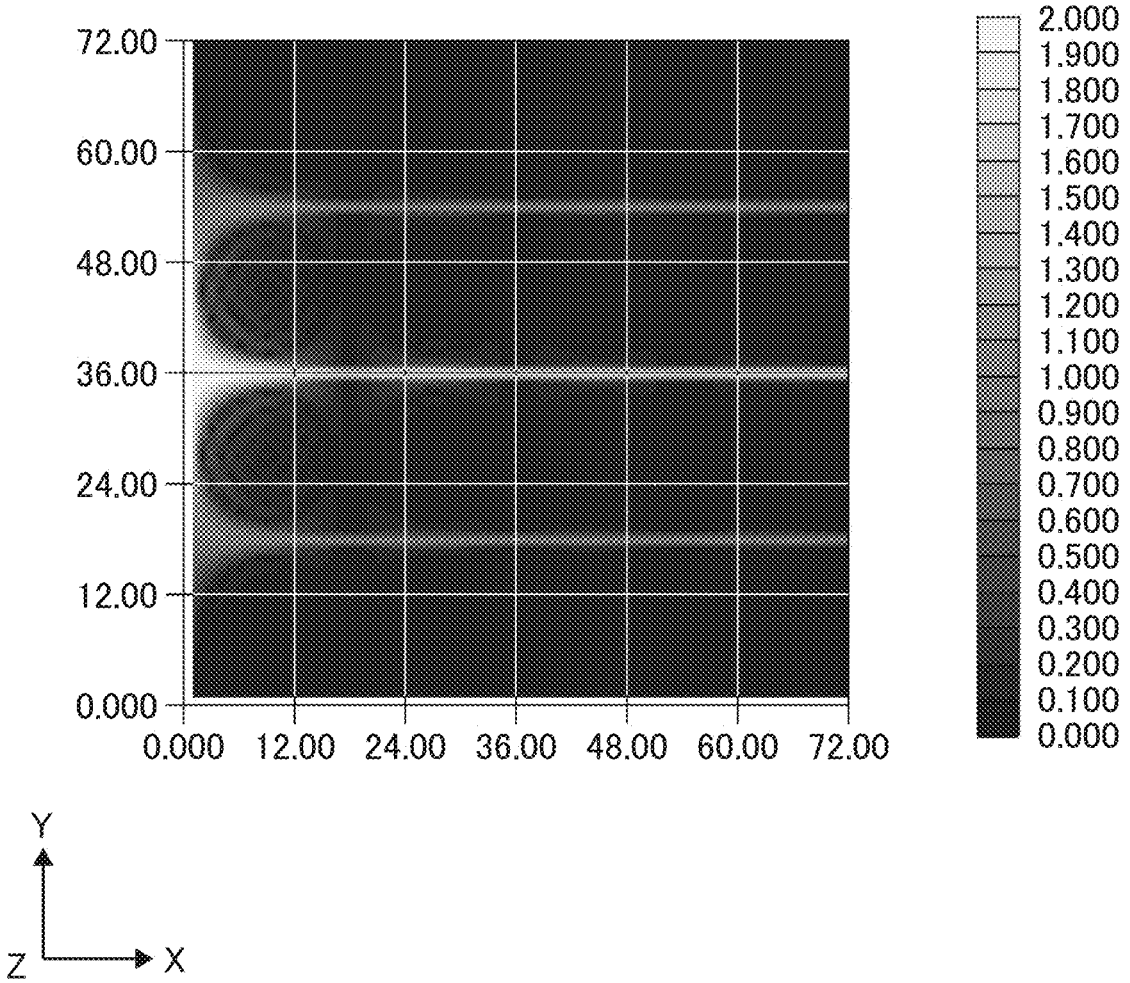
FIG. 19 is a graph illustrating the relationship between a scale factor τ and an influence of a shift of a periodic formation position in a case where the scale factor τ is 4.
Figure 20:
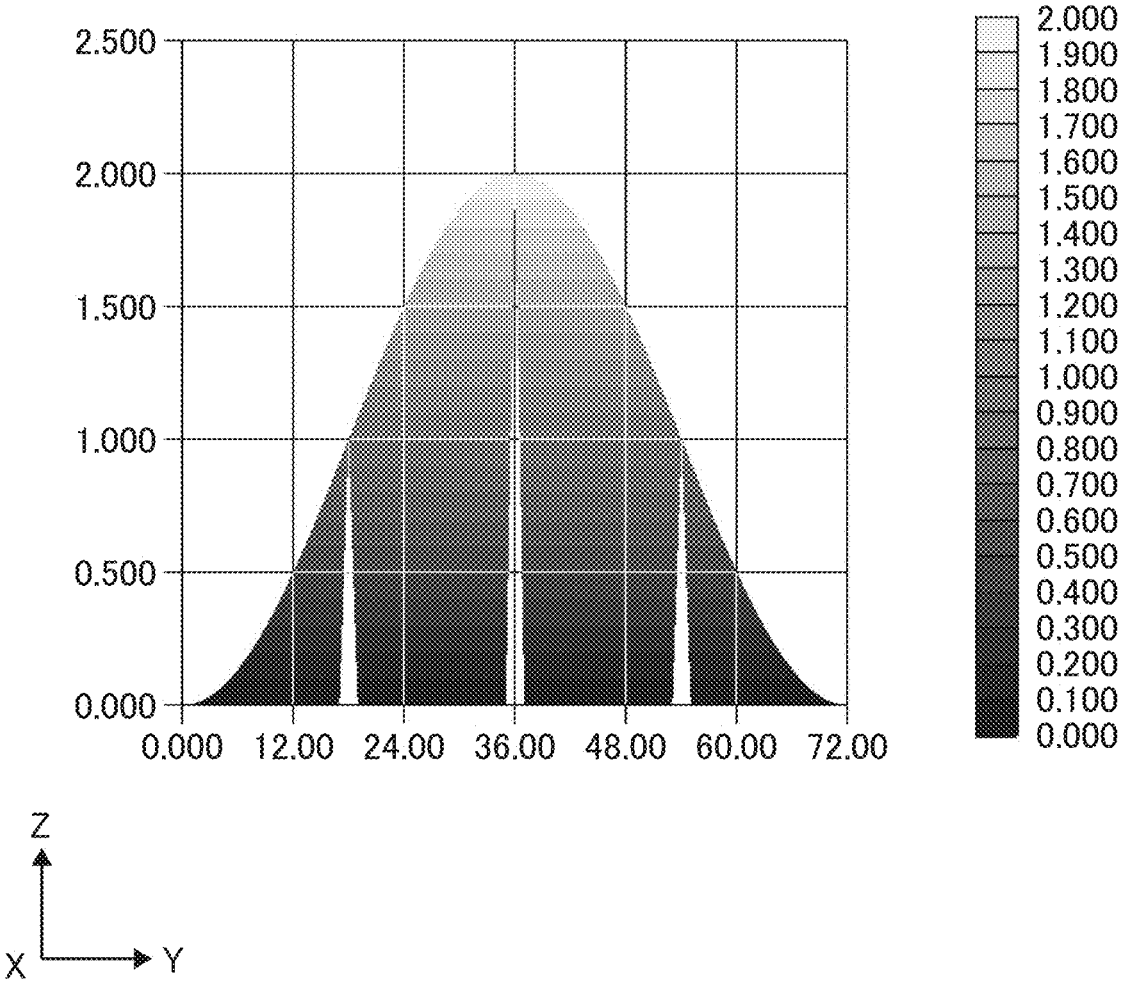
FIG. 20 is a graph illustrating the relationship between a scale factor τ and an influence of a shift of a periodic formation position in a case where the scale factor τ is 4.

FIGS. 18 to 20 are graphs in the case where the scale factor τ is "4". As is clear from FIGS. 18 to 20, the influence of the shift of the periodic formation position where the orders m are "18", "36", and "54" cannot be suppressed in the case where the scale factor τ is "4".

Figure 21:
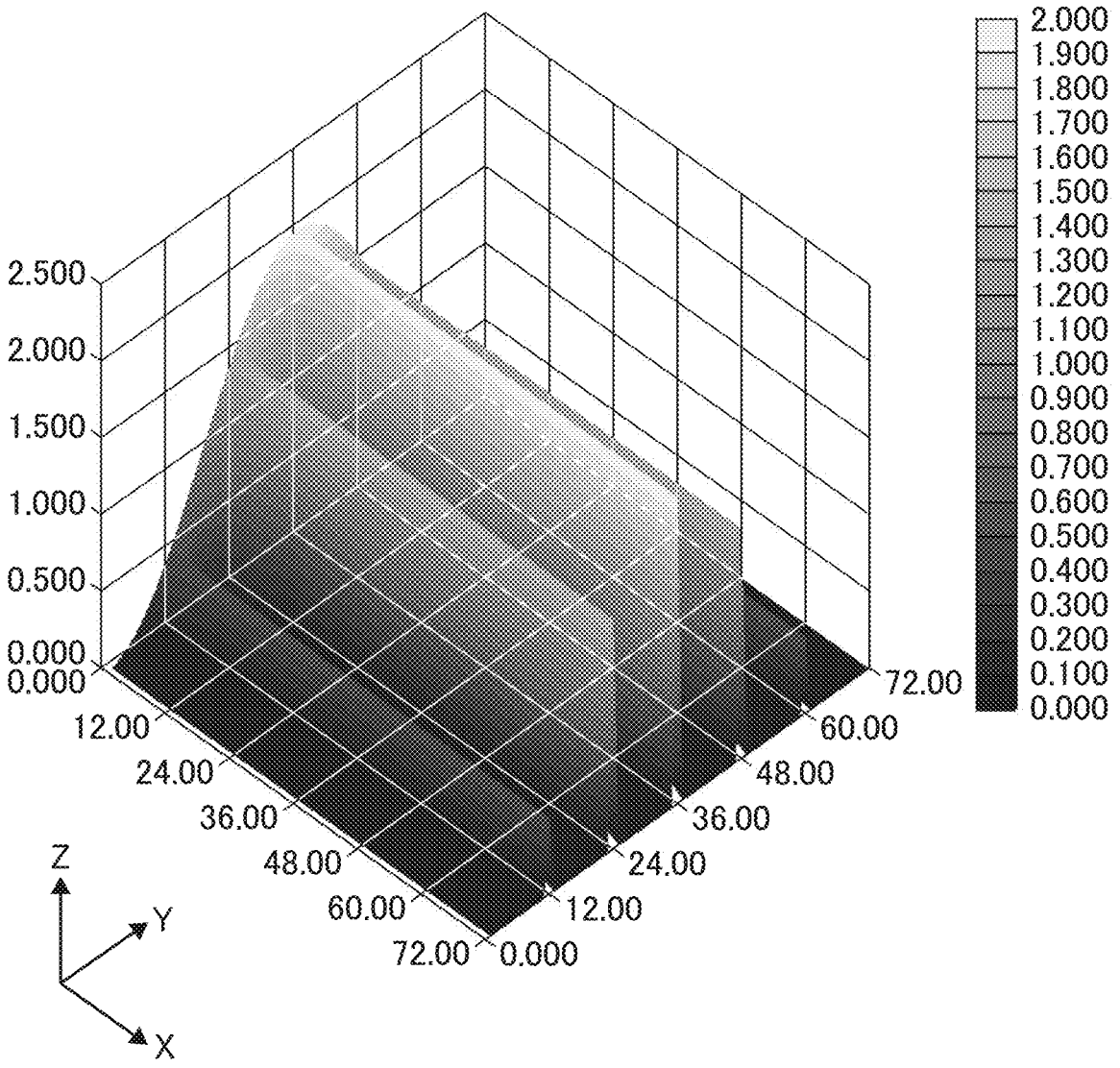
FIG. 21 is a graph illustrating a relationship between a scale factor τ and an influence of a shift of a periodic formation position in a case where the scale factor τ is 6.
Figure 22:
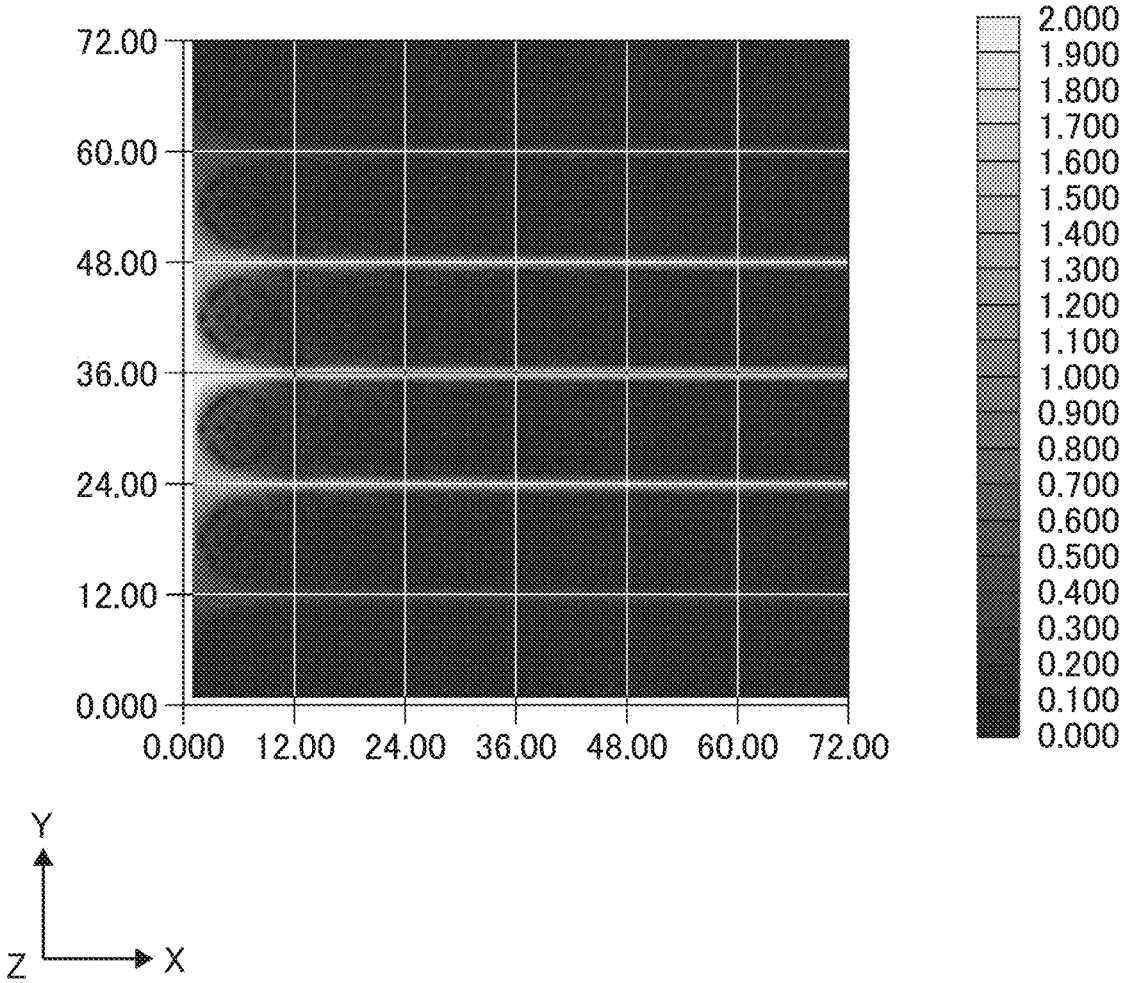
FIG. 22 is a graph illustrating the relationship between a scale factor τ and an influence of a shift of a periodic formation position in a case where the scale factor τ is 6.
Figure 23:
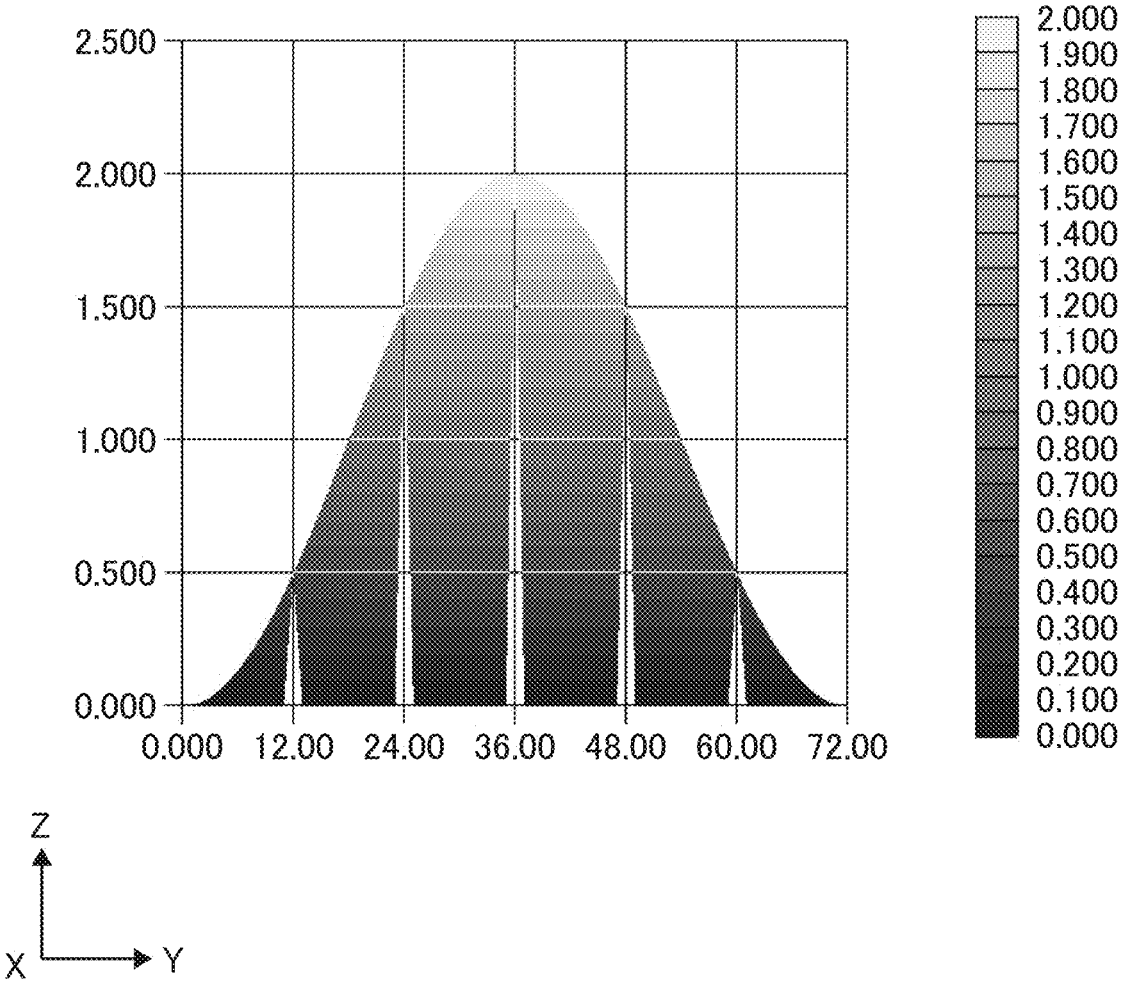
FIG. 23 is a graph illustrating the relationship between a scale factor τ and an influence of a shift of a periodic formation position in a case where the scale factor τ is 6.

FIGS. 21 to 23 are graphs in the case where the scale factor τ is "6". As is clear from FIGS. 21 to 23, the influence of the shift of the periodic formation position where the orders m are "12", "24", "36", "48", and "60" cannot be suppressed in the case where the scale factor τ is "6".

Figure 24:
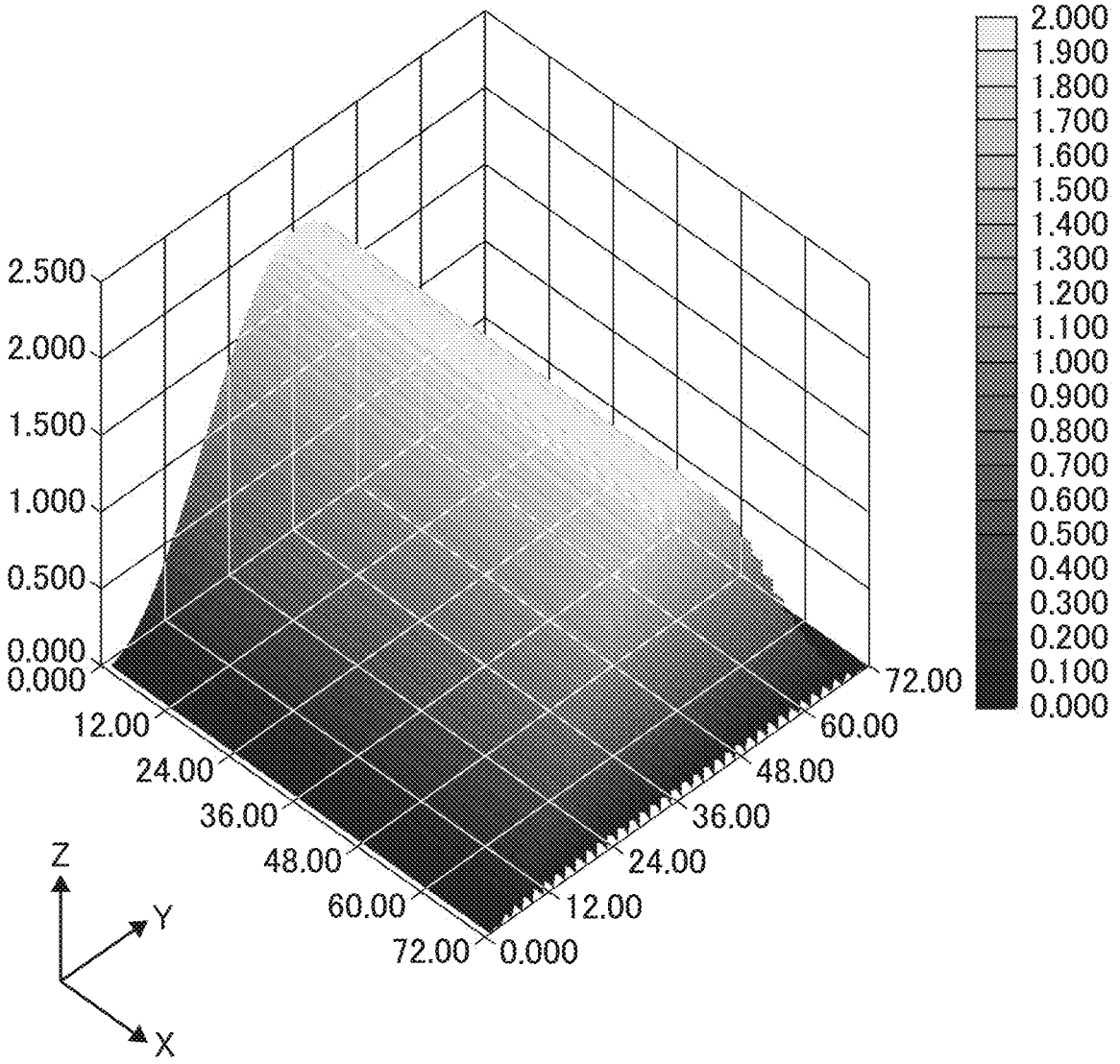
FIG. 24 is a graph illustrating a relationship between a scale factor τ and an influence of a shift of a periodic formation position in a case where the scale factor τ is 36.
Figure 25:
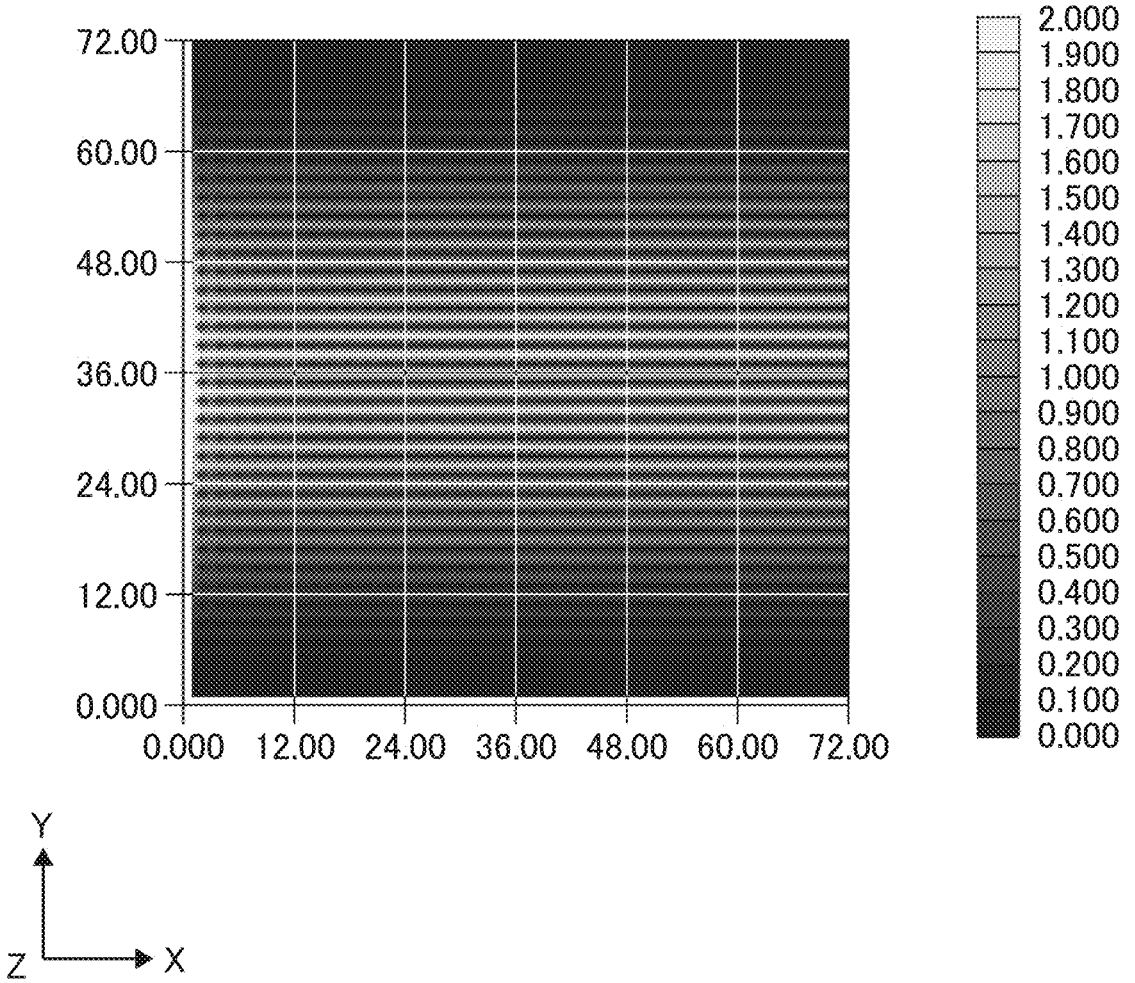
FIG. 25 is a graph illustrating the relationship between a scale factor τ and an influence of a shift of a periodic formation position in a case where the scale factor τ is 36.
Figure 26:
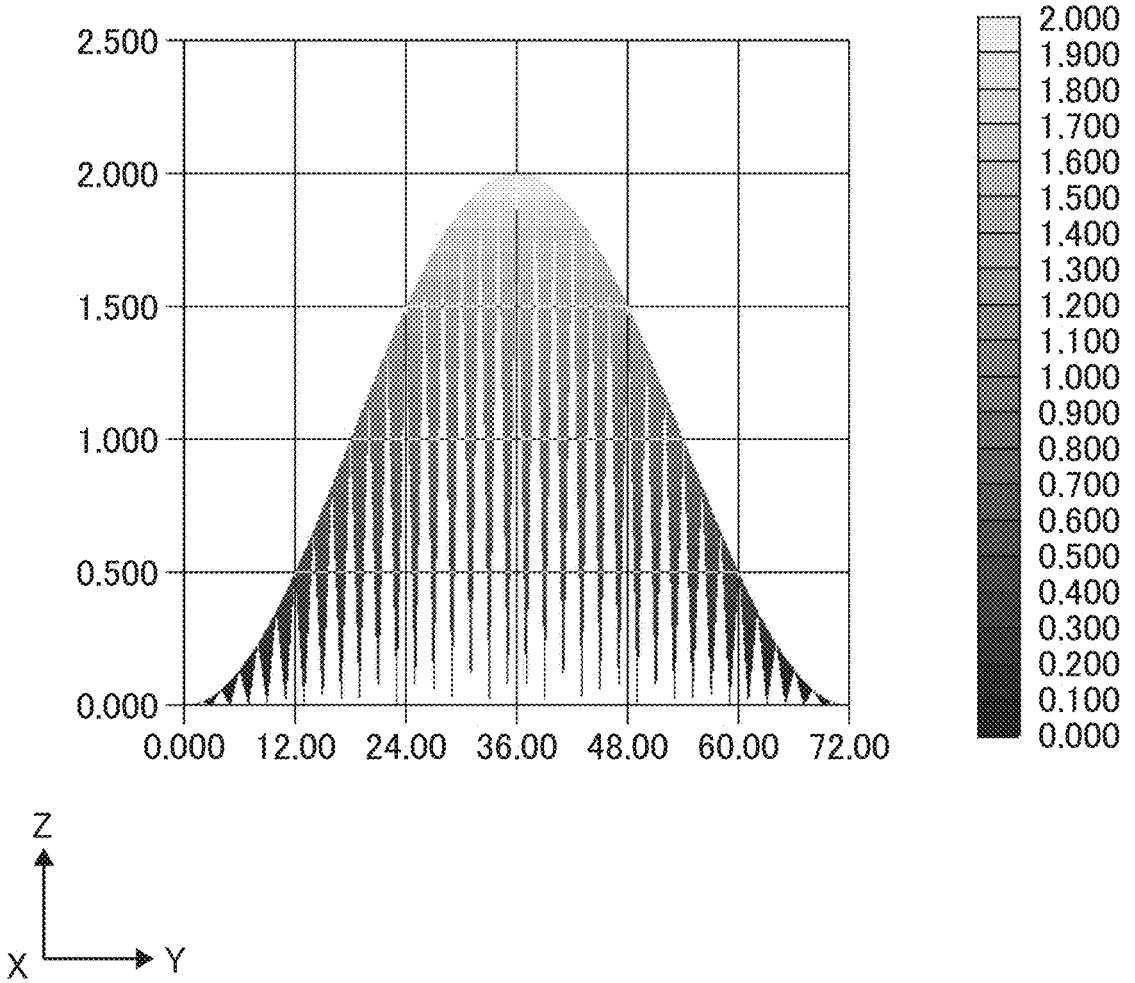
FIG. 26 is a graph illustrating the relationship between a scale factor τ and an influence of a shift of a periodic formation position in a case where the scale factor τ is 36.

FIGS. 24 to 26 are graphs in the case where the scale factor τ is "36". As is clear from FIGS. 24 to 26, the influence of the shift of the periodic formation position where the order m is an even number cannot be suppressed in the case where the scale factor τ is "36". Since the number of divisions is "72", two Z patterns (or three-line patterns) are repeatedly formed per round of the endless component (rotational body) in the case where the scale factor τ is "36".

As illustrated in FIGS. 15 to 26, when the interval for repeatedly forming the same line pattern changes, the effect of suppressing the influence of the shift of the periodic formation position changes. However, even when the Z pattern or the three-line pattern is formed as in the conventional pattern, there is a possibility that the effect of suppressing the influence of the shift of the periodic formation position cannot be properly exerted. In other words, even if the Z pattern or the three-line pattern is used, the method for forming the conventional pattern may not properly exert the effect of suppressing the influence of the periodic speed variation due to the endless component (endless rotational body). From the above possibility, defining the interval for repeatedly forming the same line pattern is important to suppress the influence of the shift of the periodic formation position occurring at each line pattern at the time of calculating the positional shift correction value.

In this regard, by defining the interval of patterns of when repeatedly forming the same line pattern, in the Z pattern and the three-line pattern of the mark 500 according to the present embodiment, the influence of the periodic speed variation due to the endless rotational body, which occurs when calculating the positional shift correction value based on the definition, can be effectively suppressed.

Scale Factor τ and Influence of Shift of Periodic Formation Position that Cannot be Suppressed The scale factor τ of the interval for repeatedly forming the same line pattern and the influence of the shift of the periodic formation position that is caused in each pattern and cannot be suppressed at the time of calculating the positional shift correction value will be described with reference to the graph in FIG. 27. In the graph in FIG. 27, the horizontal axis represents the scale factor τ, and the vertical axis represents a sum of the scale factors of the shift of the periodic formation position that cannot be suppressed.

Hereinafter, a method for calculating numerical values that are the source of the graph in FIG. 27 will be specifically described. Here, the "shift of the periodic formation position that cannot be suppressed" refers to the shift remaining regardless of a set of line patterns, of the shifts of the periodic formation positions occurring in the line patterns constituting the mark 500 according to the present embodiment at the time of calculating the positional shift correction value. That is, the "shift of the periodic formation position that cannot be suppressed" means a set of line patterns that satisfies G(k, m)=G(1, m). The influence on the shift of the formation position is expressed by the following expressions (25) and (26). Note that the expression (25) is based on the conventional pattern, and the expression (26) is based on the patterns (Z pattern and three-line pattern) constituting the mark 500 according to the present embodiment.

Expression 25

$$G(1, m) = 2\sin\left(\frac{\pi m}{n}\right)\sqrt{\frac{1 + 2\sum_{i=1}^{0}\left\{(1-i)\cos\left(\frac{2\pi m\tau i}{n}\right)\right\}}{1^2}} = 2\sin\left(\frac{\pi m}{n}\right) \tag{25}$$

Expression 26

$$G(1, m) = 2\sin^2\left(\frac{\pi m}{n}\right)\sqrt{\frac{1 + 2\sum_{i=1}^{0}\left\{(1-i)\cos\left(\frac{2\pi m\tau i}{n}\right)\right\}}{1^2}} = 2\sin^2\left(\frac{\pi m}{n}\right) \tag{26}$$

The influence of the "shift of the periodic formation position that cannot be suppressed" expressed by expressions (25) and (26) is due to the order (m) in which the equation illustrated in the following expression (27) is established.

Expression 27

$$m = \frac{n}{\tau} \times \alpha \tag{27}$$

where (α∈Z: Z is a set of integers).

Here, the expression expressing the influence of the shift of the periodic formation position, that is, the expressions (25) and (26) are based on the sine function. Therefore, when the right side of the expression (27) reaches a value exceeding the number of divisions n, waveforms depicting the same shape appear while repeating inversion/non-inversion. There is no point in extending a calculation section of the order m to infinity for the purpose of grasping tendency of the influence of the shift of the periodic formation position. Therefore, the calculation section is set to a range of a specific order m (for example, m=1 to n), and the sum of the influence of the shift of the periodic formation position that cannot be suppressed in the section is calculated. At this time, the following expression (28) is established.

Expression 28

$$0 < \frac{\alpha}{\tau} \leq 1 \tag{28}$$

where (α∈Z: Z is a set of integers).

Since the scale factor τ of the interval for repeatedly forming the same pattern is a positive real number, the calculation section is the range expressed by the following expression 29.

Expression 29

$$0<\alpha\leq\tau \tag{29}$$

where (α∈Z: Z is a set of integers).

The sum of the influence of the shift of the periodic formation position in the section is calculated by the following expressions (30) and (31) on the basis of the above expressions. Note that the expression (30) is based on the conventional pattern, and the expression (31) is based on the Z pattern and the three-line pattern constituting the mark 500 according to the present embodiment.

Expression 30

$$\sum_{\alpha=1}^{\tau} G(1, m) = \sum_{\alpha=1}^{\tau} 2\sin\left(\frac{\pi m}{n}\right) = \sum_{\alpha=1}^{\tau} 2\sin\left(\frac{\pi}{n} \cdot \frac{n}{\tau} \times \alpha\right) = \sum_{\alpha=1}^{\tau} 2\sin\left(\frac{n}{\tau} \times \alpha\right) \tag{30}$$

Expression 31

$$\sum_{\alpha=1}^{\tau} G(1, m) = \sum_{\alpha=1}^{\tau} 2\sin^2\left(\frac{\pi m}{n}\right) = \sum_{\alpha=1}^{\tau} 2\sin^2\left(\frac{\pi}{n} \cdot \frac{n}{\tau} \times \alpha\right) = \sum_{\alpha=1}^{\tau} 2\sin^2\left(\frac{n}{\tau} \times \alpha\right) \tag{31}$$

Figure 27:
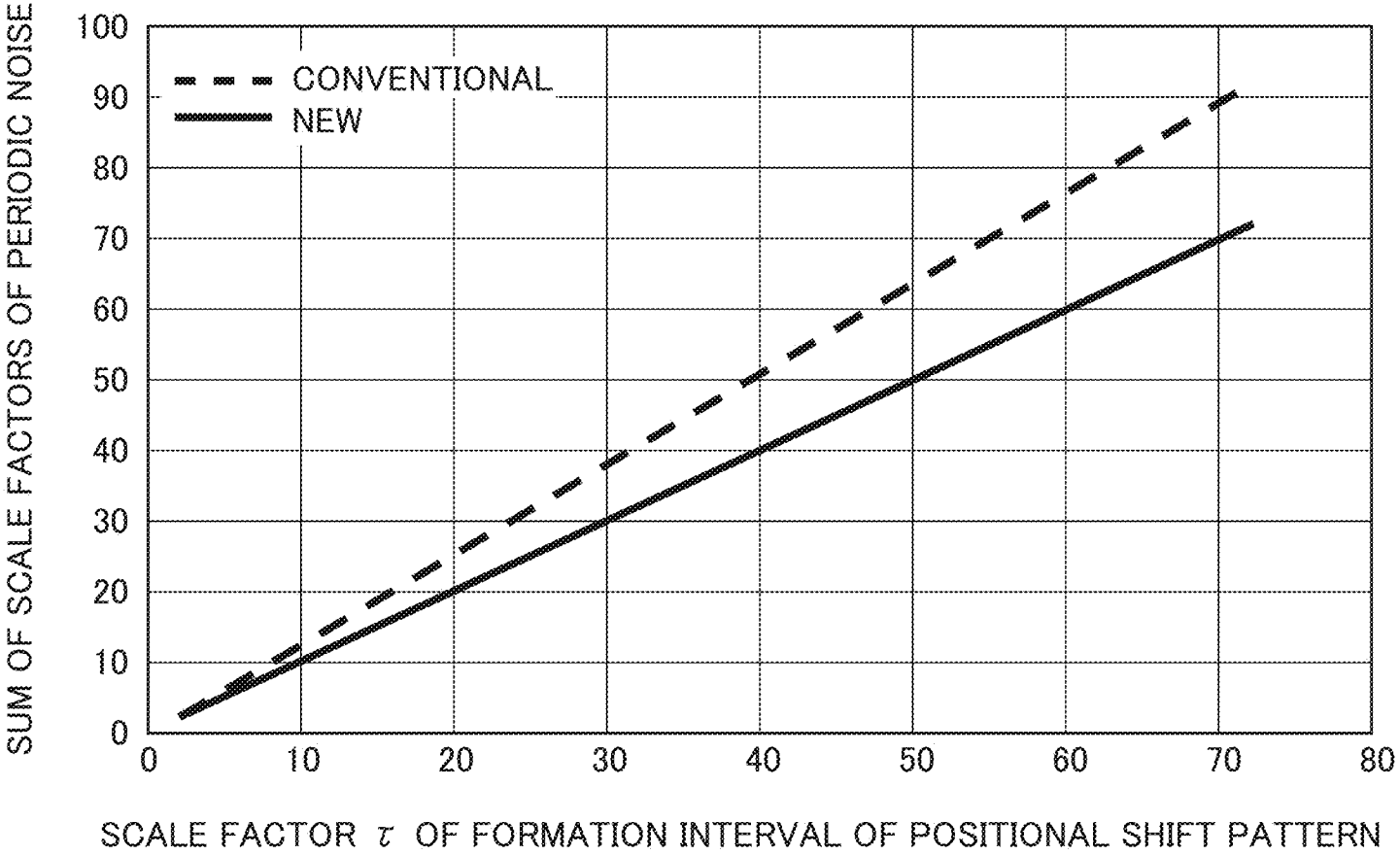
FIG. 27 is a graph illustrating the scale factor τ of an interval for repeatedly forming the same line pattern and an influence of a shift of a periodic formation position that is caused in each pattern and cannot be suppressed at the time of calculating a positional shift correction value.

Note that the graph illustrated in FIG. 27 is a simple sum, and is in practice integrated with the intensity component Cm of the shift of the periodic formation position in the order m. So-called white noise, such as jitter or suddenly occurring variation of the rotational speed, is illustrated in the graph in FIG. 27. Therefore, FIG. 27 does not illustrate the influence of the shift of the periodic formation position as it is. However, it cannot be said that the graph in FIG. 27 is a completely meaningless calculation result. In simple terms, FIG. 27 illustrates that the influence of the shift of the periodic formation position that cannot be suppressed becomes large overall as the scale factor τ becomes large. Therefore, the influence of the shift of the periodic formation position that cannot be suppressed can be decreased by making the scale factor τ smaller. That is, by minimizing the scale factor τ, the influence of the shift of the periodic formation position that cannot be suppressed can be minimized, and the alignment accuracy can be improved.

First Formation Example of Mark 500

Next, a formation example of the mark 500 according to the present embodiment will be described. In the following description, the reference line pattern 511 is illustrated by a black cross line pattern. Further, the correction target first pattern 512 and the correction target second pattern 513 are illustrated by oblique line patterns and cross line patterns in cyan, magenta, and yellow.

Figure 28:
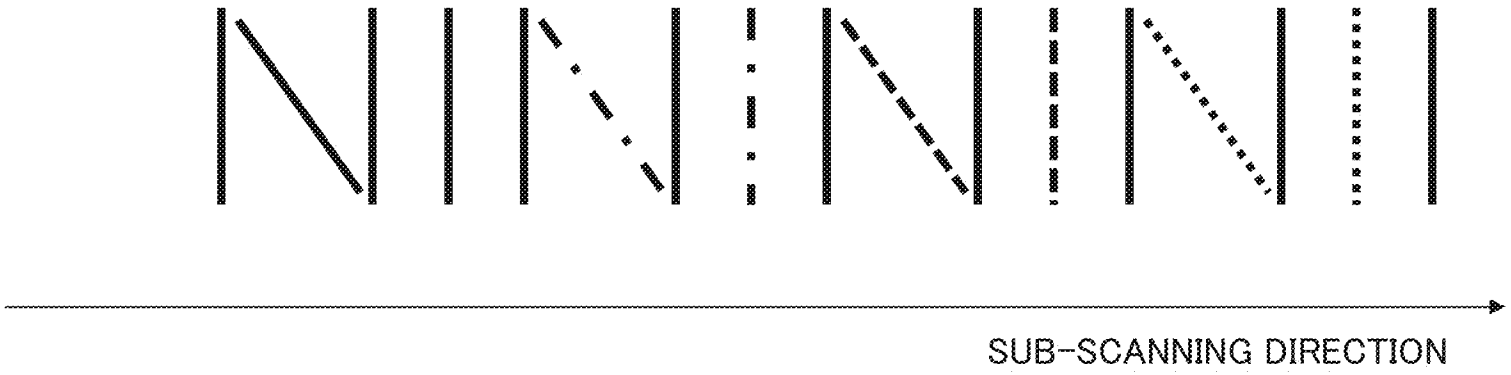
FIG. 28 is a diagram illustrating a formation pattern of a positional shift correction pattern according to the present embodiment in a case where the number of sets k is 1.

FIG. 28 illustrates a formation pattern of the mark 500 in a case where the number of sets k is 1. In FIG. 28, the yellow correction target second pattern 513 (cross line pattern) is formed following the reference line pattern 511. The reference line pattern 511 is formed following the correction target second pattern 513, and the yellow correction target first pattern 512 (oblique line pattern) is formed following the reference line patterns 511. Furthermore, the reference line patterns 511 is formed following the correction target first pattern 512, and next, the magenta correction target second pattern 513 (cross line pattern), the reference line patterns 511, the magenta correction target first pattern 512, and the reference line patterns 511 are repeatedly formed. The correction target second pattern 513 and the correction target first pattern 512 are formed such that the cross line pattern and the oblique line pattern in the same color form a set as the correction target patterns.

Although the black three-line pattern is also formed in FIG. 28, this pattern may not be formed if unnecessary. Further, the order of the colors of the correction target first pattern 512 and the correction target second pattern 513 is not limited to that illustrated in FIG. 28. Further, it is unnecessary to form all the correction target patterns 502 at one time. For example, the yellow cross line pattern may be selected as the correction target pattern 502 in the first alignment, and the yellow oblique line pattern may be selected as the correction target pattern 502 in the second alignment. However, at this time, division of the correction target patterns 502 in the same color and shape cannot be performed because the number of sets K of line patterns changes.

Figure 29:
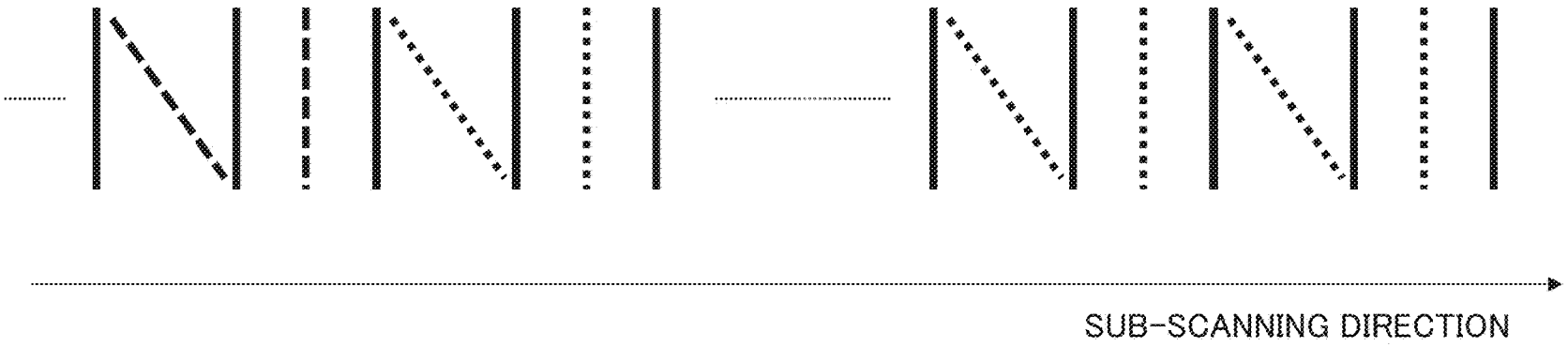
FIG. 29 is a diagram illustrating a case where the scale factor τ is 4 in the positional shift correction pattern where the number of sets k is 1.
Figure 30:
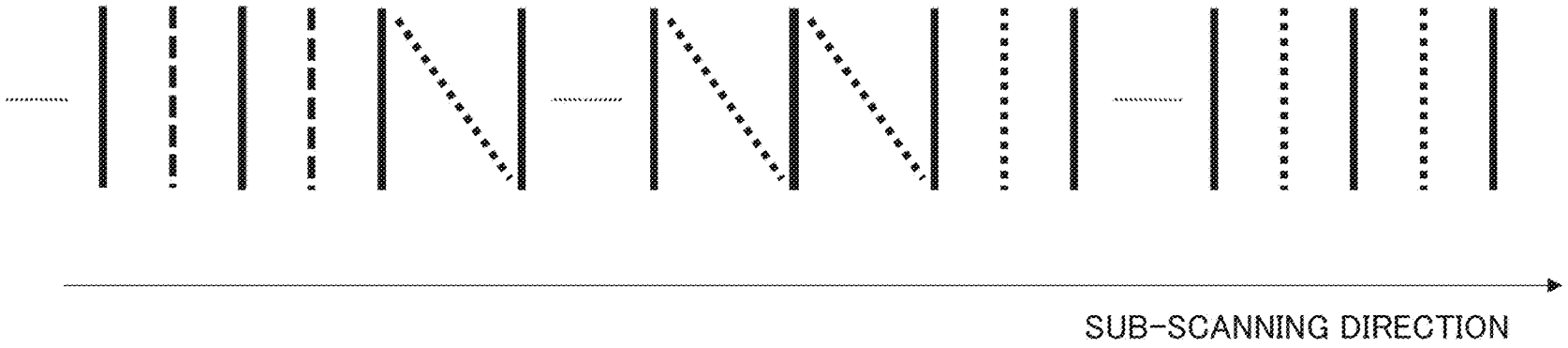
FIG. 30 is a diagram illustrating a case where the scale factor τ is 2 in the positional shift correction pattern where the number of sets k is 1.
Figure 31:
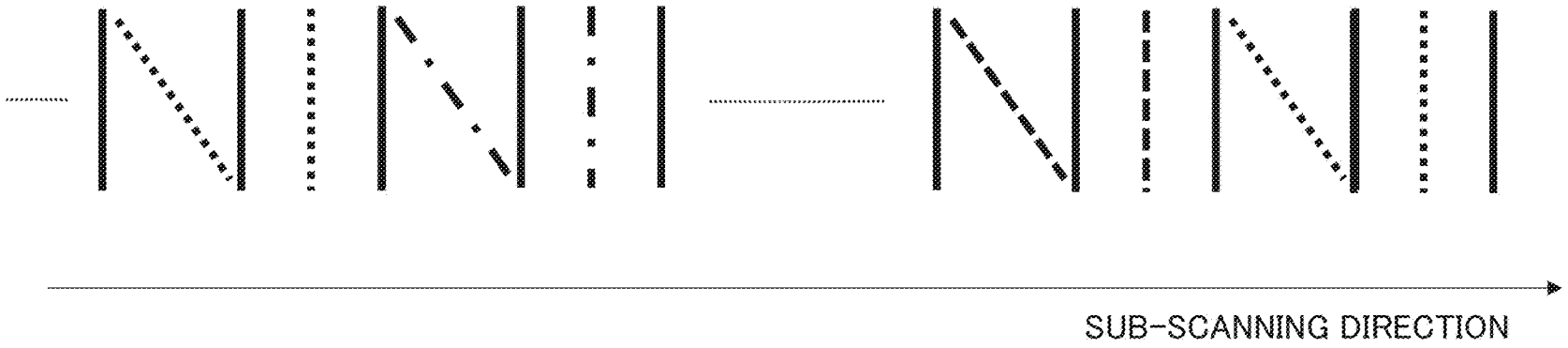
FIG. 31 is a diagram illustrating a case where the scale factor τ is 12 in the positional shift correction pattern where the number of sets k is 1.
Figure 32:
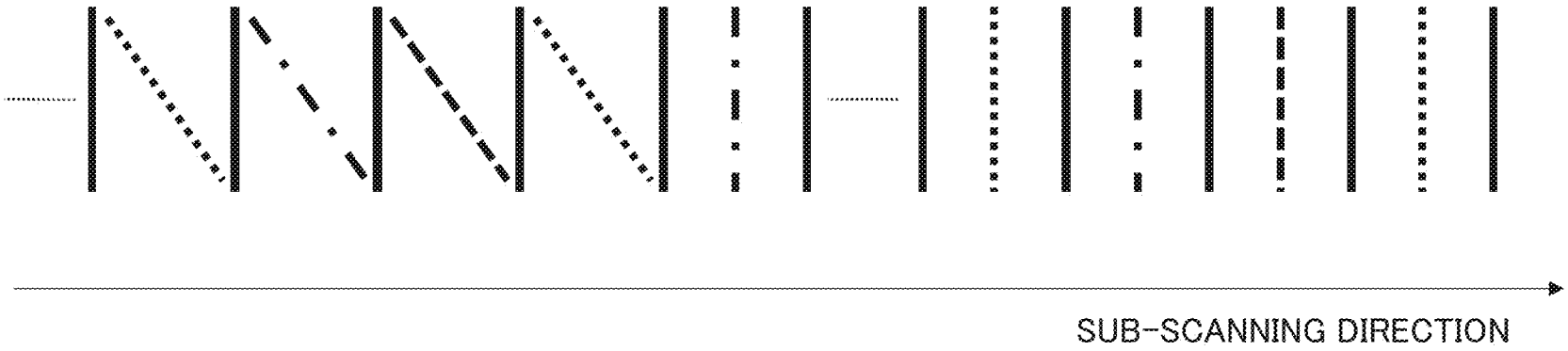
FIG. 32 is a diagram illustrating a case where the scale factor τ is 6 in the positional shift correction pattern where the number of sets k is 1.

Next, a relationship between the method for forming line patterns constituting the mark 500 illustrated in FIG. 28 and the scale factor τ will be described with reference to FIGS. 29 to 32. FIG. 29 illustrates an example in which the scale factor τ is 4. FIG. 30 illustrates an example in which the scale factor τ is 2. FIG. 31 illustrates an example in which the scale factor τ is 12. FIG. 32 illustrates an example in which the scale factor τ is 6.

As already described, the scale factor τ is determined according to the interval of line patterns used when calculating the same positional shift correction value. That is, the scale factor τ is determined according to the interval between the same correction target patterns 502. The case where the scale factor τ is 4 corresponds to an interval of four pieces of 2π/n. Further, the case where the scale factor τ is 2 corresponds to an interval of two pieces of 2π/n. The case where the scale factor τ is 12 corresponds to an interval of twelve pieces of 2π/n. The case where the scale factor τ is 6 corresponds to an interval of six pieces of 2τ/n.

The example in which the scale factor τ is "2" illustrated in FIG. 30 is the most suitable in light of the above description. That is, when the line patterns of the mark 500 are repeatedly formed such that the colors and the shapes of the correction target patterns 502 constituting adjacent sets become the same, the influence of the shift of the periodic formation position occurring in each line pattern at the time of calculating the positional shift correction value can be most effectively suppressed.

In other words, to most effectively suppress the influence of the periodic speed variation due to the rotational body as the endless component, the mark 500 is formed setting the scale factor τ to "2". Then, by making the reference line patterns 511 in all the sets have the same color, the phase component of the shift of the formation positions of the line patterns can be shared, and thus the alignment accuracy can be further improved. Further, all the reference line patterns 511 can be formed at constant intervals, and thus the length of a region where the line patterns are formed can be made short. Therefore, an execution time for alignment and color matching can be shortened.

Second Formation Example for Mark

Next, another formation example of the mark 500 according to the present embodiment will be described. In the following description, the reference line pattern 511 is illustrated by a black cross line pattern. Note that the reference line pattern 511 may be formed with a cross line pattern in color other than black. Further, the correction target first pattern 512 (oblique line pattern) and the correction target second pattern 513 (cross line pattern), which are the correction target patterns, are illustrated by the cross line pattern or the oblique line pattern in cyan, magenta, and yellow.

Figure 33:
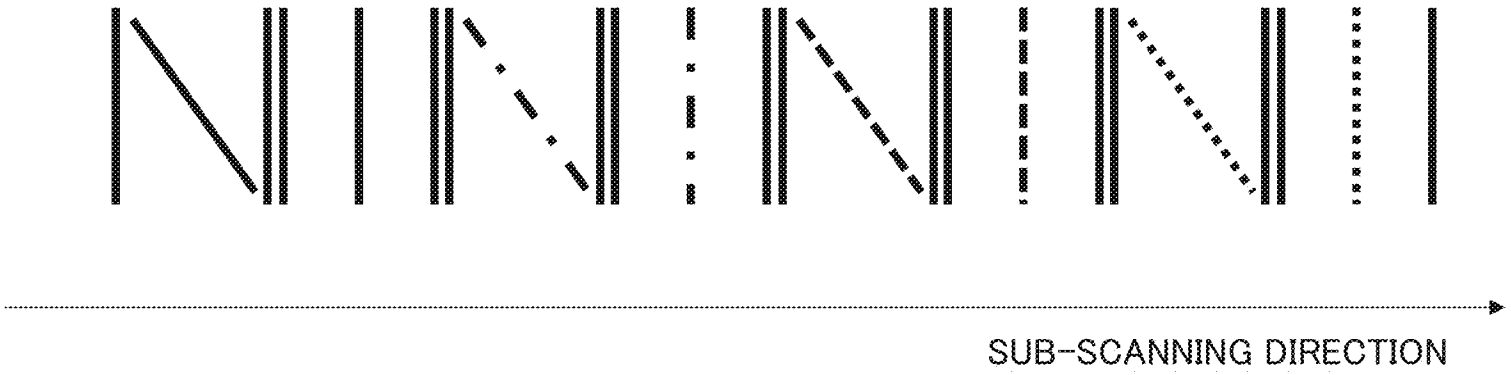
FIG. 33 is a diagram illustrating a formation pattern of a positional shift correction pattern according to the present embodiment in a case where the number of sets k is 1.

The mark 500 illustrated in FIG. 33 has a slightly larger scale factor τ than the mark 500 illustrated in FIG. 28. As illustrated in FIG. 33, the yellow correction target pattern 502 (cross line pattern) is formed following the reference line pattern 511 in the mark 500 in the case where the number of sets k is 1. The reference line patterns 511 is formed following the correction target pattern 502, and the reference line pattern 511 is formed with a space following the reference line patterns 511. Next to the reference line pattern 511, the yellow correction target pattern 502 (oblique line pattern) is formed. Further, next to the correction target pattern 502, the reference line patterns 511 is formed, then after the next reference line patterns 511 is formed with a space, the magenta correction target pattern 502 (cross line pattern) is formed. Thereafter, the reference line pattern 511, the correction target pattern 502, the reference line pattern 511, the reference line pattern 511, the correction target pattern 502, the reference line pattern 511, and the like are repeatedly formed. The correction target pattern 502 is formed such that the cross line pattern and the oblique line pattern in the same color form a set.

Although the black three-line pattern is also formed in FIG. 33, this pattern may not be formed if unnecessary. Although the reference line patterns 511 constituting the Z pattern and the reference line patterns 511 constituting the three-line pattern are separately formed, these reference line patterns 511 may be shared (in this case, the formed pattern becomes the same as illustrated in FIG. 28).

Figure 34:
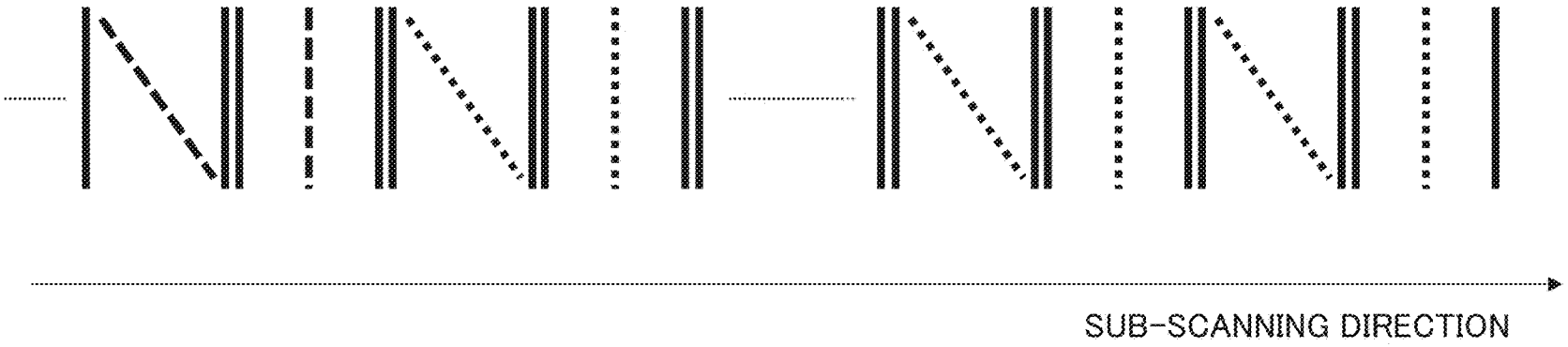
FIG. 34 is a diagram illustrating a case where the scale factor τ is larger than 4 in the positional shift correction pattern where the number of sets k is 1.
Figure 35:
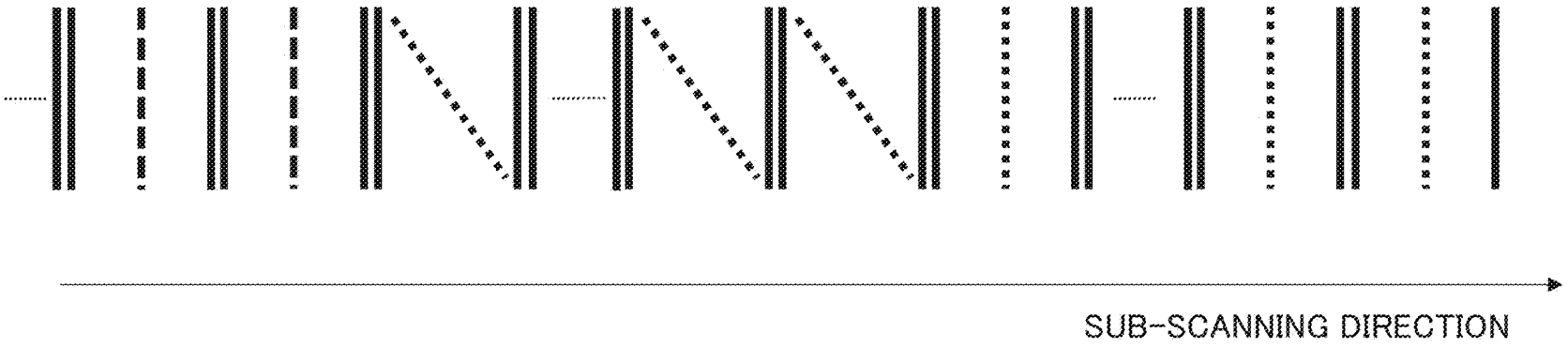
FIG. 35 is a diagram illustrating a case where the scale factor τ is larger than 2 in the positional shift correction pattern where the number of sets k is 1.
Figure 36:
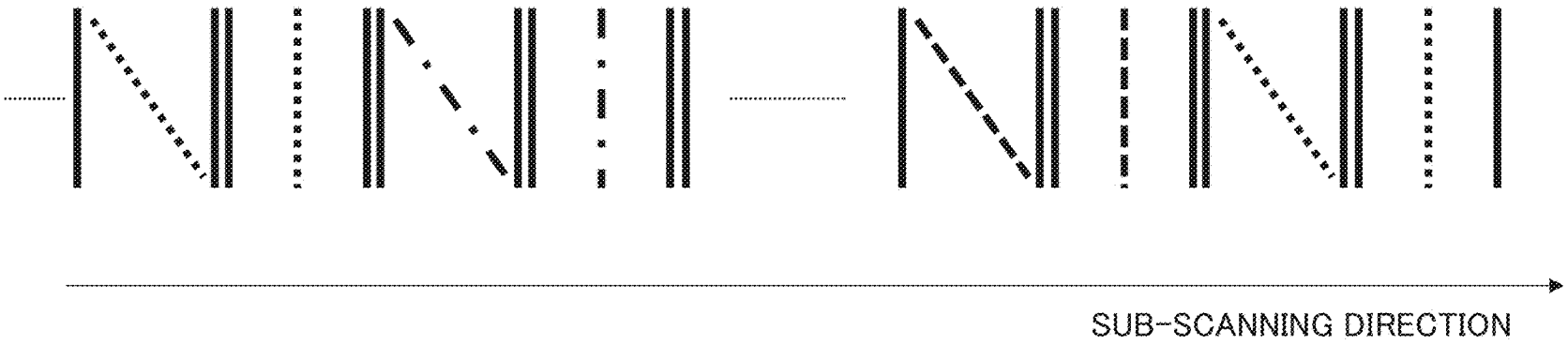
FIG. 36 is a diagram illustrating a case where the scale factor τ is larger than 12 in the positional shift correction pattern where the number of sets k is 1.
Figure 37:
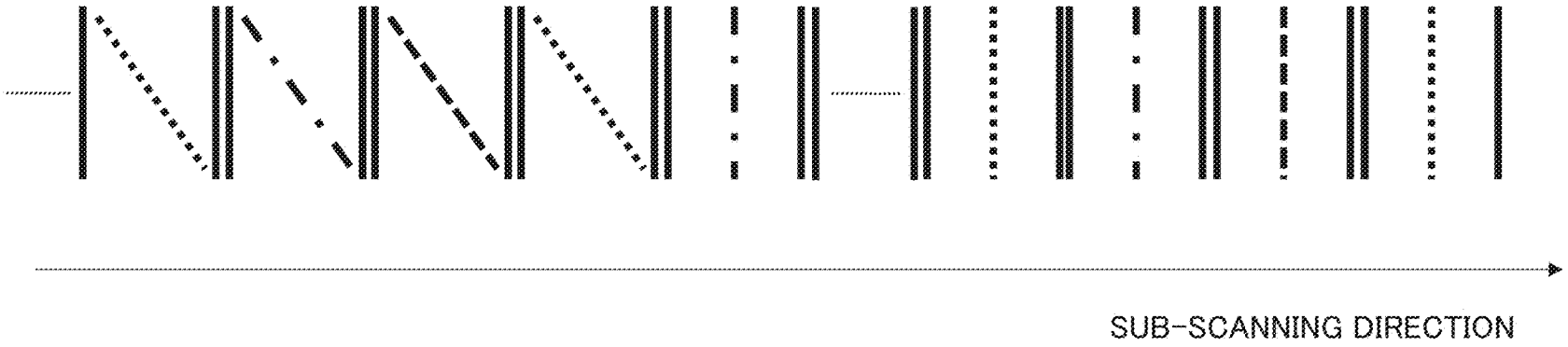
FIG. 37 is a diagram illustrating a case where the scale factor τ is larger than 6 in the positional shift correction pattern where the number of sets k is 1.

Next, a relationship between the method for forming line patterns constituting the mark 500 illustrated in FIG. 33 and the scale factor $\tau$ will be described. FIG. 34 illustrates an example in which the scale factor $\tau$ is larger than 4. FIG. 35 illustrates an example in which the scale factor $\tau$ is larger than 2. FIG. 36 illustrates an example in which the scale factor $\tau$ is larger than 12. FIG. 37 illustrates an example in which the scale factor $\tau$ is larger than 6.

The example in which the scale factor $\tau$ is larger than "2" illustrated in FIG. 35 is the most suitable in light of the above description. Of course, although the forming method illustrated in FIG. 26 is optimum, the forming method illustrated in FIG. 35 may be selected in a case where the pattern cannot be formed as in FIG. 26. Then, even in the case of the forming method illustrated in FIG. 35, the patterns are repeatedly formed such that the colors and the shapes of the correction target first patterns 512 and the correction target second patterns 513 of adjacent sets become the same.

Embodiment of Image Forming Method

Figure 38:
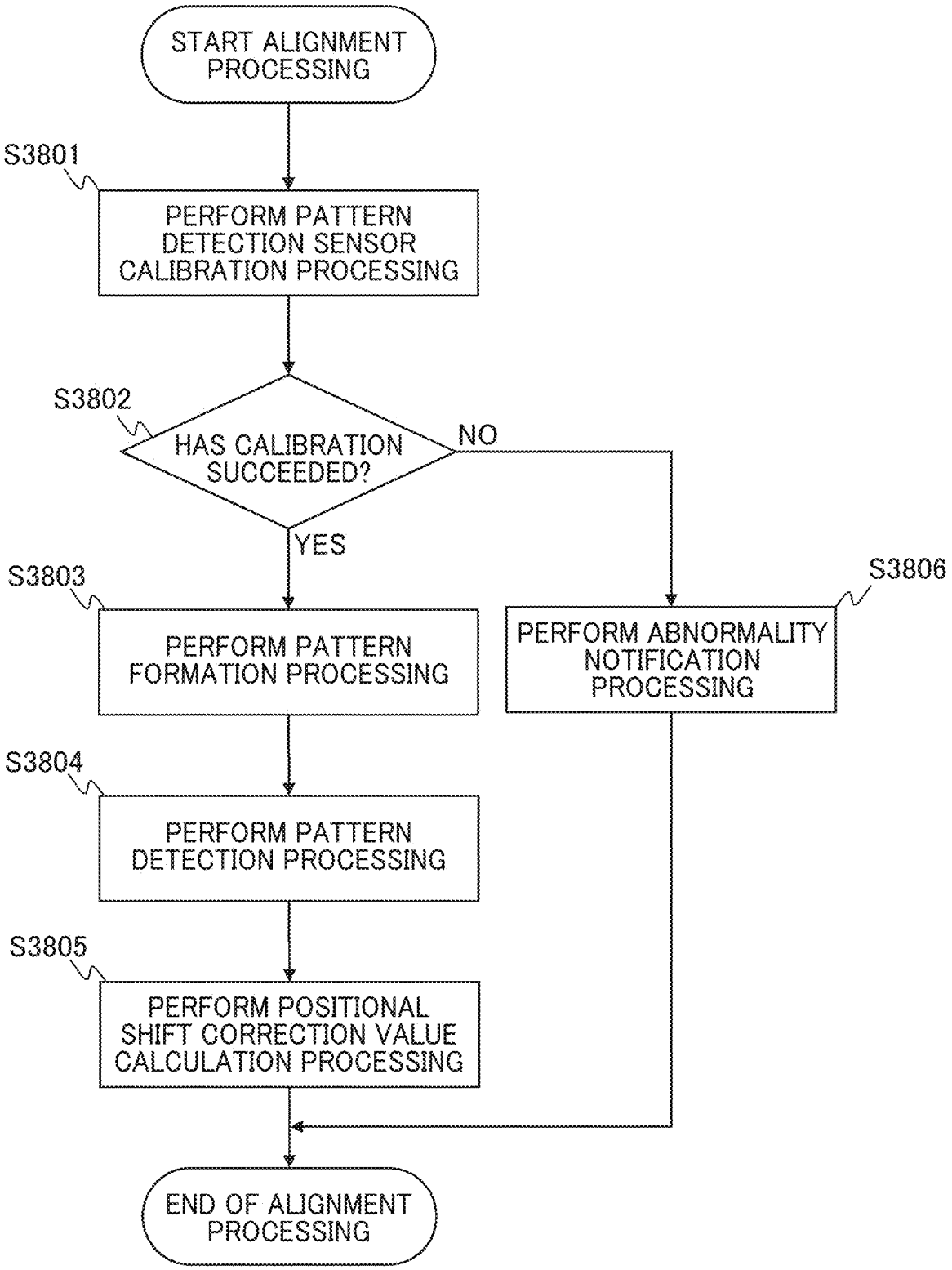
FIG. 38 is a flowchart illustrating an embodiment of an image forming method according to an embodiment of the present invention.

Next, a flow of alignment processing using the mark 500 according to the present embodiment will be described with reference to the flowchart in FIG. 38, as an image forming method according to an embodiment of the present invention. FIG. 38 illustrates a flow of processing for, in order to execute the positional shift correction, first forming a plurality of sets of correction patterns (marks 500) on the intermediate transfer belt 105, detecting the mark 500 by the pattern detection sensor 117, and controlling the formation position of the mark 500 according to the correction value calculated based on a detection result. Therefore, the process flow in FIG. 38 illustrates processing for forming the correction pattern (mark 500) to be formed at the time of executing single alignment processing (color matching operation).

First, processing for performing calibration so that the pattern detection sensor 117 can normally detect the line patterns constituting the mark 500 is executed (S3801). In a case where the pattern detection sensor 117 is an optical sensor, processing for adjusting an irradiation amount, a gain of a detection signal, and the like is executed.

Next, whether the calibration processing in S3801 has been normally executed is determined (S3802). When the calibration processing for the pattern detection sensor 117 has not been normally executed (S3802/NO), the processing is interrupted, and an abnormality is notified using an alarm notification unit included in the MFP 100 (S3806).

In a case where the calibration processing for the pattern detection sensor 117 has been normally executed (S3802/YES), processing for forming the mark 500 is executed (S3803). For the processing, a pattern generation function provided by special application specific integrated circuit (ASIC) for controlling the operation of the optical writing control device 111 is used or images for line patterns are prepared in advance. The line patterns formed here are the Z pattern and the three-line pattern constituting the mark 500.

Next, the pattern detection sensor 117 detects the mark 500 and notifies the calculation result to the correction value calculator 124 via the sensor controller 123 (S3804).

Next, the correction value calculator 124 calculates the positional shift correction amount based on the detection result from the pattern detection sensor 117, and causes the correction value storage 126 to store the calculated positional shift correction value (S3805). When executing the image formation processing, the MFP 100 including the optical writing control device 111 adjusts an image formation position using the positional shift correction value stored in the correction value storage 126.

The calibration processing (S3801) for the pattern detection sensor 117 may be periodically performed and may not be performed each time the alignment processing is performed. When the calibration processing (S3801) is not performed, the processing may be started from the pattern formation processing (S3803).

Another Embodiment of Present Invention

Figure 39A:
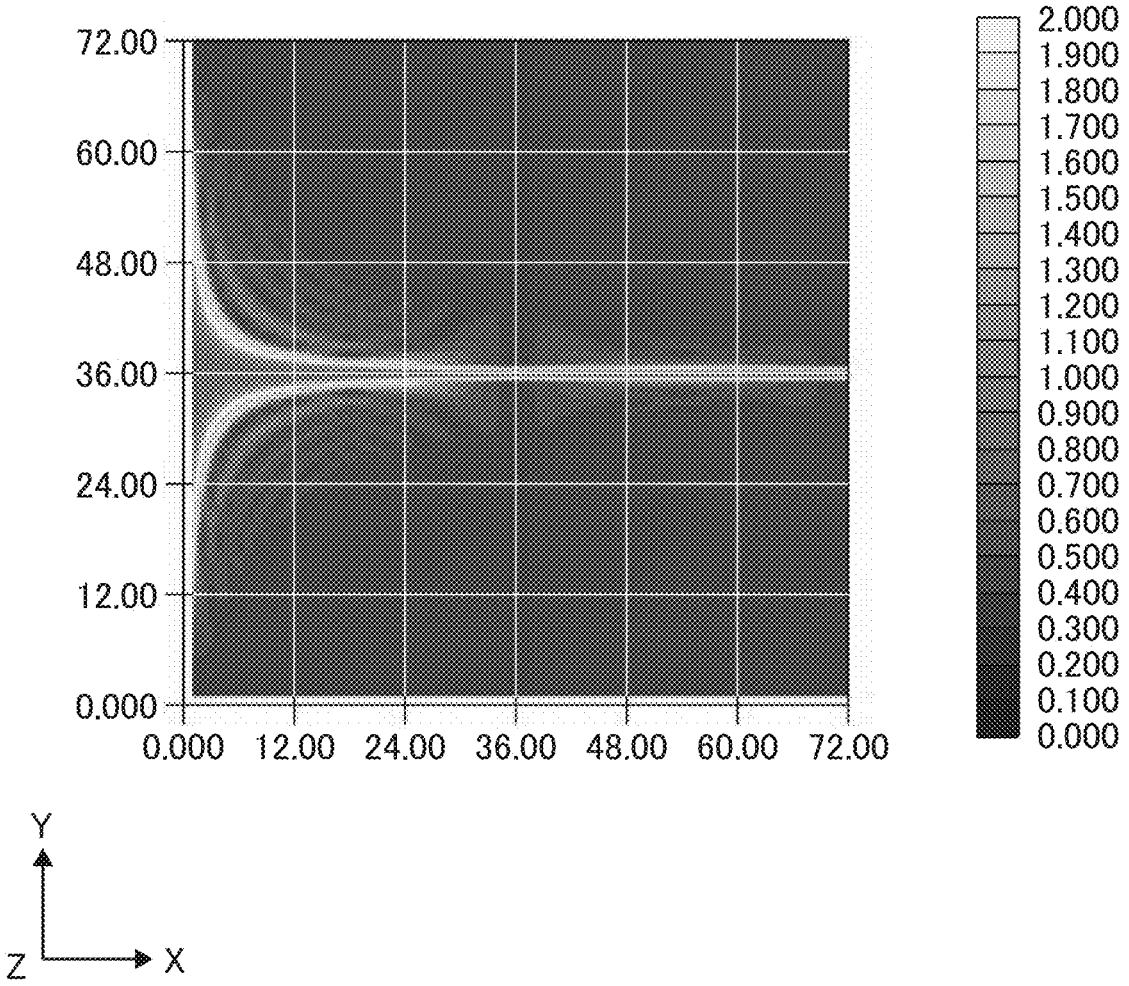
FIGS. 39A and 39B are graphs for describing another embodiment of the present invention.
Figure 39B:
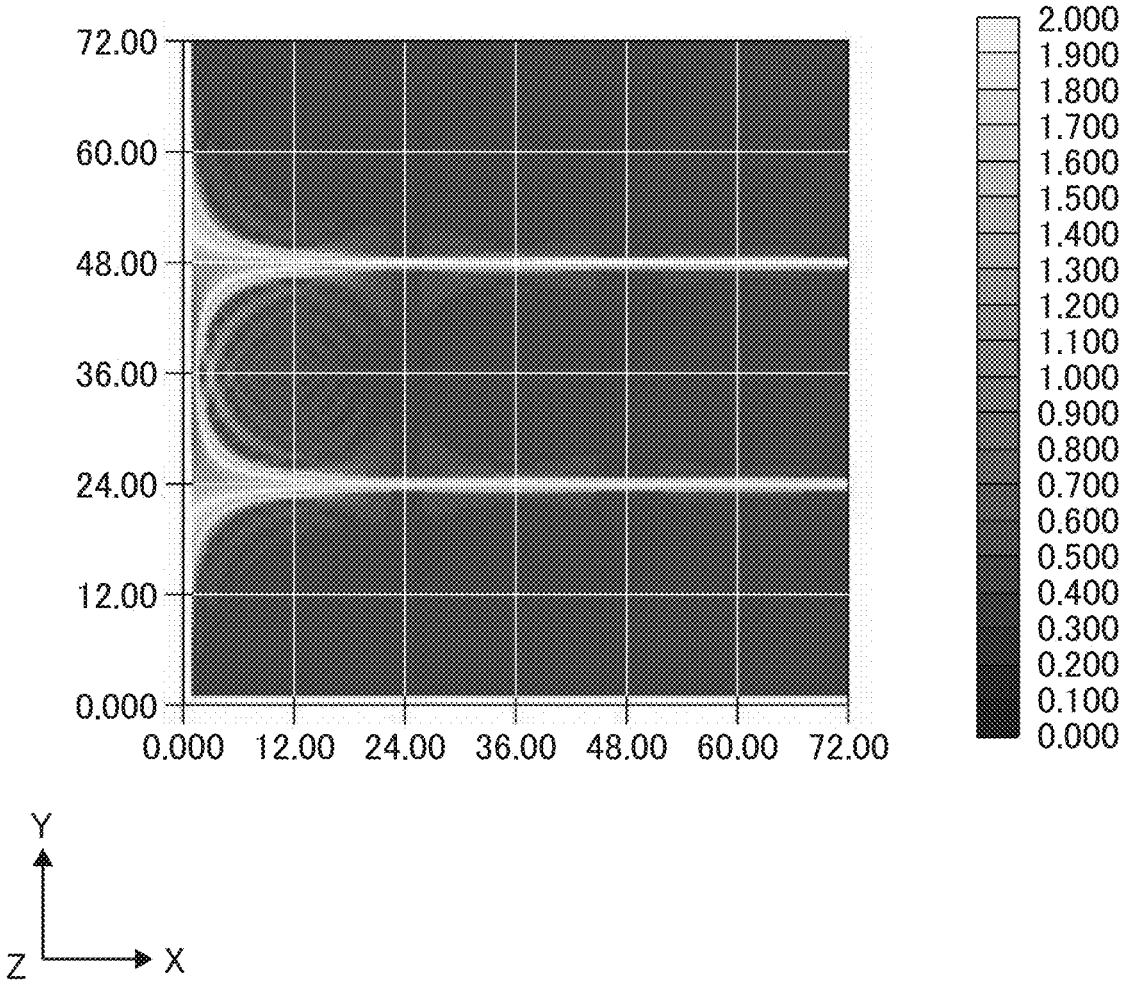

Next, another embodiment according to the present invention will be described with reference to FIGS. 39A and 39B. In the already described embodiment, in the graph in FIG. 27, the influence of the shift of the periodic formation position that cannot be suppressed, which occurs in each pattern at the time of calculating the positional shift correction value, is expressed by the next expression (32).

Expression 32

$$m = \frac{n}{\tau} \times \alpha \tag{32}$$

where ($\alpha \in Z$: Z is a set of integers).

Here, description will be given on the assumption that the number of divisions n is 72. According to expression (32), the order m of the shift of the periodic formation position that cannot be suppressed becomes different values when the scale factor $\tau$ is 2 and 3. That is, the order m is "36" when the scale factor $\tau$ is "2", and the order m is "24" or "48" when the scale factor $\tau$ is "3". Although the case where the order m is "72" is also included, but the description is omitted because the intensity component is 0.

In this case, for example, it is assumed that the order m in which the shift of the periodic formation position is likely to occur has been specified in advance in the configuration of the optical writing control device 111 and the configuration of the MFP 100. For example, the scale factor $\tau$ of "3" rather than "2" is favorable when the shift is more likely to occur in the order m of "36". Similarly, the scale factor $\tau$ of "3" rather than "2" is favorable when the shift is more likely to occur in the order m of "24". That is, the scale factor $\tau$ of the interval for repeatedly forming the same line pattern is determined such that the order m in which the shift of the periodic formation position is more likely to occur and the order m in which the shift of the periodic formation position that cannot be suppressed do not accord or do not substantially accord, whereby the influence of the shift of the periodic formation position that cannot be suppressed can be effectively suppressed at the time of calculating the positional shift correction value.

By the way, since the shift of the periodic formation position can be expressed by time integration of the shift of the periodic speed variation, the order m in which the shift of the periodic formation position is more likely to occur accords with the order m of the periodic speed variation due to an endless component (endless rotational body).

The periodic speed variation more likely to occur in the endless rotational body is caused by, for example, rotation unevenness due to eccentricity, and a variation component is mainly a variation component in a low order such as first order or second order. Therefore, the scale factor τ of the interval for repeatedly forming the same line pattern is determined such that the order m calculated based on the ratio of the peripheral length and the order m of the shift of the periodic formation position that cannot be suppressed, of the endless components (rotational bodies) that cause the periodic speed variation, do not accord or do not substantially accord, whereby the influence of the periodic speed variation can be effectively suppressed.

Specifically, it is assumed that the intermediate transfer belt 105 is the longest rotational body, and other rotational bodies that cause the periodic speed variation are the photoconductor drum 109 and the charging roller (charging roller 110), of the rotational bodies that cause the periodic rotational speed variation. It is assumed that the peripheral length of the photoconductor drum 109 is 95 mm, the peripheral length of the intermediate transfer belt 105 is 750 mm, and the peripheral length of the charging roller 110 is 30 mm. At this time, the order m of the periodic rotational speed variation caused by each photoconductor drum 109 is about 7.89 (m=750/95≈7.89). The order m of the periodic speed variation generated by the intermediate transfer belt 105 is 1 (m=750/750=1). In addition, the order m of the periodic speed variation generated by the charging roller 110 is about 25 (m=750/30≈25). These orders m accords with the order m of the shift of the periodic formation position occurring at the each pattern position at the time of calculating the positional shift correction value. Therefore, the value of the scale factor τ is determined such that all of the order m=1, 7.89, and 25 do not accord or do not substantially accord with the order m of the shift of the periodic formation position that cannot be suppressed.

First, the interval between the line patterns included in one Z pattern or the three-line pattern is determined. Either of the patterns is formed in the order of the reference line patterns 511, the correction target first pattern 512 or the correction target second pattern 513, and the reference line patterns 511. If the interval between the line patters becomes too close, the pattern detection sensor 117 cannot normally read the patterns. On the other hand, if the interval between the line patterns is too large, the value of the number of divisions n becomes small, and the alignment accuracy decreases. It is desirable to set the interval to the extent that the line patterns can be normally read by the pattern detection sensor 117 and to set the interval between the line patterns in the sub-scanning direction to be as narrow as possible.

For example, assuming that the interval between any two of the reference line patterns 511, the correction target first pattern 512 or the correction target second pattern 513, and the reference line patterns 511 is "10.41 mm" in either case of the Z pattern and the three-line pattern. In this case, the number of divisions n is approximately 72.05 (n=750/10.41). That is, the number of divisions n is approximately 72. In this case, the above expression (32) becomes the following expression (33).

Expression 33

$$m = \frac{72}{\tau} \times \alpha \tag{33}$$

where (α∈Z: Z is a set of integers).

The scale factor τ is determined based on the expression (33). For example, the order m of the shift of the periodic formation position that cannot be suppressed becomes "36" when the scale factor τ is "2", for example (m=72/2). The orders m of the shift of the periodic formation position that cannot be suppressed become "24 and 48" when the scale factor τ is "3" Here, the aforementioned orders m are compared with the orders m (1, 7.89, and 25) in which the shift of the periodic formation position is more likely to occur. There is a high possibility that the shift of the periodic formation position in the case where the order m is "24" and the shift of the periodic formation position in the case of "25" become similar, and when "3" is adopted as the scale factor τ, the shift of the periodic formation position cannot be effectively suppressed. Therefore, in such a case, "2" is adopted as the scale factor τ.

As described above, the scale factor τ of the interval for repeatedly forming the same line pattern is determined such that the order m calculated based on the ratio of the peripheral length and the order m of the shift of the periodic formation position that cannot be suppressed, of the endless components (rotational bodies) that cause the periodic speed variation, do not accord or do not substantially accord. Thereby, the influence of the shift of the periodic formation position occurring at each line pattern can be suppressed at the time of calculating the positional shift correction value, and high alignment accuracy can be implemented.

Another Embodiment of Image Forming Method

Next, alignment processing using the mark 500 according to the present embodiment will be described, as the image forming method according to another embodiment of the present invention. In the already described embodiment of the image forming method, when the pattern formation processing (S3003) is executed, an interval between the line patterns included in one Z pattern or the three-line pattern, and the scale factor τ of the interval for repeatedly forming the same line pattern may be determined based on "peripheral length information" stored in advance in the storage of the MFP 100. Here, the "peripheral length information" refers to information defined by a layout of the photoconductor drum 109, the intermediate transfer belt 105, the transfer roller 119, the charging roller 110, and the drive gear for the aforementioned rotational bodies included in the MFP 100.

Further, after the scale factor τ is determined based on the "peripheral length information", the Z pattern and the three-line pattern may be performed according to the parameter in the pattern formation processing (S3003). The "peripheral length information" and other parameters are stored in advance in a non-volatile storage included in the optical writing controller 120, and is read out each time the processing is executed. Alternatively, the processing may be executed using a fixed value calculated in advance.

The reason why the interval between the line patterns included in one Z pattern and the three-line pattern and the scale factor τ can be determined is because variation in the layout can be ignored. For example, in the case where the one round length of the intermediate transfer belt 105 is 750 mm, the range in which the peripheral length of the intermediate transfer belt 105 changes due to temperature change is about ±1.0 mm, and a variation amount is about ±0.13%.

Since the intermediate transfer belt 105 has a configuration in which the peripheral length easily changes due to the temperature change or the like in the endless components, the variation in the other components can be considered to be smaller. Therefore, the influence on the order m calculated based on the ratio of the peripheral length is small enough to ignore even if there is change over time in the endless component (rotational body) that causes the periodic speed variation. Therefore, even when the peripheral length information is determined and parameterized in advance, and the line patterns are formed using the parameter, the alignment can be performed with high accuracy.

As described above, the mark 500 is formed, the pattern detection processing for the mark 500 is performed by the pattern detection sensor 117, and the calculation result is notified to the correction value calculator 124 via the sensor controller 123. Subsequently, the correction value calculator 124 calculates the positional shift correction amount based on the detection result from the pattern detection sensor 117, and causes the correction value storage 126 to store the calculated positional shift correction value. When executing the image formation processing, the MFP 100 including the optical writing control device 111 adjusts the image formation position using the positional shift correction value stored in the correction value storage 126, thereby suppressing the shift of the formation position of the mark 500 of when executing the single alignment processing, and performing the alignment with high accuracy.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

a transfer belt;

a plurality of endless rotational bodies configured to rotate to superimpose color images onto the transfer belt;

an image forming device configured to form a plurality of correction patterns for calculating a correction value for correcting a positional shift caused when the color images are superimposed on the transfer belt; and a pattern sensor configured to detect the plurality of correction patterns formed on the transfer belt, the plurality of correction patterns including:

a first pattern formed by the image forming device as a straight line pattern orthogonal to a conveyance direction of the plurality of correction patterns in which the plurality of correction patterns is conveyed by rotation of the transfer belt; and a second pattern formed by the image forming device as one of a straight line pattern orthogonal to the conveyance direction and an oblique line pattern inclined with respect to the conveyance direction, each of the plurality of correction patterns including a set of combination patterns, each combination pattern of each set of combination patterns including one line of the second pattern disposed between two lines of the first pattern; and processing circuitry configured to cause the image forming device to form the plurality of correction patterns using the correction value, calculated based on a detection result of the pattern sensor, the second pattern included in one correction pattern of the plurality of correction patterns formed on the transfer belt being same in color as the second pattern included in at least one correction pattern of a preceding correction pattern of the plurality of correction patterns, and a following correction pattern of the plurality of correction patterns, in the conveyance direction with respect to the one correction pattern of the plurality of correction patterns, wherein the first pattern included in the plurality of correction patterns is formed with images representing a same color.

2. The image forming apparatus according to claim 1, further comprising a light source to emit light, wherein the plurality of endless rotational bodies includes an image bearer, and wherein the processing circuitry is further configured to cause the light source to emit the light according to image information to form an electrostatic latent image on the image bearer.

3. The image forming apparatus according to claim 2, wherein the plurality of endless rotational bodies includes a charging roller configured to charge a surface of the image bearer.

4. The image forming apparatus according to claim 1, wherein the plurality of endless rotational bodies includes a power transmission device configured to transmit power to rotate the transfer belt and the plurality of endless rotational bodies.

5. The image forming apparatus according to claim 1, wherein the processing circuitry is further configured to set a color of the images forming the first pattern to a reference color and is further configured to cause the image forming device to form the first pattern representing the reference color as a pattern indicating a reference position of alignment of an image of a color other than the reference color.

6. The image forming apparatus according to claim 5, wherein the reference color is black.

7. The image forming apparatus according to claim 1, wherein, upon the image forming device forming the plurality of sets of correction patterns and upon the pattern sensor failing to detect a positional shift in the plurality of correction patterns, the processing circuitry is further configured to cause the image forming device to form the plurality of sets of correction patterns such that an interval of the first pattern formed on a leading side of the plurality of sets of correction patterns in the conveying direction and an interval of the first pattern formed on a tailing side of the plurality of sets of correction patterns in the conveyance direction are detected at an equal interval by the pattern sensor.

8. The image forming apparatus according to claim 1, wherein, upon the image forming device forming a plurality of sets of correction patterns and the pattern sensor failing to detect a positional shift in the plurality of correction patterns, the processing circuitry is configured to cause the image forming device to form the plurality of sets of correction patterns such that an interval of the second pattern formed between adjacent correction patterns of the plurality of sets of correction patterns is detected at an equal interval by the pattern sensor.

9. The image forming apparatus according to claim 1, wherein, upon the image forming device forming a pair of correction patterns and the pattern sensor failing to detect a positional shift in the plurality of correction patterns, the processing circuitry is configured to cause the image forming device to form the pair of correction patterns such that intervals of the first pattern and the second pattern formed in the pair of correction patterns are detected at an equal interval by the pattern sensor.

10. The image forming apparatus according to claim 7, wherein, upon the image forming device forming the plurality of sets of correction patterns, the processing circuitry is configured to cause the image forming device to form the plurality of sets of correction patterns such that the first pattern overlaps between at least a part of adjacent correction patterns in adjacent sets of the plurality of sets of correction patterns.

11. The image forming apparatus according to claim 7, wherein, upon the image forming device forming the plurality of sets of correction patterns, the processing circuitry is configured to cause the image forming device to form the plurality of sets of correction patterns such that the first pattern overlaps between all adjacent correction patterns in adjacent sets of the plurality of sets of correction patterns.

12. The image forming apparatus according to claim 1, wherein the processing circuitry is configured to cause the image forming device to form the plurality of correction patterns such that a color and a shape of the first pattern included in a pair of correction patterns do not match a color and a shape represented in the second pattern included in the pair of correction patterns.

13. The image forming apparatus according to claim 1, wherein the processing circuitry is configured to cause the image forming device to form the plurality of correction patterns such that all of the second patterns included in the plurality of correction patterns to be formed at a formation timing corrected with the correction value calculated based on detection results of the plurality of correction patterns represent a same color and a same shape.

14. The image forming apparatus according to claim 13, wherein the processing circuitry is configured to cause the image forming device to form the plurality of sets of correction pattern such that all of the second patterns included in the plurality of correction patterns to be formed at a formation timing corrected with the correction value calculated based on detection results of a plurality of sets of correction patterns are different in at least one of a color and a shape from the second pattern included in the correction pattern formed at a formation timing corrected with a previous correction value.

15. The image forming apparatus according to claim 9, wherein, upon the image forming device forming the plurality of sets of correction patterns and the pattern sensor failing to detect positional shift in the plurality of correction patterns and upon the image forming device forming the plurality of sets of correction patterns such that all intervals of the first patterns and the second patterns included in the plurality of sets of correction patterns are detected at an equal interval by the pattern sensor, the processing circuitry is configured to cause the image forming device to:

determine, using a first real number obtained by dividing a peripheral length of one of the plurality of endless rotational bodies by a first formation interval that is the equal interval, and a second real number obtained by dividing a second formation interval of the second pattern included in correction patterns of adjacent sets of the plurality of sets of correction patterns by the first formation interval, the first formation interval and the second formation interval such that all of orders obtained by multiplying a value obtained by dividing the first real number by the second real number by an integer coefficient does not accord or does not substantially accord with an order of periodic speed variation caused by the one of the plurality of endless rotational bodies; and form the plurality of sets of correction patterns using the first formation interval and the second formation interval determined, at color matching operation.

16. The image forming apparatus according to claim 15, wherein the first formation interval and the second formation interval are preset fixed values, and wherein the image forming device forms the plurality of sets of correction patterns using the fixed values.

17. The image forming apparatus according to claim 15, wherein the order of the periodic speed variation corresponds to first-order variation in the periodic speed variation caused by the one of the plurality of endless rotational bodies.

18. An image forming apparatus comprising:

a transfer belt;

a plurality of endless rotational bodies configured to rotate to superimpose color images onto the transfer belt;

pattern formation means for forming a plurality of correction patterns for calculating a correction value for correcting a positional shift caused when the color images are superimposed on the transfer belt; and pattern detection means for detecting the plurality of correction patterns formed on the transfer belt, the plurality of correction patterns including:

a first pattern formed by the pattern formation means as a straight line pattern orthogonal to a conveyance direction of the plurality of correction patterns in which the plurality of correction patterns is conveyed by rotation of the transfer belt; and a second pattern formed by the pattern formation means as one of a straight line pattern orthogonal to the conveyance direction and an oblique line pattern inclined with respect to the conveyance direction, each of the plurality of correction patterns being a set of combination patterns, each combination pattern in which one line of the second pattern is disposed between two lines of the first pattern, the pattern formation means for forming the plurality of correction patterns using the correction value, which is calculated based on a detection result of the pattern detection means, such that the second pattern included in one correction pattern of the plurality of correction patterns formed on the transfer belt is same in color and shape as the second pattern included in at least one correction pattern of a preceding correction pattern and a following correction pattern in the conveyance direction with respect to the one correction pattern of the plurality of correction patterns.

19. An image forming method for superimposing images developed with developers in a plurality of colors by rotation of a plurality of endless rotational bodies to form a color image on a transfer belt, the image forming method comprising:

forming a plurality of correction patterns for calculating a correction value for correcting a positional shift caused when the images of the plurality of colors are superimposed on the transfer belt; and detecting the plurality of correction patterns formed on the transfer belt, the plurality of correction patterns including:

a first pattern formed as a straight line pattern orthogonal to a conveyance direction of the plurality of correction patterns in which the plurality of correction patterns is conveyed by rotation of the transfer belt; and a second pattern formed as one of a straight line pattern orthogonal to the conveyance direction and an oblique line pattern inclined with respect to the conveyance direction, each of the plurality of correction patterns being a set of combination patterns, each combination pattern in which one line of the second pattern is disposed between two lines of the first pattern; and forming the plurality of correction patterns using the correction value, which is calculated based on a detection result of the plurality of correction patterns, such that the second pattern included in one correction pattern of the plurality of correction patterns formed on the transfer belt is same in color and shape as the second pattern included in at least one correction pattern of a preceding correction pattern and a following correction pattern in the conveyance direction with respect to the one correction pattern of the plurality of correction patterns.

20. The image forming apparatus of claim 1, wherein each set of combination patterns includes a first correction sub-pattern, including the oblique line pattern of the second pattern disposed between two of the straight line patterns of the first pattern, and a second correction sub-pattern, including the straight line pattern of the second pattern disposed between two straight line patterns of the first pattern.

* * * * *